US010726679B2

(12) United States Patent
Hirai et al.

(10) Patent No.: US 10,726,679 B2
(45) **Date of Patent: *Jul. 28, 2020**

(54) GAMING SYSTEM AND METHODS OF OPERATING GAMING MACHINES TO PROVIDE SKILL-BASED WAGERING GAMES TO PLAYERS

(71) Applicant: Konami Gaming, Inc., Las Vegas, NV (US)

(72) Inventors: Tomoaki Hirai, Zama (JP); Toru Omoto, Zama (JP)

(73) Assignee: Konami Gaming, Inc., Las Vegas, NV (US)

( * ) Notice: Subject to any disclaimer, the term of this patent is extended or adjusted under 35 U.S.C. 154(b) by 182 days.

This patent is subject to a terminal disclaimer.

(21) Appl. No.: 15/720,823

(22) Filed: Sep. 29, 2017

(65) Prior Publication Data

US 2019/0096193 A1 Mar. 28, 2019

Related U.S. Application Data

(60) Provisional application No. 62/562,753, filed on Sep. 25, 2017.

(51) Int. Cl.
*G07F 17/32* (2006.01)

(52) U.S. Cl.
CPC ..... *G07F 17/3295* (2013.01); *G07F 17/3209* (2013.01); *G07F 17/3211* (2013.01); *G07F 17/3244* (2013.01)

(58) Field of Classification Search
CPC ..... A63F 13/814; A63F 2300/8047; G10H 2220/135; G10H 220/151
See application file for complete search history.

(56) References Cited

U.S. PATENT DOCUMENTS 5,816,915 A * 10/1998 Kadlic ..... G07F 17/32 463/13
6,390,923 B1 * 5/2002 Yoshitomi ..... A63F 13/00 463/43
6,669,563 B1 * 12/2003 Kitami ..... A63F 13/06 463/36

(Continued)

OTHER PUBLICATIONS

International Search Report and Written Opinion (International Application No. PCT/US 18/45978); dated Oct. 29, 2018; 8 pages.

*Primary Examiner* — Jay Trent Liddle
*Assistant Examiner* — Alex F. R. P. Rada, II
(74) *Attorney, Agent, or Firm* — Howard & Howard Attorneys PLLC

(57) ABSTRACT

A gaming machine for providing a skill-based wagering game to a player is described herein. The gaming machine a processor programmed to initiate a skill contest game and display a skill contest game on a display device, and determine a number of skill events being included in the skill contest game. Each skill event includes an image being displayed in a corresponding user input button for a predefined event time period. The processor determines a reference point total as a function of the number of skill events, and determines a normalized skill game point total based on the total amount of base points and the reference point total, determines an award as a function of the normalized skill game point total, and adjusts the credit balance based on the award.

20 Claims, 66 Drawing Sheets

(56) References Cited

U.S. PATENT DOCUMENTS

| | | | | |
|---|---|---|---|---|
| 6,843,726 | B1 * | 1/2005 | Nomi | A63F 13/06 463/43 |
| 2004/0192431 | A1 * | 9/2004 | Singer | G07F 17/3244 463/20 |
| 2011/0077079 | A1 * | 3/2011 | Ahn | A63F 13/06 463/31 |
| 2013/0288760 | A1 | 10/2013 | Chiwata | |
| 2014/0141863 | A1 | 5/2014 | Arnone et al. | |
| 2017/0200349 | A1 | 7/2017 | Englman et al. | |

* cited by examiner

118/120

128 132 100/108 100/102 130

| Weight | Chip Color | Skill Level (PERFECT) Table #1 | (GREAT) Table #2 | (GOOD) Table #3 | (BAD) Table #4 |
|---|---|---|---|---|---|
| 126 30.00000% | Bule | 2 | 2 | 2 | 2 |
| 30.00000% | Bule | 10 | 9 | 9 | 8 |
| 126 15.00000% | Bule | 20 | 18 | 17 | 15 |
| 10.00000% | Blule | 30 | 27 | 26 | 23 |
| 9.49000% | Gold | 40 | 36 | 34 | 30 |
| 2.50000% | Gold | 50 | 45 | 43 | 38 |
| 1.50000% | Gold | 100 | 90 | 85 | 75 |
| 1.00000% | Gold | 250 | 225 | 213 | 188 |
| 0.50000% | Gold | 500 | 450 | 425 | 375 |
| 0.01000% | Gold | 1000 | 900 | 850 | 750 |

FIG. 24

118/122

| Weight | Chip Color | Skill Level (PERFECT) Table #1 | (GREAT) Table #2 | (GOOD) Table #3 | (BAD) Table #4 |
|---|---|---|---|---|---|
| 126 42.3855% | Bule | 2 | 2 | 2 | 2 |
| 45.0000% | Bule | 10 | 9 | 9 | 8 |
| 7.0000% | Bule | 20 | 18 | 17 | 15 |
| 126 3.0000% | Blule | 30 | 27 | 26 | 23 |
| 1.6000% | Gold | 40 | 36 | 34 | 30 |
| 0.9145% | Gold | 50 | 45 | 43 | 38 |
| 0.0500% | Gold | 100 | 90 | 85 | 75 |
| 0.0250% | Gold | 250 | 225 | 213 | 188 |
| 0.0200% | Gold | 500 | 450 | 425 | 375 |
| 0.0050% | Gold | 1000 | 900 | 850 | 750 |

FIG. 25

118/124

| Weight | Chip Color | Skill Level (PERFECT) Table #1 | (GREAT) Table #2 | (GOOD) Table #3 | (BAD) Table #4 |
|---|---|---|---|---|---|
| 126 60.000% | Bule | 2 | 2 | 2 | 2 |
| 32.400% | Bule | 10 | 9 | 9 | 8 |
| 5.000% | Bule | 20 | 18 | 17 | 15 |
| 126 1.000% | Blule | 30 | 27 | 26 | 23 |
| 1.000% | Gold | 40 | 36 | 34 | 30 |
| 0.500% | Gold | 50 | 45 | 43 | 38 |
| 0.050% | Gold | 100 | 90 | 85 | 75 |
| 0.025% | Gold | 250 | 225 | 213 | 188 |
| 0.020% | Gold | 500 | 450 | 425 | 375 |
| 0.005% | Gold | 1000 | 900 | 850 | 750 |

FIG. 26

134

142 140 138

| Pattern # | RTP level | | | | RTP % | | | | Avg. | Weight |
|---|---|---|---|---|---|---|---|---|---|---|
| | Stage1 | Stage2 | Stage3 | Stage4 | Stage1 | Stage2 | Stage3 | Stage4 | | |
| 136 1 | Low | Low | Low | Middle | 74.0% | 74.0% | 74.0% | 97.6% | 79.9% | 32 |
| 2 | Low | Low | Middle | High | 74.0% | 74.0% | 97.6% | 220.0% | 116.4% | 8 |
| 3 | Middle | Low | Low | Middle | 97.6% | 74.0% | 74.0% | 97.6% | 85.8% | 32 |
| 136 4 | Low | Middle | Low | High | 74.0% | 97.6% | 74.0% | 220.0% | 116.4% | 8 |
| 5 | Middle | Middle | Low | Middle | 97.6% | 97.6% | 74.0% | 97.6% | 91.7% | 32 |
| 6 | Middle | Low | Middle | High | 97.6% | 74.0% | 97.6% | 220.0% | 122.3% | 4 |
| 7 | Low | Middle | Middle | High | 74.0% | 97.6% | 97.6% | 220.0% | 122.3% | 4 |
| 8 | Middle | Middle | Middle | High | 97.6% | 97.6% | 97.6% | 220.0% | 128.2% | 4 |
| 9 | Low | Low | Low | High | 74.0% | 74.0% | 74.0% | 220.0% | 110.5% | 16 |
| 10 | Low | Middle | High | High | 74.0% | 97.6% | 220.0% | 220.0% | 152.9% | 2 |

FIG. 27

144/150

148 100

146

| Game Score | Skill Level |
|---|---|
| more than 10000 | PERFECT (Table #1) |
| 7500 to 10000 | GREAT (Table #2) |
| 2500 to 7500 | GOOD (Table #3) |
| less than 2500 | BAD (Table #4) |

FIG. 28

152

146

| Number of objects passed | Skill Level |
|---|---|
| 15 or more | PERFECT (Table #1) |
| 10 to 15 | GREAT (Table #2) |
| 5 to 10 | GOOD (Table #3) |
| less than 5 | BAD (Table #4) |

FIG. 29

154

146

| LAP TIME | Skill Level |
|---|---|
| less than 00'01"00 | PERFECT (Table #1) |
| 00'01"00 to 00'01"30 | GREAT (Table #2) |
| 00'01"30 to 00'02"00 | GOOD (Table #3) |
| more than 00'02"00 | BAD (Table #4) |

FIG. 30

156

146

| Direction | Length | Skill Level |
|---|---|---|
| GOOD | GOOD | PERFECT (Table #1) |
| GOOD | BAD | GREAT (Table #2) |
| BAD | GOOD | GOOD (Table #3) |
| BAD | BAD | BAD (Table #4) |

FIG. 31

156/158

146

| Number of strokes | Skill Level |
|---|---|
| -2 or less | PERFECT (Table #1) |
| -1 | GREAT (Table #2) |
| ±0 | GOOD (Table #3) |
| +1 or more | BAD (Table #4) |

FIG. 32

160

146

| Caused Damage to Opponent | Skill Level |
|---|---|
| Extra Large (more than 60% of Stamina) | PERFECT (Table #1) |
| Lage (40% to 60% of Stamina) | GREAT (Table #2) |
| Midium (20% to 40% of Stamina) | GOOD (Table #3) |
| Small (less than 20% of Stamina) | BAD (Table #4) |

FIG. 33

160

146

| Number of HIT COMBINATION | Skill Level |
|---|---|
| 10 or more | PERFECT (Table #1) |
| 5 to 10 | GREAT (Table #2) |
| 2 to 5 | GOOD (Table #3) |
| less than 2 | BAD (Table #4) |

FIG. 34

160

146

| Remaining Stamina | Skill Level |
|---|---|
| 90% or more | PERFECT (Table #1) |
| 60% to 90% | GREAT (Table #2) |
| 40% to 60% | GOOD (Table #3) |
| less than 40% | BAD (Table #4) |

FIG. 35

160

146

| Evaluation score | Skill Level |
|---|---|
| 500,000 or more | PERFECT (Table #1) |
| 300,000 to 500,000 | GREAT (Table #2) |
| 100,000 to 300,000 | GOOD (Table #3) |
| less than 100,000 | BAD (Table #4) |

FIG. 36

174

| | |
|---|---|
| Music Title | Gimme a Big Beat |
| Artist Name | kors k |
| LEVEL (Default Value) | 5 / STAR : 2.5 |
| BPM | 138 |
| GENRE | Dance/Electoronic |
| Sound Label | Csd_BSQ_MUSIC_Game_001 |
| Source Code Label | BSQ_MUSIC_Game_001 |

| | |
|---|---|
| Length of Music(Sec) | 46.953 |
| Number of Lit Square | 100 |

FIG. 37

178

| LEVEL | 1 | 2 | 3 | 4 | 5 | 6 | 7 | 8 | 9 | 10 |
|---|---|---|---|---|---|---|---|---|---|---|
| # of STAR | 0.5 | 1.0 | 1.5 | 2.0 | 2.5 | 3.0 | 3.5 | 4.0 | 4.5 | 5.0 |
| Difficulty level | Easy ← | | | | | | | | | → Hard |

FIG. 38

176

| LEVEL | 1 | 2 | 3 | 4 | 5 | 6 | 7 | 8 | 9 | 10 |
|---|---|---|---|---|---|---|---|---|---|---|
| Result(X) | 10 >=X > 9 | 9 >= X > 8 | 8 >= X > 7 | 7 >= X > 6 | 6 >= X > 5 | 5 >= X > 4 | 4 >= X > 3 | 3 >= X >2 | 2 >= X > 1 | 1 >= X > 0 |

FIG. 39

L-807-BSA/Beat Square

MusicNotes_001

Music Notes

| | |
|---|---|
| Length of Music | 46.953 |
| Number of Lit Square | 100 |

180

TimeLine

182 182

| No. | Time | Actual Position | | | |
|---|---|---|---|---|---|
| | Sec | Pattern 1 (Basic) | Pattern 2 (Flip Horizontal) | Pattern 3 (Flip Vertical) | Pattern 4 (Rotate 180) |
| 1 | 3.476 | 14 | 15 | 2 | 3 |
| 2 | 3.476 | 15 | 14 | 3 | 2 |
| 3 | 4.346 | 9 | 12 | 5 | 8 |
| 4 | 5.000 | 12 | 9 | 8 | 5 |
| 5 | 6.086 | 6 | 7 | 10 | 11 |
| 6 | 6.520 | 7 | 6 | 11 | 10 |
| 7 | 6.956 | 1 | 4 | 13 | 16 |
| 8 | 6.956 | 4 | 1 | 16 | 13 |
| 9 | 7.823 | 5 | 8 | 9 | 12 |
| 10 | 8.476 | 8 | 5 | 12 | 9 |
| 11 | 9.563 | 9 | 12 | 5 | 8 |
| 12 | 10.000 | 12 | 9 | 8 | 5 |
| 13 | 10.433 | 14 | 15 | 2 | 3 |
| 14 | 10.433 | 15 | 14 | 3 | 2 |
| 15 | 11.303 | 9 | 12 | 5 | 8 |
| 16 | 11.956 | 12 | 9 | 8 | 5 |
| 17 | 13.040 | 5 | 8 | 9 | 12 |
| 18 | 13.476 | 8 | 5 | 12 | 9 |
| 19 | 13.910 | 6 | 7 | 10 | 11 |
| 20 | 13.910 | 7 | 6 | 11 | 10 |
| 21 | 14.780 | 1 | 4 | 13 | 16 |
| 22 | 15.433 | 4 | 1 | 16 | 13 |

Actual Position

| | | | |
|---|---|---|---|
| 1 | 2 | 3 | 4 |
| 5 | 6 | 7 | 8 |
| 9 | 10 | 11 | 12 |
| 13 | 14 | 15 | 16 |

186

Count of appearance

Pattern 1(Basic)

| | | | |
|---|---|---|---|
| 10 | 4 | 3 | 11 |
| 7 | 8 | 9 | 6 |
| 6 | 6 | 5 | 7 |
| 5 | 4 | 5 | 4 |

Pattern 2(Flip Horizontal)

| | | | |
|---|---|---|---|
| 11 | 3 | 4 | 10 |
| 6 | 9 | 8 | 7 |
| 7 | 5 | 6 | 6 |
| 4 | 5 | 4 | 5 |

Pattern 3(Flip Vertical)

| | | | |
|---|---|---|---|
| 5 | 4 | 5 | 4 |
| 6 | 6 | 5 | 7 |
| 7 | 8 | 9 | 6 |
| 10 | 4 | 3 | 11 |

Pattern 4(Rotate 180 degrees)

| | | | |
|---|---|---|---|
| 4 | 5 | 4 | 5 |
| 7 | 5 | 6 | 6 |
| 6 | 9 | 8 | 7 |
| 11 | 3 | 4 | 10 |

Position Table

| P1 | P2 | P3 | P4 |
|---|---|---|---|
| 1 | 4 | 13 | 16 |
| 2 | 3 | 14 | 15 |
| 3 | 2 | 15 | 14 |
| 4 | 1 | 16 | 13 |
| 5 | 8 | 9 | 12 |
| 6 | 7 | 10 | 11 |
| 7 | 6 | 11 | 10 |
| 8 | 5 | 12 | 9 |
| 9 | 12 | 5 | 8 |
| 10 | 11 | 6 | 7 |
| 11 | 10 | 7 | 6 |
| 12 | 9 | 8 | 5 |
| 13 | 16 | 1 | 4 |
| 14 | 15 | 2 | 3 |
| 15 | 14 | 3 | 2 |
| 16 | 13 | 4 | 1 |

184

FIG. 40

134

136

| Pattern | Stage1 | Stage2 | Stage3 | Stage4 | Weight |
|---|---|---|---|---|---|
| 1 | Low | Low | Low | Middle | 31 |
| 2 | Low | Low | Middle | Middle | 66 |
| 3 | Middle | Low | Low | Middle | 86 |
| 4 | Low | Middle | Low | Middle | 104 |
| 5 | Middle | Middle | Low | Middle | 127 |
| 6 | Middle | Low | Middle | Middle | 146 |
| 7 | Low | Middle | Middle | Middle | 176 |
| 8 | Middle | Middle | Middle | Middle | 176 |
| 9 | Low | Low | Low | High | 9 |
| 10 | Low | Low | Middle | High | 9 |
| 11 | Low | Middle | Low | High | 8 |
| 12 | Middle | Low | Low | High | 7 |
| 13 | Low | Middle | Middle | High | 6 |
| 14 | Middle | Middle | Low | High | 6 |
| 15 | Middle | Low | Middle | High | 6 |
| 16 | Middle | Middle | Middle | High | 5 |
| 17 | Low | Low | High | High | 5 |
| 18 | High | Low | Low | High | 4 |
| 19 | Low | High | Low | High | 4 |
| 20 | Low | Middle | High | High | 2 |
| 21 | Middle | Low | High | High | 2 |
| 22 | Middle | Middle | High | High | 2 |
| 23 | High | Middle | Middle | High | 2 |
| 24 | Middle | High | Middle | High | 2 |
| 25 | High | High | Low | High | 2 |
| 26 | High | Low | High | High | 2 |
| 27 | Low | High | High | High | 1 |
| 28 | High | High | Middle | High | 1 |
| 29 | High | Middle | High | High | 1 |
| 30 | Middle | High | High | High | 1 |
| 31 | High | High | High | High | 1 |
| | | | | | 1000 |

FIG. 41

118/120

Perfect Judgment of touch

Low

| | Win | Weight | Cycle | | Note |
|---|---|---|---|---|---|
| 1 | 0 | 25911 | 1.54 | 0.647775 | No win |
| 2 | 1 | 11998 | 3.33 | 0.299950 | win |
| 3 | 2 | 1100 | 36.36 | 0.027500 | win |
| 4 | 3 | 584 | 68.49 | 0.014600 | win |
| 5 | 5 | 300 | 133.33 | 0.007500 | win |
| 6 | 10 | 100 | 400.00 | 0.002500 | win |
| 7 | 15 | 0 | - | - | - |
| 8 | 20 | 0 | - | - | - |
| 9 | 25 | 0 | - | - | - |
| 10 | 50 | 5 | 8000.00 | 0.000125 | win |
| 11 | 75 | 0 | - | - | - |
| 12 | 100 | 0 | - | - | - |
| 13 | 150 | 0 | - | - | - |
| 14 | 250 | 2 | 20000.00 | 0.000050 | Big win |
| 15 | 2000 | 0 | - | - | - |
| | | 40000 | | | |

RTP 48.0000%

FIG. 42

118/122

Middle

| Win | Weight | Cycle | | Note |
|---|---|---|---|---|
| 0 | 25149 | 1.59 | 0.628725 | No win |
| 1 | 12000 | 3.33 | 0.300000 | win |
| 2 | 1420 | 28.17 | 0.035500 | win |
| 3 | 750 | 53.33 | 0.018750 | win |
| 5 | 500 | 80.00 | 0.012500 | win |
| 10 | 121 | 330.58 | 0.003025 | win |
| 15 | 0 | - | - | - |
| 20 | 0 | - | - | - |
| 25 | 0 | - | - | - |
| 50 | 57 | 701.75 | 0.001425 | win |
| 75 | 0 | - | - | - |
| 100 | 0 | - | - | - |
| 150 | 0 | - | - | - |
| 250 | 3 | 13333.33 | 0.000075 | Big win |
| 2000 | 0 | - | - | - |
| | 40000 | | | |

RTP 61.0000%

FIG. 43

118/124

High

| Win | Weight | Cycle | | Note |
|---|---|---|---|---|
| 0 | 10243 | 3.91 | 0.256050 | No win |
| 1 | 7910 | 5.06 | 0.197750 | win |
| 2 | 5008 | 7.99 | 0.125200 | win |
| 3 | 6107 | 6.55 | 0.152675 | win |
| 5 | 4206 | 9.51 | 0.105150 | win |
| 10 | 4309 | 9.28 | 0.107725 | win |
| 15 | 0 | - | | |
| 20 | 0 | - | | - |
| 25 | 0 | | | |
| 50 | 1918 | 20.86 | 0.047950 | win |
| 75 | 0 | - | | - |
| 100 | 0 | | | |
| 150 | 0 | - | | |
| 250 | 260 | 153.85 | 0.006500 | Big win |
| 2000 | 40 | 1000.00 | 0.001000 | Big win |
| | 40000 | | | |
| RTP | 853.1675% | | | |

FIG. 44

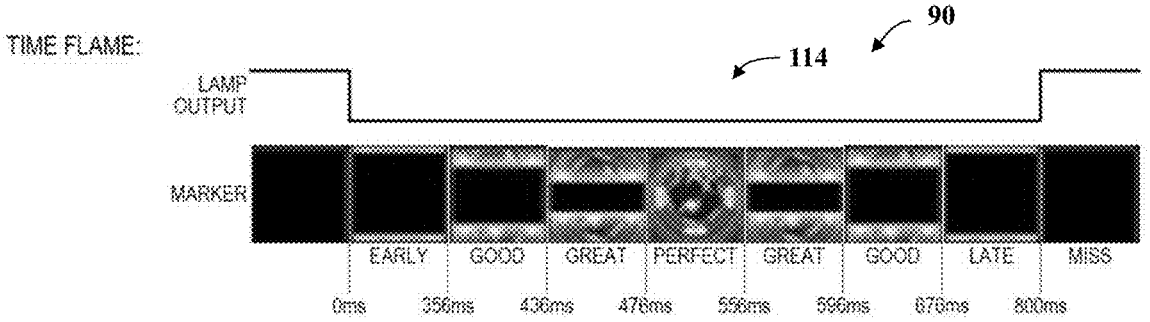
FIG. 45
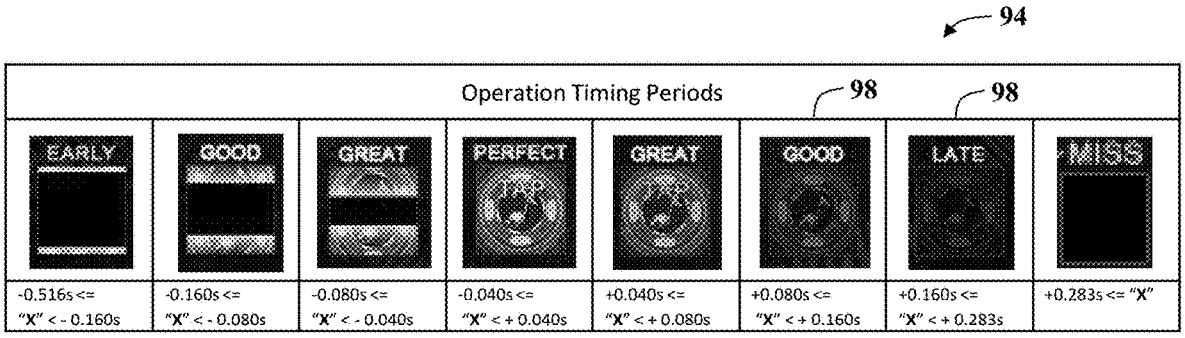
FIG. 46
94
| Event Time Period = 800ms | |
|---|---|
| Touch Operation Skill Value Level | Operation Timing Periods |
| Early | -0.516s <= X < -0.160s |
| Good | -0.160s <= X < -0.080s |
| Great | -0.080s <= X < -0.040s |
| Perfect | -0.040s <= X < +0.040s |
| Great | +0.040s <= X < +0.080s |
| Good | +0.080s <= X < +0.160s |
| Late | +0.160s <= X < +0.283s |
| Miss | +0.283s <= X |
100 98
FIG. 47

118

188

190 190

| Number of Gold Coins Triggering Skill Contest Game | 3 Gold Coins | 4 Gold Coins | 5 Gold Coins |
|---|---|---|---|
| Trigger cycle (Paytable: V05) | 39.27 games | 446.90 games | 12960.00 games |
| Score calculation for wins | 1 credit = 100 points | 1 credit = 10 points | 1 credit = 1 point |
| Ranges of bonus credit (Case of 500credits(x1)) | 300 – 1,000 credits | 3,000 – 10,000 credits | 30,000 – 100,000 credits |

600

100 602

| Result of Skill | Points |
|---|---|
| Perfect | 10 |
| Great | 8 |
| Good | 6 |
| Early / Late | 4 |
| Miss | 3 |

FIG. 50

608

| Reference Number Upper Value | | |
|---|---|---|
| # of markers | Points for a perfect touch | Reference Number Upper value of the accumulated base points |
| 300 | 10 | 3000 |

610

FIG. 51

604

100 602 602

| Skill Game Result | | | |
|---|---|---|---|
| Touch Operation | Base Points | Count | Accumulated Base Points |
| Perfect | 10 | 81 | 810 |
| Great | 8 | 147 | 1176 |
| Good | 6 | 60 | 360 |
| Early / Late | 4 | 9 | 36 |
| Miss | 3 | 3 | 9 |
| | Total | 300 | 2391 |

FIG. 52

612

| Skill Contest Game Result | | | |
|---|---|---|---|
| Amount of Earned Points | Reference Points | Max Scope | Normalized Earned Score |
| 2391 | 3000 | 100000 | 79700 |

606

FIG. 53

198

| Award Reset and Increment for Total Bet Amounts | | |
|---|---|---|
| Progressive | Reset | Increment Rate |
| Gold Crown | $1,000 | 0.05% |
| Silver Crown | $100 | 0.10% |
| Bronze Crown | $30 | 0.30% |

FIG. 54

198

| Progressive Award Trigger Cycle in Total | | | | |
|---|---|---|---|---|
| Progressive | 500credits(1x) | 1000credits(2x) | 1500credits(3x) | 2000credits(4x) |
| Gold Crown | 43200.00 | 21600.00 | 14400.00 | 10800.00 |
| Silver Crown | 2009.30 | 1004.65 | 669.77 | 502.33 |
| Bronze Crown | 557.42 | 278.71 | 185.81 | 139.35 |

FIG. 55

1132

| Team Assignment | Team Cabinet Color |
|---|---|
| A | RED |
| B | BLUE |
| C | GREEN |
| D | YELLOW |
| E | PURPLE |
| F | ORANGE |
| G | CYAN |
| H | PINK |

FIG. 75

1134

1136

| Cabinet No. | Team Assignment | Team Cabinet Color |
|---|---|---|
| ID #1 | A | RED |
| ID #2 | B | BLUE |
| ID #3 | C | GREEN |
| ID #4 | D | YELLOW |
| ID #5 | E | PURPLE |
| ID #6 | F | ORANGE |
| ID #7 | G | CYAN |
| ID #8 | H | PINK |

FIG. 76

1134

1138

| Cabinet No. | Team Assignment | Team Cabinet Color |
|---|---|---|
| ID #1 | A | RED |
| ID #2 | A | RED |
| ID #3 | B | BLUE |
| ID #4 | B | BLUE |
| ID #5 | C | GREEN |
| ID #6 | C | GREEN |
| ID #7 | D | YELLOW |
| ID #8 | D | YELLOW |

FIG. 77

GAMING SYSTEM AND METHODS OF OPERATING GAMING MACHINES TO PROVIDE SKILL-BASED WAGERING GAMES TO PLAYERS

CROSS-REFERENCE TO RELATED APPLICATION

This application claims priority to U.S. Provisional Patent Application Ser. No. 62/562,753, filed Sep. 25, 2017, which is hereby incorporated by reference in its entirety.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to gaming machines and more particularly, to gaming machines and methods for operating gaming machines to provide skill-based wagering games to players.

BACKGROUND OF THE INVENTION

Known gaming machines include a video display device to display a reel game that includes a plurality of reels with each reel including a plurality of symbols. During game play, the gaming machine accepts a wager from a player, the player selects one or more paylines, the gaming machine spins the reels, and sequentially stops each reel to display a combination of symbols on the reels. The gaming machine then awards the player an award based on the combination of symbols orientated along the selected paylines. At least some known gaming machines may also include bonus feature games that may include additional free spins and/or progressive awards.

Overtime, players may become frustrated with known wagering game feature because the games have limited player interaction and affect on the game outcome. Accordingly, new features are necessary to appeal to player interest and enhance excitement in order to entice longer play and increased profitability. The present invention is directed to satisfying these needs.

SUMMARY OF THE INVENTION

In one aspect of the present invention, a gaming machine for providing a skill-based wagering game to a player is provided. The gaming machine includes a display device, a user input device, and a controller including a processor coupled to a memory device. The user input device includes a player selection device, an accepting device, and a cashout device. The player selection device is configured to generate a signal indicating a player's selection input. The accepting device is configured to accept an item associated with a monetary value to establish a credit balance being increasable and decreasable based at least on wagering activity. The cashout device is configured to receive an input to cause an initiation of a payout associated with the credit balance. The memory device stores a plurality of award paytables. Each of the award paytables includes a plurality of skill event records. Each skill event record includes a corresponding selection probability and a plurality of award values. Each award value is associated with a corresponding skill level value. The controller is programmed to display a skill-based wagering game on the display device, receive a signal indicating a wager being received from the player, and initiate the skill-based wagering game. The controller generates and displays a skill event associated with the skill-based wagering game, and randomly selects a skill event record associated with the skill event. The controller then receives a player's selection input via the user input device in response to the displayed skill event, determines a player skill level value based on the received player's selection, and determines an award value included in the selected skill event record based on the player skill level value. The controller then adjusts the credit balance based on the determined award value.

In another aspect of the present invention, a computer-implemented method of operating a gaming machine is provided. The gaming machine includes a display device, a user input device, and a controller. The method includes the controller displaying a skill-based wagering game on the display device, receiving, from the user input device, a signal indicating a wager being placed by the player, and adjusting a credit balance. The user input device includes a player selection device, an accepting device, and a cashout device. The player selection device is configured to generate a signal indicating a player's selection input. The accepting device is configured to accept an item associated with a monetary value to establish a credit balance being increasable and decreasable based at least on wagering activity. The cashout device is configured to receive an input to cause an initiation of a payout associated with the credit balance. The controller initiates the skill-based wagering game upon receiving the wager and accesses a memory device that stores a plurality of award paytables. Each of the award paytables includes a plurality of skill event records. Each skill event record includes a corresponding selection probability and a plurality of award values. Each award value is associated with a corresponding skill level value. The controller generates a skill event associated with the skill-based wagering game, randomly selects a skill event record associated with the skill event, and displays the skill event on the display device. The controller also receives a player's selection input via the user input device in response to the displayed skill event, determines a player skill level value based on the received player's selection, determines an award value included in the selected skill event record based on the player skill level value, and adjusts the credit balance based on the determined award value.

In yet another aspect of the present invention, one or more non-transitory computer-readable storage media, having computer-executable instructions embodied thereon, is provided. The computer-executable instructions cause a processor to display a skill-based wagering game on the display device, receive, from a user input device, a signal indicating a wager being placed by the player, and adjust a credit balance. The user input device includes a player selection device, an accepting device, and a cashout device. The player selection device is configured to generate a signal indicating a player's selection input. The accepting device is configured to accept an item associated with a monetary value to establish a credit balance being increasable and decreasable based at least on wagering activity. The cashout device is configured to receive an input to cause an initiation of a payout associated with the credit balance. The processor initiates the skill-based wagering game upon receiving the wager and accesses a memory device storing a plurality of award paytables. Each of the award paytables includes a plurality of skill event records. Each skill event record includes a corresponding selection probability and a plurality of award values. Each award value is associated with a corresponding skill level value. The processor generates a skill event associated with the skill-based wagering game, randomly selects a skill event record associated with the skill event, and displays the skill event on the display device. The processor receives a player's selection input via the user input device in response to the displayed skill event, determines a player skill level value based on the received player's selection, determines an award value included in the selected skill event record based on the player skill level value, and adjusts the credit balance based on the determined award value.

In one aspect of the present invention, a gaming machine for providing a skill-based wagering game to a player is provided. The gaming machine includes a display device, a user input device, and a controller that includes a processor. The display device is configured to display a game screen including a plurality of user input buttons arranged in a matrix using computer generated graphical images. The user input device includes a player selection device, an acceptor device, and a cashout device. The player selection device is configured to generate and transmit a signal indicating a player touch operation associated with each of the user input buttons. The acceptor device is configured to accept an item associated with a monetary value to establish a credit balance being increasable and decreasable based at least on wagering activity. The cashout device is configured to receive an input to cause an initiation of a payout associated with the credit balance. The processor is programmed to receive a signal from the user input device indicating a wager being placed by the player, initiate a skill contest game and display the skill contest game on the display device, and determine a number of skill events being included in the skill contest game. Each skill event includes an image being displayed in a corresponding user input button for a predefined event time period. The processor determines a reference point total as a function of the number of skill events, conducts a round of the skill contest game including displaying the skill events on the game screen in a sequential display pattern, detects a player touch operation associated with each skill event, and determines a total amount of base points associated with the detected player touch operations. The processor determines a normalized skill game point total based on the total amount of base points and the reference point total, determines an award as a function of the normalized skill game point total, and adjusts the credit balance based on the award.

In another aspect of the present invention, a method of operating a gaming machine is provided. The gaming machine includes a display device, a user input device, and a controller including a processor. The method includes the processor performing the steps of displaying a skill-based wagering game on the display device including a game screen including a plurality of user input buttons arranged in a matrix using computer generated graphical images and receiving a signal from the user input device indicating a wager being placed by the player. The user input device includes a player selection device, an acceptor device, and a cashout device. The player selection device is configured to generate and transmit a signal indicating a player touch operation associated with each of the user input buttons. The acceptor device is configured to accept an item associated with a monetary value to establish a credit balance being increasable and decreasable based at least on wagering activity. The cashout device is configured to receive an input to cause an initiation of a payout associated with the credit balance. The processor initiates a skill contest game and displays the skill contest game on the display device, and determines a number of skill events being included in the skill contest game. Each skill event includes an image being displayed in a corresponding user input button for a predefined event time period. The processor determines a reference point total as a function of the number of skill events, conducts a round of the skill contest game including displaying the skill events on the game screen in a sequential display pattern, detects a player touch operation associated with each skill event, and determines a total amount of base points associated with the detected player touch operations. The processor determines a normalized skill game point total based on the total amount of base points and the reference point total, determines an award as a function of the normalized skill game point total, and adjusts the credit balance based on the award.

In yet another aspect of the present invention, one or more non-transitory computer-readable storage media, having computer-executable instructions embodied thereon, is provided. The computer-executable instructions cause a processor to display a skill-based wagering game on a display device including a game screen including a plurality of user input buttons arranged in a matrix using computer generated graphical images. The processor receives a signal from a user input device indicating a wager being placed by the player. The user input device includes a player selection device, an acceptor device, and a cashout device. The player selection device is configured to generate and transmit a signal indicating a player touch operation associated with each of the user input buttons. The acceptor device is configured to accept an item associated with a monetary value to establish a credit balance being increasable and decreasable based at least on wagering activity. The cashout device is configured to receive an input to cause an initiation of a payout associated with the credit balance. The processor initiates a skill contest game and displays the skill contest game on the display device, and determines a number of skill events being included in the skill contest game. Each skill event includes an image being displayed in a corresponding user input button for a predefined event time period. The processor determines a reference point total as a function of the number of skill events and conducts a round of the skill contest game including displaying the skill events on the game screen in a sequential display pattern, detects a player touch operation associated with each skill event, and determines a total amount of base points associated with the detected player touch operations. The processor determines a normalized skill game point total based on the total amount of base points and the reference point total, determines an award as a function of the normalized skill game point total, and adjusts the credit balance based on the award.

In one embodiment, a gaming system for providing a tournament skill-based game to players is provided. The gaming system includes a plurality of gaming machines connected together via a communications network. The plurality of gaming machines includes a host gaming machine and a plurality of node gaming machines. Each of the plurality of gaming machines is configured to provide a skill-based game to a player and includes a processor coupled to a memory device, a display device and a user input device. The display device is configured to display a game screen including a plurality of user input buttons arranged in a matrix using computer generated graphical images. The user input device includes a player selection device, an acceptor device, and a cashout device. The player selection device is configured to generate and transmit a signal indicating a player touch operation associated with each of the user input buttons. The acceptor device is configured to accept an item associated with a monetary value to establish a credit balance being increasable and decreasable based at least on wagering activity. The cashout device is configured to receive an input to cause an initiation of a payout associated with the credit balance. The host gaming machine includes a processor programmed to receive a request to initiate a tournament skill game with the plurality of gaming machines, identify participating gaming machines from the plurality of gaming machines that are participating in the tournament skill game, and assign a team identifier to each participating gaming machine. The participating gaming machines include the host gaming machine and at least one participating node gaming machine. The host gaming machine is configured to receive a selection of a musical soundtrack associated with the tournament skill game, determine a number of skill events and a sequential display pattern associated with the selected musical soundtrack, and transmit a data file to each participating node gaming machine indicating the selected musical soundtrack, the associated number of skill events, and the associated sequential display pattern. The host gaming machine is configured to transmit an initiation signal to each participating node gaming machine causing each participating node gaming machine to initiate the tournament skill game in coordination with the host gaming machine. Each participating gaming machine simultaneously conducts a round of the tournament skill game including displaying the skill events in the sequential display pattern with the selected musical soundtrack.

In another embodiment, a method of operating a gaming system is provided. The gaming system including a plurality of gaming machines connected together via a communications network. The plurality of gaming machines including a host gaming machine and a plurality of node gaming machines. Each of the plurality of gaming machines is configured to provide a skill-based game to a player and includes a processor coupled to a memory device, a display device and a user input device. The display device is configured to display a game screen including a plurality of user input buttons arranged in a matrix using computer generated graphical images. The user input device includes a player selection device, an acceptor device, and a cashout device. The player selection device is configured to generate and transmit a signal indicating a player touch operation associated with each of the user input buttons. The acceptor device is configured to accept an item associated with a monetary value to establish a credit balance being increasable and decreasable based at least on wagering activity. The cashout device is configured to receive an input to cause an initiation of a payout associated with the credit balance. The method includes the processor of the host gaming machine performing the steps of receiving a request to initiate a tournament skill game with the plurality of gaming machines, identifying participating gaming machines from the plurality of gaming machines that are participating in the tournament skill game, and assigning a team identifier to each participating gaming machine. The participating gaming machines include the host gaming machine and at least one participating node gaming machine. The host gaming machine receives a selection of a musical soundtrack associated with the tournament skill game, determines a number of skill events and a sequential display pattern associated with the selected musical soundtrack, and transmits a data file to each participating node gaming machine indicating the selected musical soundtrack, the associated number of skill events, and the associated sequential display pattern. The host gaming machine transmits an initiation signal to each participating node gaming machine causing each participating node gaming machine to initiate the tournament skill game in coordination with the host gaming machine. Each participating gaming machine simultaneously conducts a round of the tournament skill game including displaying the skill events in the sequential display pattern with the selected musical soundtrack.

In yet another aspect of the present invention, one or more non-transitory computer-readable storage media, having computer-executable instructions embodied thereon, is provided. The computer-executable instructions cause a processor to function as a gaming system that includes a plurality of gaming machines connected together via a communications network. The plurality of gaming machines include a host gaming machine and a plurality of node gaming machines. Each of the plurality of gaming machines is configured to provide a skill-based game to a player and includes a processor coupled to a memory device, a display device and a user input device. The display device is configured to display a game screen including a plurality of user input buttons arranged in a matrix using computer generated graphical images. The user input device includes a player selection device, an acceptor device, and a cashout device. The player selection device is configured to generate and transmit a signal indicating a player touch operation associated with each of the user input buttons. The acceptor device is configured to accept an item associated with a monetary value to establish a credit balance being increasable and decreasable based at least on wagering activity. The cashout device is configured to receive an input to cause an initiation of a payout associated with the credit balance. The host gaming machine includes a processor programmed to receive a request to initiate a tournament skill game with the plurality of gaming machines, identify participating gaming machines from the plurality of gaming machines that are participating in the tournament skill game, and assign a team identifier to each participating gaming machine. The participating gaming machines include the host gaming machine and at least one participating node gaming machine. The host gaming machine is configured to receive a selection of a musical soundtrack associated with the tournament skill game, determine a number of skill events and a sequential display pattern associated with the selected musical soundtrack, and transmit a data file to each participating node gaming machine indicating the selected musical soundtrack, the associated number of skill events, and the associated sequential display pattern. The host gaming machine is configured to transmit an initiation signal to each participating node gaming machine causing each participating node gaming machine to initiate the tournament skill game in coordination with the host gaming machine. Each participating gaming machine simultaneously conducts a round of the tournament skill game including displaying the skill events in the sequential display pattern with the selected musical soundtrack.

BRIEF DESCRIPTION OF THE DRAWINGS

Other advantages of the present invention will be readily appreciated as the same becomes better understood by reference to the following detailed description when considered in connection with the accompanying drawings wherein:

FIGS. 24-36 are exemplary illustrations of data records that may be used by the gaming machine shown in FIG. 1, according to an embodiment of the present invention;

FIGS. 37-55 are exemplary illustrations of data files that may be used by the gaming machine shown in FIG. 1, according to an embodiment of the present invention;

FIGS. 75-77 are exemplary illustrations of data files that may be used by the gaming system shown in FIGS. 69-72, according to an embodiment of the present invention;

Corresponding reference characters indicate corresponding parts throughout the drawings.

DETAILED DESCRIPTION OF THE PREFERRED EMBODIMENT

Figure 1:
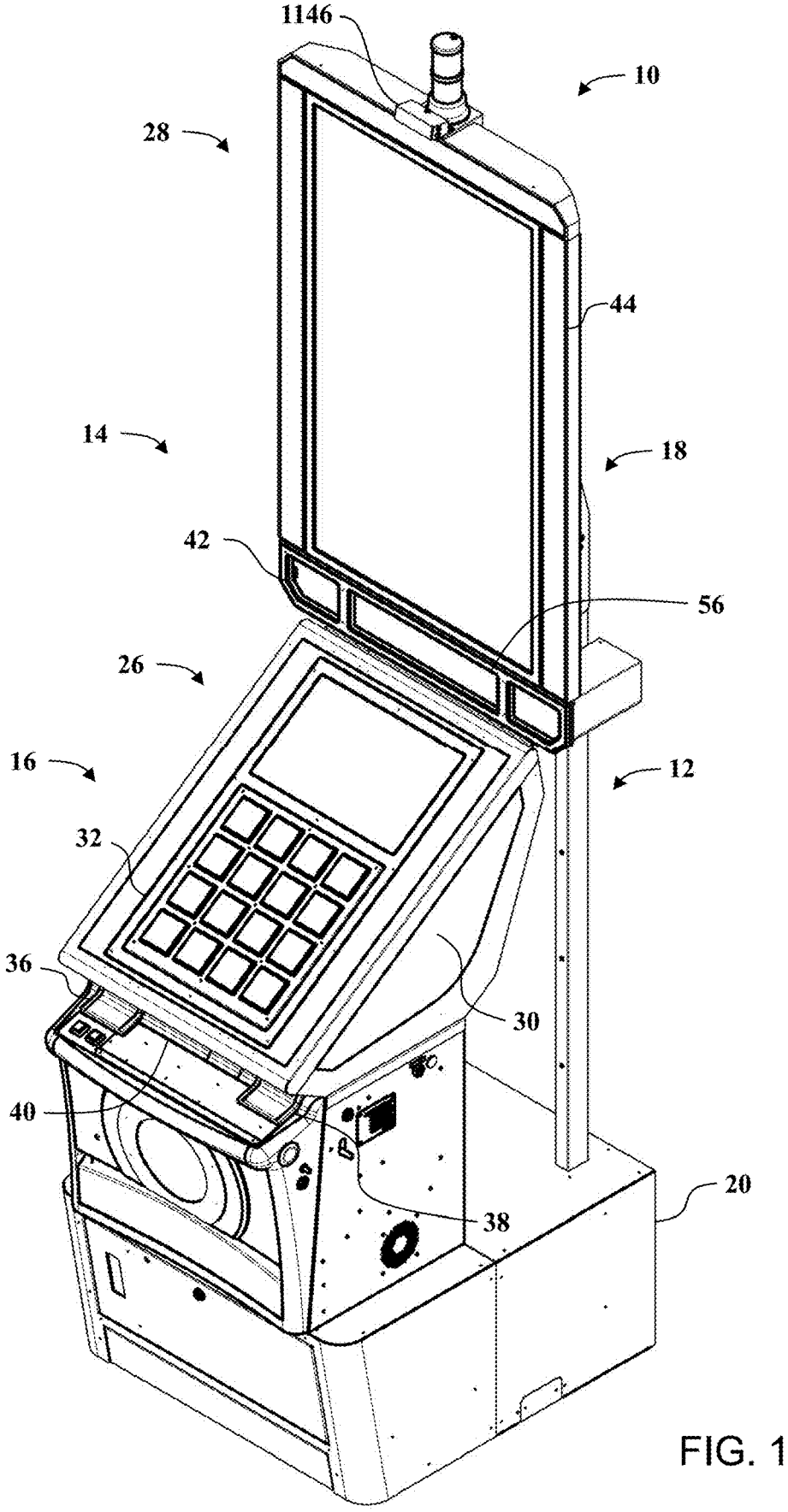
FIG. 1 is a front perspective view of an exemplary gaming machine for use in providing a skill-based wagering game to a player, according to an embodiment of the present invention.

With reference to the drawings and in operation, the present invention overcomes at least some of the disadvantages of known gaming systems by providing a gaming machine that provides a skill-based wagering game that allows the player to place wagers and receive awards based on the player's skill in performing skill-based events.

The gaming machine provides a game of skill which pays an award to a player of the game based on the player's skill. The skill-based wagering game may include a wide range of skill games for a casino, such as for example, wagering music games, shooting games, racing games, fighting games, sports games and the like.

In one embodiment, the skill-based wagering game may include a musical skill game with game play similar to a Whac-A-Mole™ type game. For example, in one embodiment, the skill-based wagering game may include a game similar to Jubeat™, published by Konami Ltd. Animated explosions or other animations, called "markers", that can be chosen at the song select screen are shown within the panels synced to a track of the player's choosing. When the markers reach a "hot point", which is dependent on the marker chosen, the player must tap the corresponding screen to score points. Taps can be judged as either Perfect, Good, Fast, or Slow. The skill-based wagering game may also include three difficulty settings (Basic, Advanced, and Extreme) for each song. The gaming machine may also track and save statistics and a player ranking, which may be used to access unlockable songs.

The gaming machine determines a skill level of the player and changes an award determination table based on the determined skill level of the player. For a low-skill player, the gaming machine may use an award determination table which assures minimum return to player (RTP) percentage to the player. For a high-skill player, the gaming machine may use a different award determination table which provides more chance for a larger award. By providing different award determination tables based on skill levels, the gaming machine a) assures the minimum RTP (%) for low-level skill players and b) provides a chance to win high prize for high-level skill players concurrently. As used herein, the term "Return to Player" describes a value indicating an amount of wagered funds that will be returned to players over a predefined period of time. For example, instance, a gaming machine having an RTP of 95% is expected to return $95 out of every $100 put in over a predefined period of time.

In addition, the gaming machine may provide the skill-based wagering game including a plurality of game stages. The gaming machine game defines a RTP (%) level of each game stage separately, which allows the player can enjoy a non-monotonic game with varied RTP. This may be used in skill-based music games as well as free games of a conventional slot machine.

In addition, when operated to initiate a game of skill in which a monetary award is paid a player of the game based on the player's skill, the gaming machine may provide a $1^{st}$ game phase in a practice mode without consuming credit before providing a $2^{nd}$ game phase in an wagering game mode. Thus allowing the player to be familiar with gameplay before betting money. In addition, the gaming machine can measure the skill level of the player in the $1^{st}$ phase and provide appropriate difficulty in the $2^{nd}$ phase.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1A:
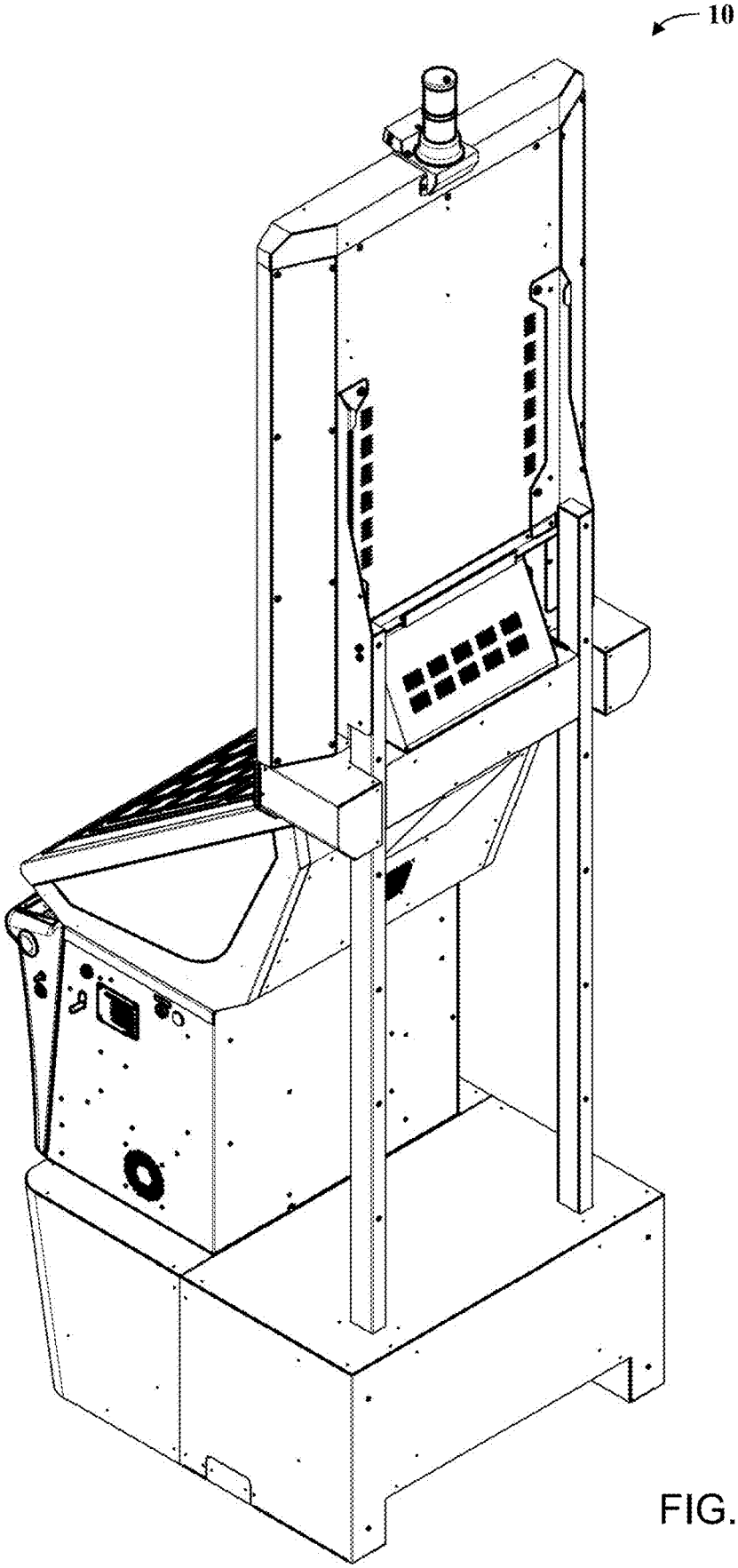
FIG. 1A is a rear perspective view of the gaming machine shown in FIG. 1.
Figure 2:
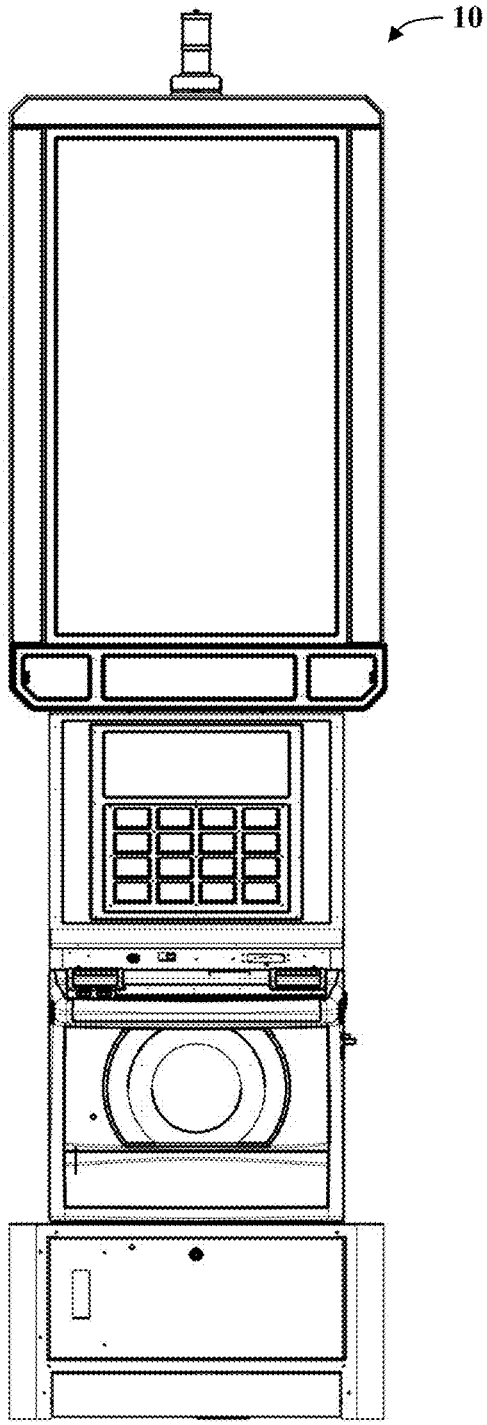
FIG. 2 is a front view of the gaming machine shown in FIG. 1.
Figure 3:
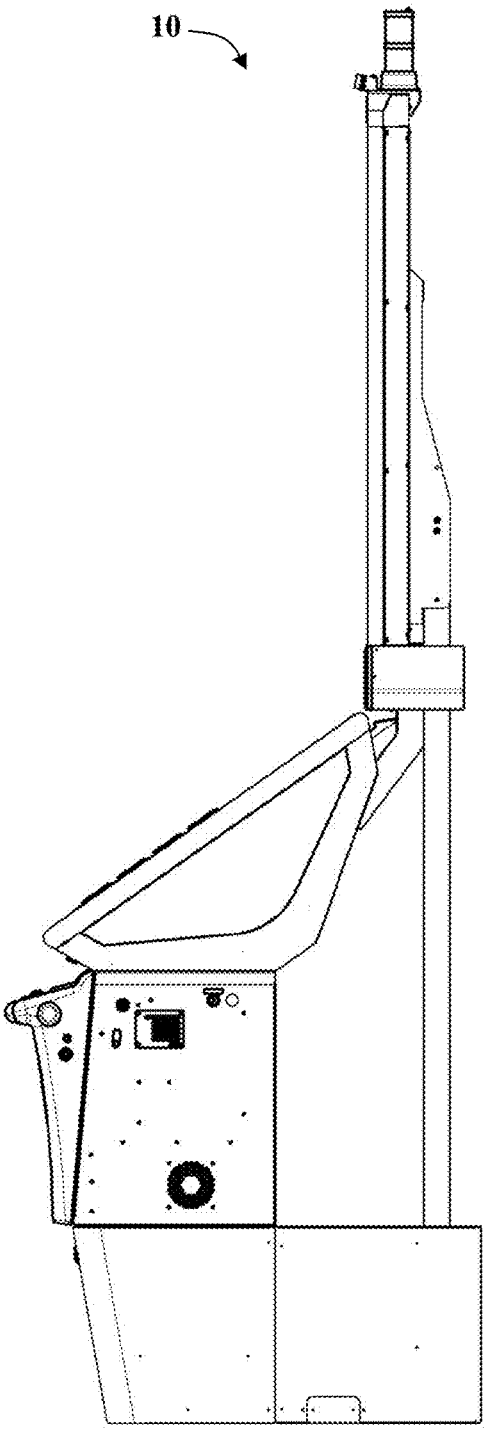
FIG. 3 is a side view of the gaming machine shown in FIG. 1.
Figure 4:
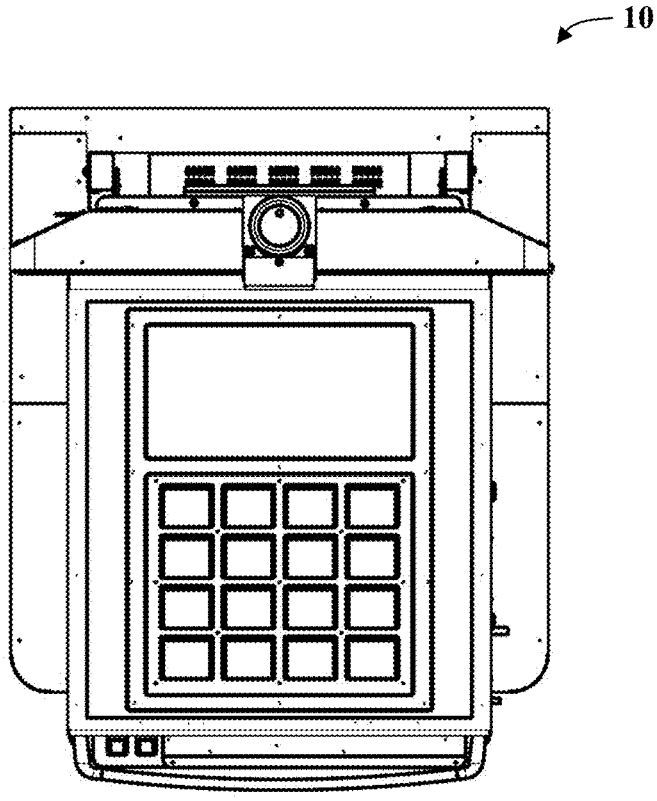
FIG. 4 is a top view of the gaming machine shown in FIG. 1.
Figure 5A:
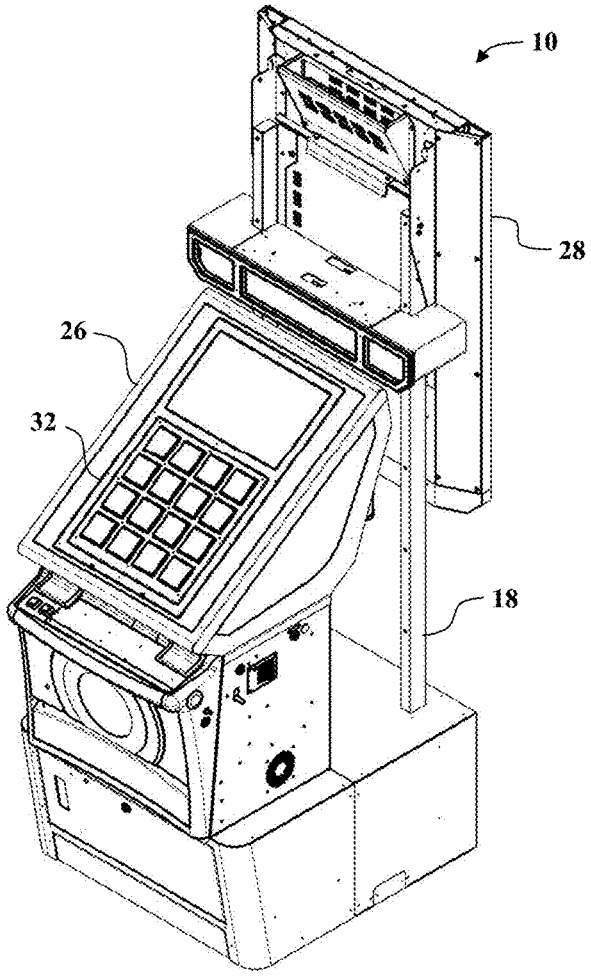
FIG. 5A is a front perspective view of the gaming machine shown in FIG. 1 illustrating the gaming machine in a transport form.
Figure 5B:
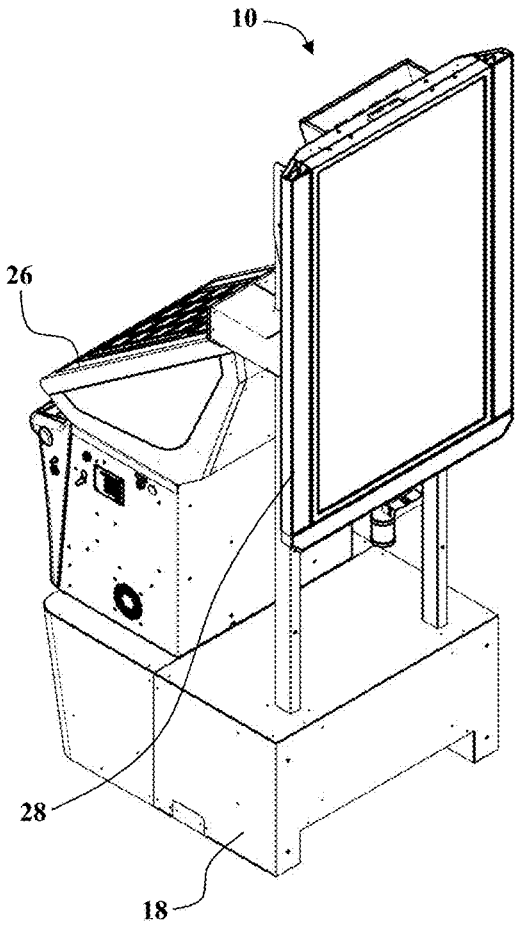
FIG. 5B is a rear perspective view of the gaming machine shown in FIG. 5A.
Figure 5C:
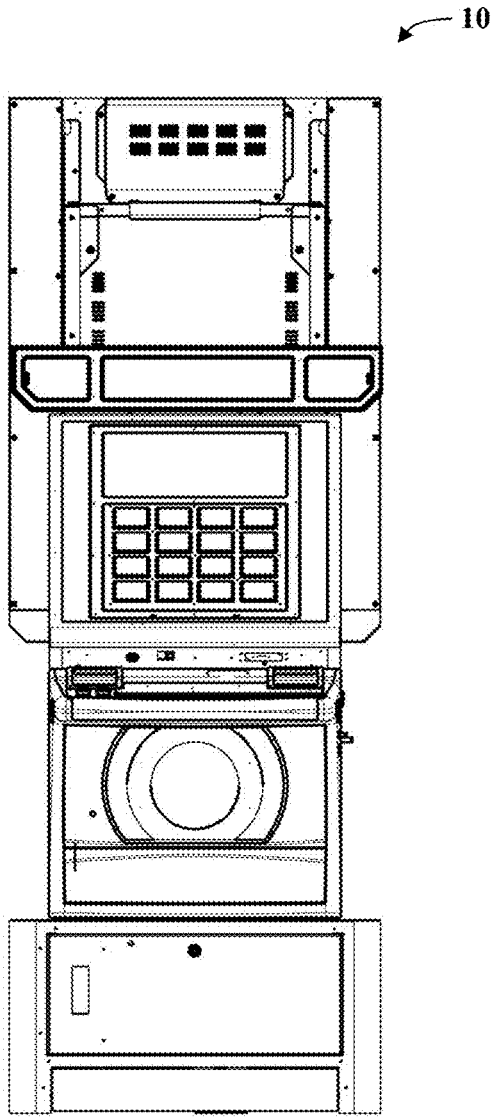
FIG. 5C is a front view of the gaming machine shown in FIG. 5A.
Figure 5D:
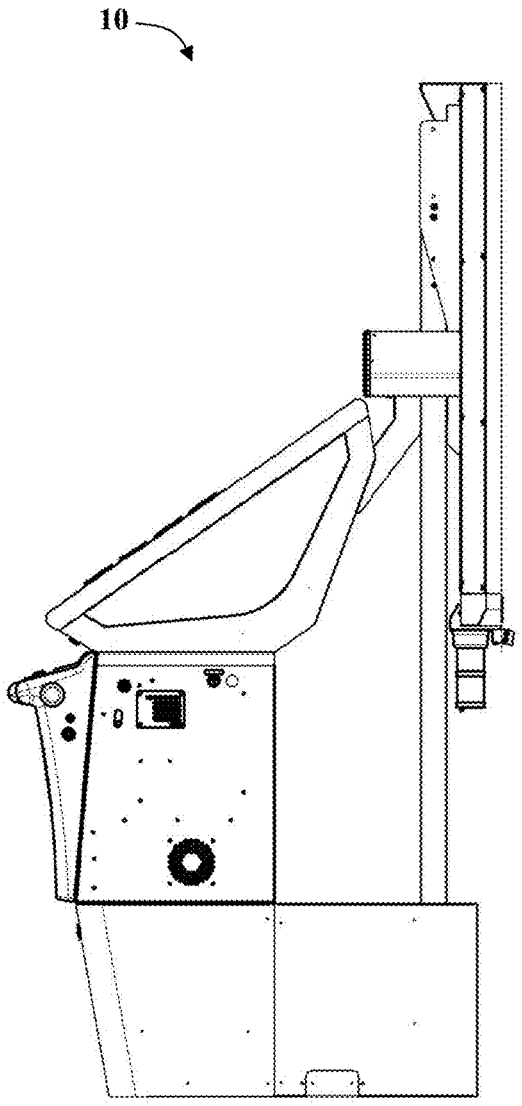
FIG. 5D is a side view of the gaming machine shown in FIG. 5A.
Figure 5E:
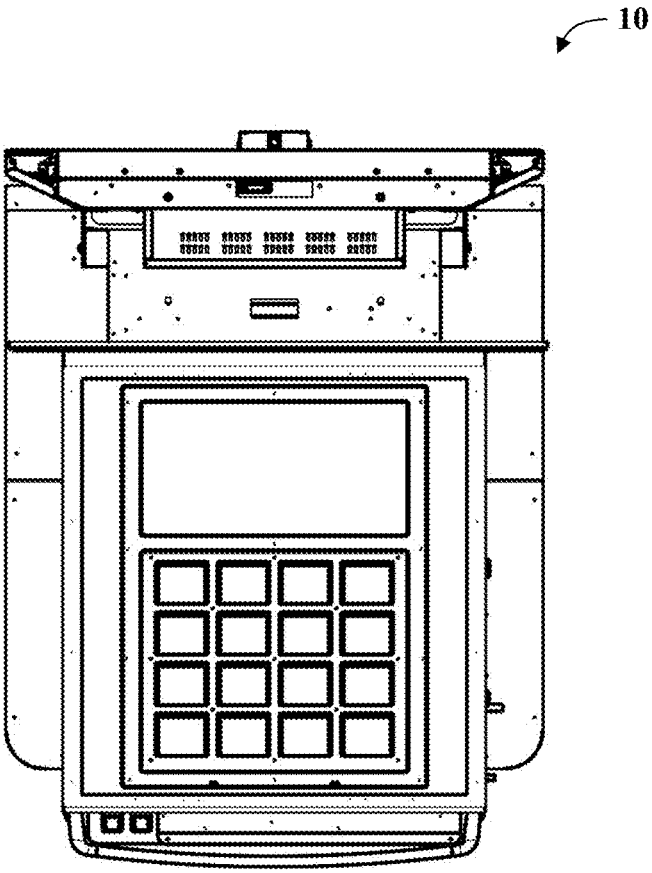
FIG. 5E is a top view of the gaming machine shown in FIG. 5A.

FIGS. 1 and 1A are perspective views of an exemplary gaming machine 10 for providing a skill-based wagering game to a player, according to an embodiment of the present invention. FIGS. 2-6 are various views of the gaming machine 10 shown in FIG. 1. FIG. 7 is a functional block diagram of the gaming machine 10. In the illustrated embodiment, the gaming machine 10 includes a gaming controller 12, a display device 14 for displaying a plurality of games, and a user input device 16 to enable a player to interface with the gaming machine 10. The gaming controller 12 is operatively coupled to the display device 14 and the user input device 16 to enable a player to play games being displayed on the display device 14. In one embodiment, the gaming machine 10 may include a gaming machine installed in a casino. In another embodiment, the gaming machine 10 may include a personal computer, laptop, cell phone, smartphone, tablet computer, personal data assistant, and/or any suitable computing device.

In the illustrated embodiment, the gaming machine 10 also includes a cabinet assembly 18 that is configured to support the display device 14, the user input device 16, and/or the gaming controller 12 from a gaming stand 20 and/or a supporting surface. The display device 14 and the user input device 16 are each coupled to the cabinet assembly 18 and are each accessible by the player. In one embodiment, the gaming controller 12 is positioned within the cabinet assembly 18. Alternatively, the gaming controller 12 may be separated from the cabinet assembly 18, and connected to components of the gaming machine 10 through a network such as, for example, a LAN, a WAN, dial-in-connections, cable modems, wireless modems, and/or special high-speed ISDN lines. For example, in one embodiment, the gaming controller 12 may be located remotely with respect to the gaming machine 10, or within one of the gaming machine cabinet assembly 18.

In the illustrated embodiment, the display device 14 is configured to display a skill-based wagering game 22 on a game screen 24 (shown in FIGS. 12-16 and 60-63) including computer-generated graphic images for use in the skill-based wagering game 22, for example, sequential images used in a musical arcade games such as the Jubeat™ published by Konami, Ltd., role playing video arcade such as Castlevania™, Metal Gear Solid™, and Contra™ published by Konami, Ltd., shooting games such as Gradius™ published by Konami, Ltd., vehicle arcade racing games such as Road Fighters™, published by Konami, Ltd., and/or sports related arcade games such as Pro Evolution Soccer™ published by Konami, Ltd. In addition, the skill-based wagering game 22 may include any type of game including, but not limited to, a role-playing game, a puzzle game, a maze-type game, a video slot game, a keno game, a black-jack game, a video poker game, or any type of game which allows a player to make a wager, play a game, and potentially provide the player an award based on an outcome of the game and a paytable.

In the illustrated embodiment, the display device 14 may include a first display 26 and a second display 28. In one embodiment, the display device 14 may be configured to display the skill-based wagering game on the first display 26 and display a secondary wagering game on the second display 28. For example, the secondary wagering game may include a video slot game described in U.S. patent application Ser. No. 14/855,993 to Gilmore et al., filed Sep. 16, 2015, titled "Gaming Machine and Methods of Providing Games to Players Having Player Characters and Enemy Characters", which is incorporated herein by reference in its entirety. Moreover, in one embodiment, each display 26 and 28 may be configured to display at least a portion of the game screen 24. In addition, the display device 14 may be configured to display the game screen 24 on the first display 26 and/or the second display 28.

In one embodiment, the first display 26, and/or the second display 28 may include a flat panel display, such as a cathode ray tube display (CRT), a liquid crystal display (LCD), a light-emitting diode display (LED), an organic light-emitting diode display (OLED), an active-matrix organic light-emitting diode display (AMOLED), a plasma display, and/or any suitable visual output device capable of displaying graphical data and/or text to a user. Alternatively, a single component, such as a touch screen, may function as both the display device 14 and as the user input device 16. In the illustrated embodiment, the gaming machine 10 also includes a pair of side display units 30 that are used to display various images associated with the skill-based wagering game.

The user input device 16 includes a player selection device 32 including a touch button unit 34 for receiving a player's selection, a coin slot 36, and/or a bill acceptor 38. The coin slot 36 includes an opening that is configured to receive coins and/or tokens deposited by the player into the gaming machine 10. The gaming controller 12 converts a value of the coins and/or tokens to a corresponding amount of gaming credits that are used by the player to wager on games played on the gaming machine 10. In one embodiment, the user input device 16 may include an acceptor device which accepts media associated with a monetary value to establish a credit balance, a validator device configured to identify physical media, and a cash-out button actuatable to cause an initiation of a payout associated with the credit balance. In one embodiment, the acceptor device may be configured to receive physical media such as, for example, a coin, a medal, a ticket, a card, a bill, currency, and/or any suitable physical media that enables the gaming machine 10 to function as described herein. The acceptor device may also be configured to accept virtual media such as, for example, an RFID signal, a keypad and/or touch screen entry, a personal identification number and/or identifier, a player tracking account, a virtual credit balance, reward points, gaming credits, bonus points, and/or any suitable virtual media that enables the gaming machine 10 to function as described herein. For example, in one embodiment, the coin slot may include an opening that is configured to receive coins and/or tokens deposited by the player into the gaming machine 10. In one embodiment, the acceptor device may include the coin slot 36 and/or the bill acceptor 38.

The bill acceptor 38 includes an input and output device that is configured to accept a bill, a ticket, and/or a cash card into the bill acceptor 38 to enable an amount of gaming credits associated with a monetary value of the bills, ticket, and/or cash card to be credited to the gaming machine 10. The bill acceptor 38 may also include the validator device to identify bills, ticket, and/or cash card received by the gaming machine. Moreover, the gaming machine 10 may also utilize a cashless wagering system (not shown), such as a ticket in ticket out (TITO) system (not shown). In one embodiment, the bill acceptor 38 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of a casino cashless system (not shown). In one embodiment, the acceptor device and/or the validator device may include the coin slot 36, the bill acceptor 38, a TITO system, a cashless wagering system, and/or a player tracking device.

A coin hopper 40 is coupled to the cabinet assembly 18 and is configured to receive a plurality of coins that are dispensed from the gaming machine 10. One or more speakers 42 are installed inside the cabinet assembly 18 to generate voice announcements and/or sound effects associated with game play. The gaming machine 10 also includes one or more illumination lighting devices 44 that are configured to blink and/or change brightness and color in specific patterns to produce lighting effects to enhance a visual gaming experience for the player.

The touch button unit 34 includes a plurality of transparent touch buttons 46 that are positioned over a portion of the first display 26. In the illustrated embodiment, the touch button unit 34 includes sixteen touch buttons 46 arranged in a 4×4 grid arrangement. The touch buttons 46 allow images being displayed on the first display 26 to be viewable by a player through the touch buttons 46. In one embodiment, each of the touch buttons 46 is coupled to a corresponding mechanical switch that is configured to detect a player's operation of the touch button 46 and transmit a signal indicating the operation of the touch button 46 to the gaming controller 12. For example, as shown in FIGS. 12-16 and 60-63, the gaming controller 12 may operate the first display 26 to display the game screen 24 including a plurality of graphic operational images 48 that may be used by the player to operate the gaming machine 10. Each of the operational images 48 may be visible by the player through a corresponding transparent touch button 46. When a corresponding touch button 46 is actuated by the player, e.g. depressed by the player, a corresponding mechanical switch transmits a signal indicated the actuation of the touch button 46 to the gaming controller 12. The gaming controller 12 then executes the operation associated with the displayed operational image 48 actuated by the player.

In one embodiment, the touch buttons 46 may include a plurality of BET switches 50 for inputting a wager on a game and initiating the game and a PAYOUT switch 52 (shown in FIG. 13) for ending a gaming session and dispensing accumulated gaming credits to the player. In another embodiment, the user input device 16 may include a video touch display that displays video images of the touch buttons 46.

The user input device 16 may also include a touchless display being displayed with changeable video images of the touch buttons.

The gaming machine 10 also includes a player tracking device 56 that is coupled to the gaming controller 12 for identifying the player and/or a player tracking account that is associated with the player. The player tracking account may include, but is not limited to, gaming credits available to the player for use in playing the gaming machine 10. The player tracking device 56 is configured to communicate player account information between a player tracking controller (not shown) and the gaming machine 10. For example, the player tracking device 56 may be used to track bonus points and/or credits awarded to the player during a gaming session and/or track bonus and/or credits downloaded to the gaming machine 10 from the player tracking system. In the illustrated embodiment, the player tracking controller assigns a player status, e.g. a player ranking, based on the player account information. For example, the player tracking information may include, but is not limited to, a frequency in which the player plays a game, the average wager the player makes per play of a game, a total amount wagered by the player over a predefined period of time, and/or any other suitable player tracking information.

The player tracking device 56 is coupled to the gaming cabinet assembly 18 and includes a player identification card reader, a data display, and a keypad. The player identification card reader is configured to accept a player tracking card (not shown) inserted by the player, and read information contained on the player tracking card to identify the player account information. The player identification card reader may include, but is not limited to, a barcode reader, a magnetic card reader, IC card reader, and/or a radio frequency identification (RFID) card reader. The keypad is configured to accept a user selection input such as, for example, a unique player personal identification number (PIN) to facilitate enabling the gaming machine 10 to identify the player, and access player account information associated with the identified player to be displayed on the data display. In one embodiment, the data display includes a touchscreen panel that includes the keypad. Alternatively, the data display and the keypad may be included in the display device 14.

Figure 6:
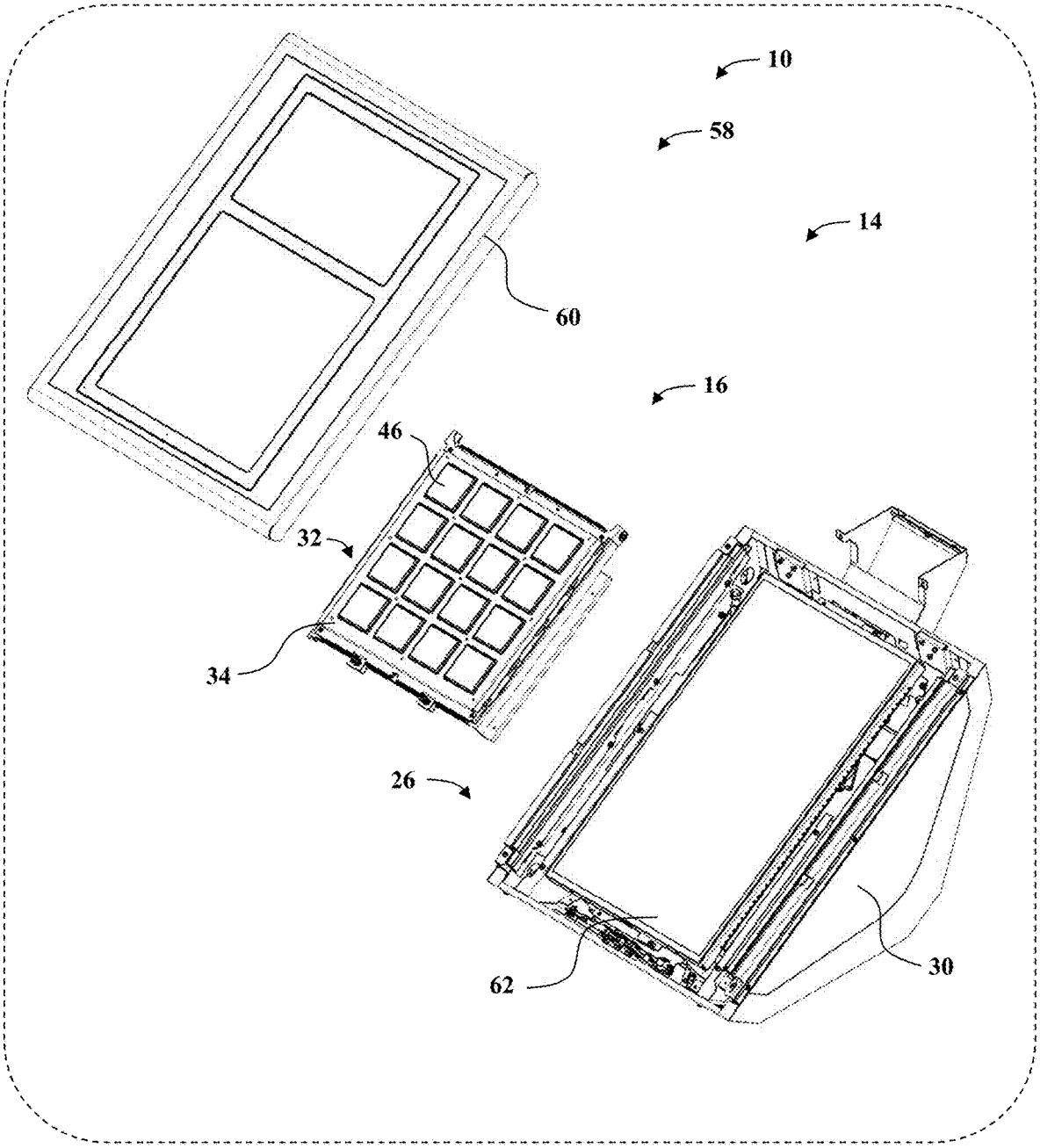
FIG. 6 is an exploded schematic view of the gaming machine shown in FIG. 1.
Figure 7:
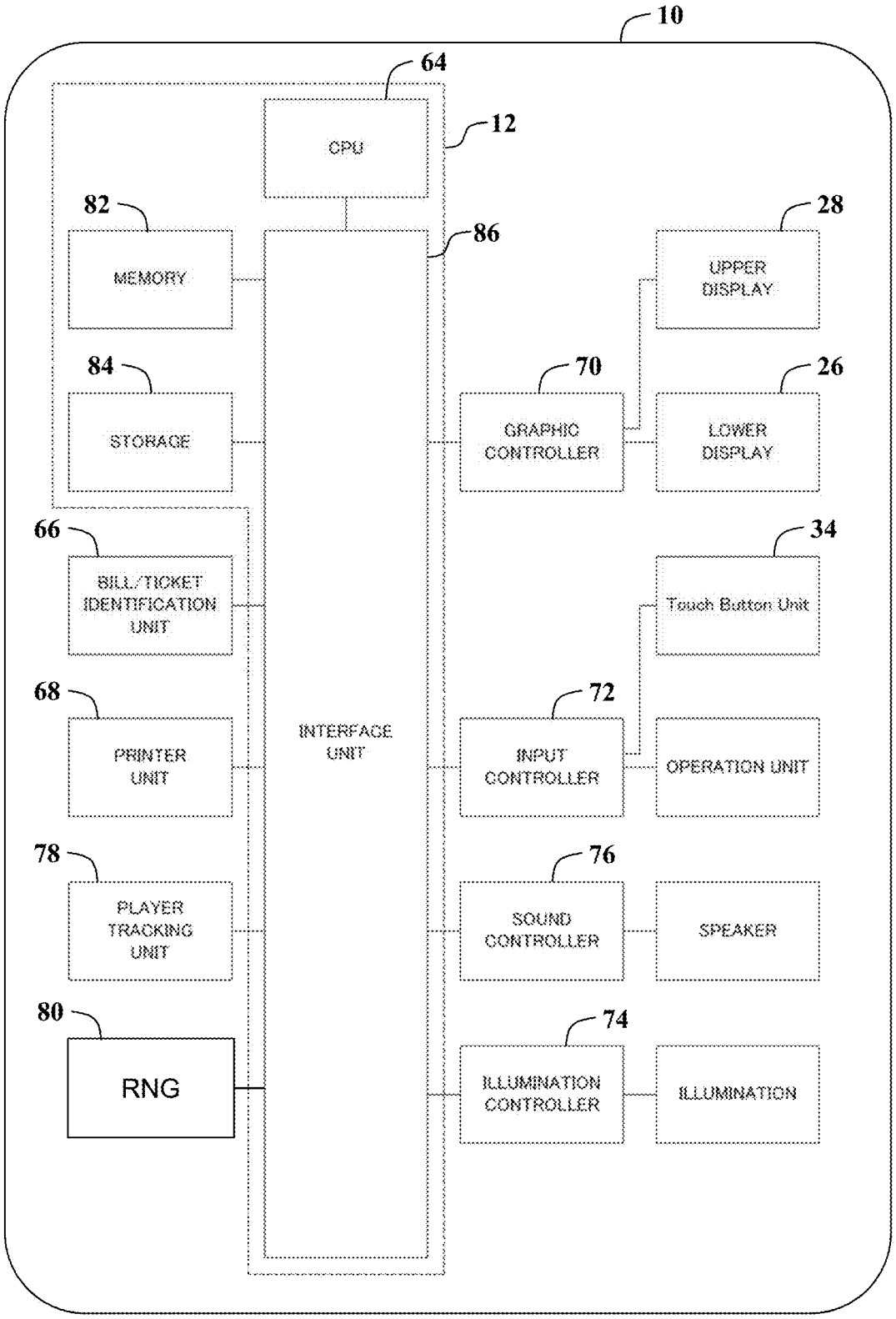
FIG. 7 is a functional block diagram of the gaming machine shown in FIG. 1, according to an embodiment of the present invention.

Referring to FIG. 6, in one embodiment the gaming machine 10 includes a top unit 58 that includes a cover unit 60, the touch button unit 34 and an LCD unit 62. In addition 2 side LED units are provided at the both sides of top unit. The touch button unit has 4×4 transparent buttons which accept player's touch operation respectively. Due to its transparency, the player can see graphical images displayed on LCD unit through the transparent buttons. When the player touches (depresses) the transparent button, mechanical switches incorporated below the transparent button detect the player's operation and send signal to the control unit. The side LED unit perform illumination by changing brightness and/or color tone of LEDs inside of it.

Referring to FIG. 7, in one embodiment, the gaming machine 10 may include the gaming controller 12, a bill/ticket identification unit 66, a printer unit 68, a graphic controller 70, an input controller 72, an illumination controller 74, a sound controller 76, a player tracking unit 78, and a random-number generator (RNG) 80. The gaming controller 12 includes a processor, i.e., a central processing unit (CPU) 64, a memory device 82, a storage device 84, and an interface unit 86. The interface unit 86 is configure to transmit signals and data between the CPU 64 and the bill/ticket identification unit 66, the printer unit 68, the graphic controller 70, the input controller 72, the illumination controller 74, the sound controller 76, the player tracking unit 78, the RNG 80, the memory device 82, and the storage device 84 to enable the gaming controller 12 to operate the gaming machine 10 to provide the skill-based wagering game 22 as described herein.

The memory device 82 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the gaming controller 12 to store, retrieve, and/or execute instructions and/or data.

The CPU 64 executes various programs, and thereby the gaming controller 12 controls other components of the gaming machine 10 according to player instructions and data accepted by the user input device 16. The CPU 64 in particular executes a game program, and thereby conducts a game in accordance with the embodiments described herein. The memory device 82 and the storage device 84 store programs and data used by the CPU 64. Moreover, the memory device 82 and the storage device 84 store and retrieve information including, but not limited to, wagers, wager amounts, skill-based game events, and image data for producing game images and/or screens on the display device 14, and temporarily stores variables, parameters, and the like that are used by the CPU 64. In addition, the memory device 82 stores indicia, game images, operating timing data, and/or award paytables which represent relationships between combinations of random numbers, types of awards, and player skill level values. In one embodiment, the memory device 82 utilizes RAM to temporarily store programs and data necessary for the progress of the game, and EPROM to store, in advance, programs and data for controlling basic operation of the gaming machine 10, such as the booting operation thereof.

The bill/ticket identification unit 66 manages the amount of player's credits, which is equivalent to the amount of coins and bills counted and validated by the bill acceptor 38. The bill/ticket identification unit 66 may also convert a player's credits to coins, bills, or other monetary data by using the coin hopper 40 and/or for use in dispensing a credit voucher via the bill acceptor 38. The printer unit 68 is configured to operate the printer included with the bill acceptor 38 to print ticket vouchers used with a cashless wagering system.

The graphic controller 70 controls the display device 14 to display various images on a graphical interface including the game screen 24 preferably by using computer graphics and image data stored in the memory device 82. More specifically, the graphic controller 70 generates and displays the images being displayed with the game including images being displayed on the first display device 14 and the second display device 14 by using computer graphics and the image data.

The input controller 72 monitors player selections received through the user input device 16, accepts various instructions and data that a player enters through the user input device 16, and transmits signals indicative of player's selections to the gaming controller 12.

The illumination controller 74 controls one or more illumination devices 44 to blink and/or change brightness and color in specific patterns in order to produce lighting effects associated with game play. The sound controller 76 controls the speakers 42 to output voice announcements and sound effects during game play.

The player tracking unit 78 operates the player tracking device 56 to allow the player to identify the player and/or a player tracking account that is associated with the player.

The RNG 80 generates and outputs random numbers to the gaming controller 12 for use in generating and displaying the skill-based wagering game 22. The RNG 80 outputs random numbers preferably at the start of each round of a game. The gaming controller 12 uses the random numbers to determine an outcome of the games. For example, the gaming controller 12 uses the RNG 80 to randomly select award paytables that may be used during the skill-base game to provide awards to the player based on the level of skill demonstrated by the players during the game. Moreover, the gaming controller 12 generally uses random numbers generated by the RNG 80 to play the games and to determine whether or not to provide an award to a player. The gaming controller 12 may also receive combinations of random numbers from the RNG 80 for use during the skill-based game. In general, the term "award" may be a payout, in terms of credits or money. Thus, the gaming controller 12 may award a regular payout in response to the outcome of the game. However, it should be noted that the term award may also refer to other types of awards, including, prizes, e.g., meals, show tickets, etc. . . . , as well as in-game award, such as bonus features, free games, and/or free spins, or awarding the player one or more wild symbols or stacked wild symbols in each of the games. The RNG 80 may be implemented as a hardware module or a software module executed by the CPU 64.

In the illustrated embodiment, the gaming controller 12 includes a skill-based game program for use in executing the skill-based wagering game 22 being displayed on the display device 14. In the illustrated embodiment, the skill-based wagering game 22 includes one or more skill events that must be completed by the player. The gaming controller 12 is programmed to determine a skill level of the player based on the player's selections being made during the skill event, and determine an award to be provided to the player based on the determined skill level. In some embodiments, the skill-based game may include any game that allows the player to affect the outcome of the skill-based game through a series of player choices and/or player selections. The skill-based game may also include a player skill component associated with the player's selection that may include physical or manual dexterity, digital dexterity, hand-eye coordination (e.g., aim), reflexes, memory, cognitive processing, knowledge, and/or strategy-based selection. Skill-based games may include, but are not limited to including, role-playing arcade-type games, first-person shooting games, sporting games, memory games, matching games, and/or any suitable game that includes a skill component and that enables the outcome of the game to be at least partially determined based on a players selection.

For example, with reference to FIGS. 12-23 and 12-16 and 60-63, in the illustrated embodiment, the skill-based wagering game 22 includes a musical skill game that includes a plurality of skill events associated with the timing of a musical soundtrack, such as for example, Jubeat™ published by Konami, Ltd. The gaming controller 12 is programmed to play the musical soundtrack and display a plurality of skill events in coordination with the musical soundtrack. For example, in the illustrated embodiment, each skill event includes an image being displayed within a touch button 46 at a predefined time during the musical soundtrack. The player is prompted to actuate or depress the corresponding touch button 46 during the period in which the image is being displayed in order to register a player input. The gaming controller 12 then evaluates the timing in which the player input was received with respect to the time period in which the image was being displayed, and determines a skill level associated with the skill event based on the timing of the player input. During the skill-based wagering game 22, the gaming controller 12 may display a plurality of skill events as the musical soundtrack is being played, and determine an award to be provided to the player based on the player input associated with each skill event.

Figure 17:
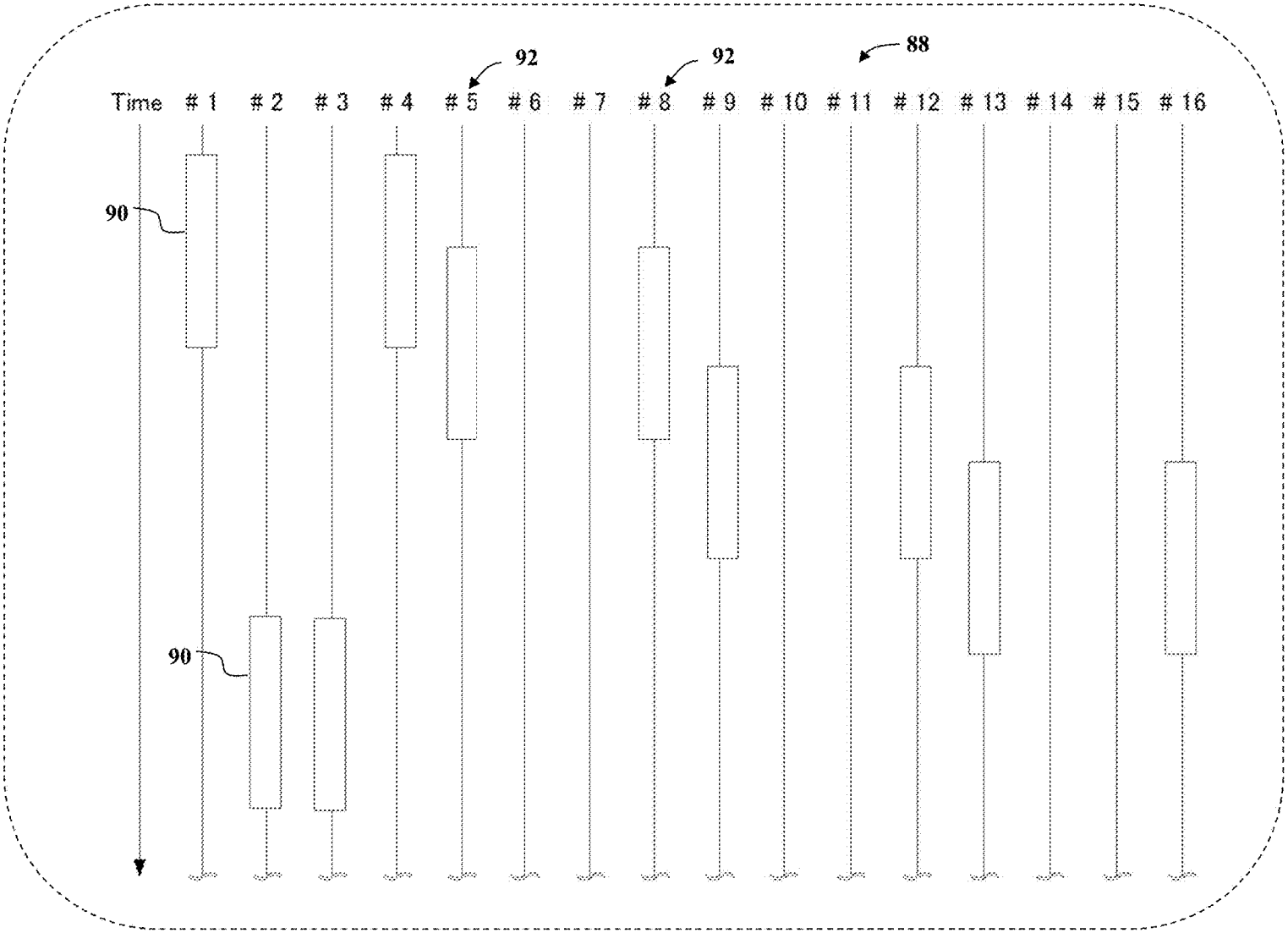
FIG. 17 is an schematic illustration of timing chart that may be used by the gaming machine shown in FIG. 1 to display a skill-based wagering game, according to an embodiment of the present invention.
Figure 18:
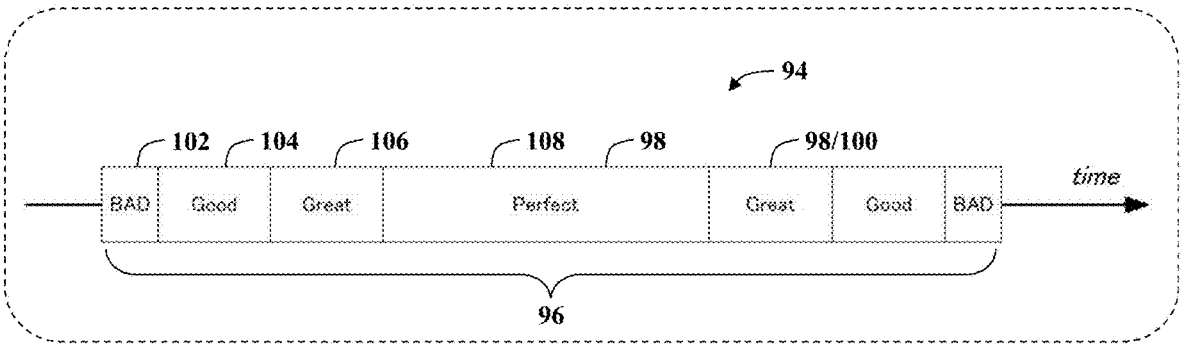
FIG. 18 is an exemplary event timing period that may be used by the gaming machine shown in FIG. 1 to display a skill-based wagering game, according to an embodiment of the present invention.

The memory device 82 and the storage device 84 includes a plurality of data that may be used by the gaming controller 12 to operate the gaming machine 10 to generate and display the skill-based wagering game 22. For example, as shown in FIG. 17, in one embodiment, the data may include a plurality of timing chart data records 88 that includes a plurality of skill events 90 that occur over a predefined period of time. The timing and position to display the marker is defined as shown in this timing chart. Each music title has its corresponding timing chart. In the illustrated embodiment, each timing chart data record 88 includes a timing record 92 associated with each of the touch buttons 46 included in the touch button unit 34. For example, as shown in FIG. 17, the timing chart data record 88 includes sixteen timing records 92 corresponding with each of the sixteen touch buttons 46. Each timing record 92 includes data associated with the appearance of a skill event at a corresponding touch button 46 during the predefined time period. In the illustrated embodiment, the appearance of a skill event 90 is coordinated with a beat of the music soundtrack to prompt the player to actuate the corresponding touch button 46 with the corresponding music beat. As shown in the timing chart data record, multiple skill events 90 may appear simultaneously and at different touch buttons 46.

In addition, multiple skill events 90 may also appear sequentially and at the same and/or different touch buttons 46. For example, a skill-based wagering game 22 being executed using the illustrated timing chart data record 88 would include a pair of skill events first appearing with touch button No. 1 and touch button No. 4, followed by the appearance of skill events in touch button No. 5 and touch button No. 8. In one embodiment, the data may also include data associated with a variety of musical soundtracks that may be used with the skill-based wagering game 22. The data may also include one or more timing chart data records 88 that are associated with each of the musical soundtracks.

The data also includes a plurality of operation timing records 94 (shown in FIG. 18) that may be used to determine a skill level of a player during the skill event. The operation timing record 94 illustrates a relationship between the player's operation timing and the player's skill level on each touch. Each operation timing record 94 includes an event time period 96 that includes a predefined period of time. The event time period 96 includes a plurality of consecutive operation timing periods 98. Each operation timing period 98 is associated with a player skill level value 100 and may be used to determine a skill level associated with the player's execution of the corresponding skill event. The determined player skill level may then be used to determine an award being provided to the player. In the illustrated embodiment, the event time period 96 includes operation timing periods 98 associated with four different skill level values including a low skill level value 102 (illustrated as "Bad"), a medium skill level value 104 (illustrated as "Good"), a medium-high skill level value 106 (illustrated as "Great"), and a high skill level value 108 (illustrated as "Perfect").

Figure 23:
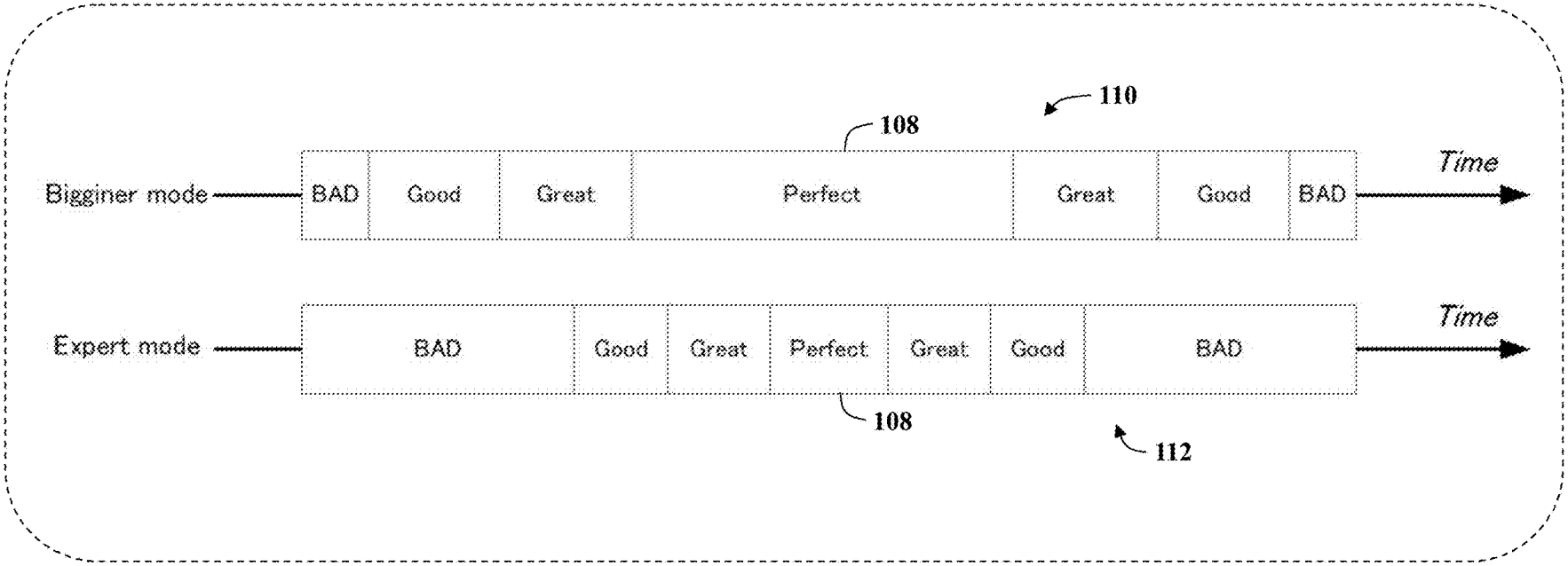
FIG. 23 are exemplary event timing periods that may be used by the gaming machine shown in FIG. 1 to display a skill-based wagering game, according to an embodiment of the present invention.

In one embodiment, as shown in FIG. 23, the data may include a low skill operation timing record 110 and a high skill operation timing record 112. The low skill operation timing record 110 includes a high skill operation timing period 108 that is longer in time than the high skill operation time period 108 included with the high skill operation timing record 112.

Figure 19:
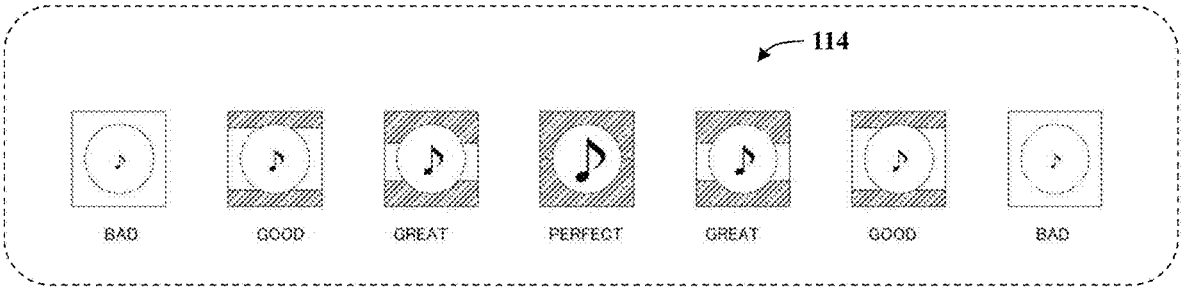
FIG. 19 is an illustration of a sequence of graphic images that may be used by the gaming machine shown in FIG. 1 to display a skill-based wagering game, according to an embodiment of the present invention.
Figure 20:
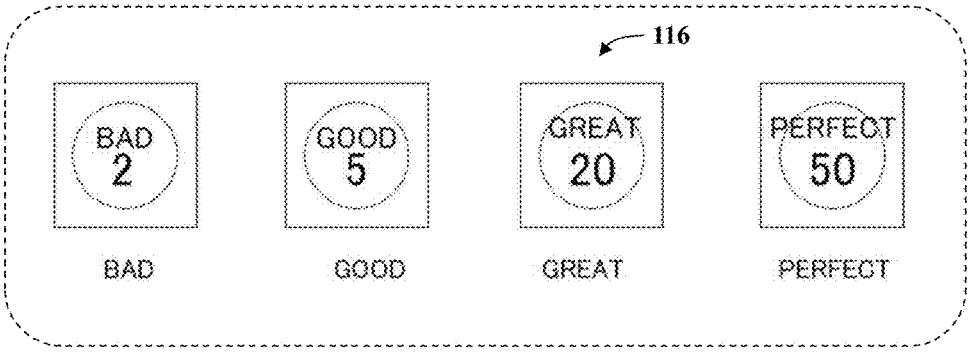
FIG. 20 is an illustration of various graphic images that may be used by the gaming machine shown in FIG. 1 to display a skill-based wagering game, according to an embodiment of the present invention.
Figure 21:
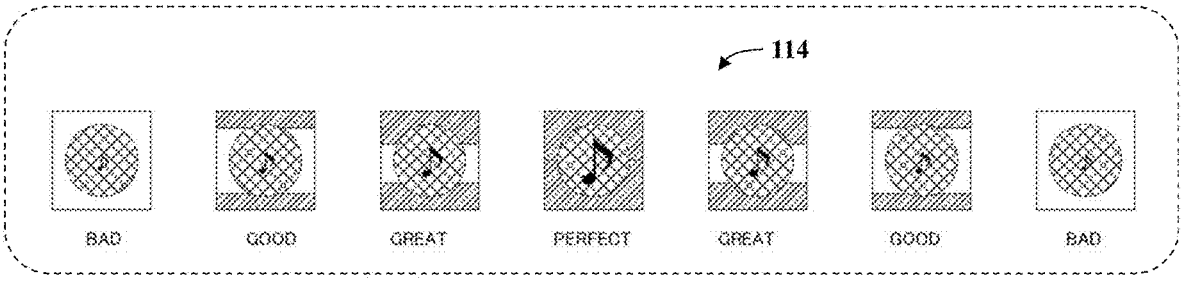
FIG. 21 is another illustration of a sequence of graphic images that may be used by the gaming machine shown in FIG. 1 to display a skill-based wagering game, according to an embodiment of the present invention.

In addition, with reference to FIGS. 19 and 21, in one embodiment, the data may also include a sequential image record 114 that includes a plurality of images that may be used to display the skill event 90 with a corresponding touch button 46. FIG. 19 illustrates an animation of a marker. The size of a note increases in the first half and reduces in the second half. In other words, the size of the note changes according to skill level at that timing. In addition, colored zone in the back ground of the notes also increases and reduces like as the size of the note. FIGS. 19 and 20 corresponds to a marker with blue chip color in the award paytables shown in FIGS. 24-26. FIG. 21 illustrates an alternative animation of a marker and corresponds to a marker with gold chip color in the award paytables shown in FIGS. 24-26. For example, the sequential image record 114 may include a graphic image corresponding to each operation timing period 98 included in the operation timing record 94. In addition, the sequential image record 114 includes images associated with each player skill level value 100 included in the operation timing record 94.

During play of the skill-based wagering game 22, the gaming controller 12 may display a skill event 90 including sequentially displaying the images included in the sequential image record 114 with a corresponding touch button 46 in accordance with the corresponding timing record 92 associated with the touch button 46. The sequential display of images prompts the player to actuate the corresponding touch button 46 as the images are being displayed. Upon receiving a signal from the touch button unit 34 indicating the player's actuation of the touch button 46, the gaming controller 12 detect a player's operation timing associated with the player's selection input and determines a corresponding consecutive operation timing period 98 associated with the player's operation timing. The gaming controller 12 may then determine a skill level value 100 based on the corresponding consecutive operation timing period. For example, if the player actuates the touch button early or late in the event time period sequence, the gaming controller 12 assigns a low skill level value 102, e.g. a Bad skill level, to the player. If the player actuates the touch button 46 in the middle of the event time period sequence, the gaming controller 12 assigns a high skill level value 108, e.g. a Perfect skill level, to the player.

Figure 22:
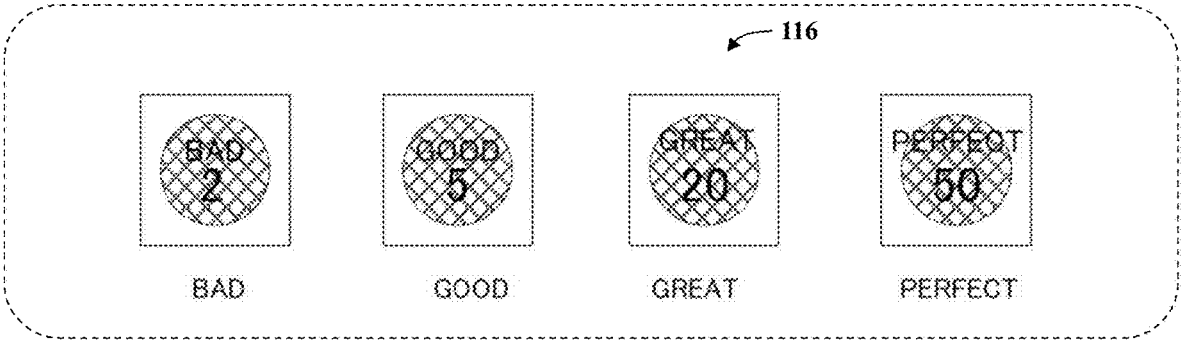
FIG. 22 is another illustration of various graphic images that may be used by the gaming machine shown in FIG. 1 to display a skill-based wagering game, according to an embodiment of the present invention.

In one embodiment, as shown in FIGS. 20 and 22, the data includes a plurality of award images 116 that are used to display an award associated with the completion of a skill event. FIG. 20 illustrates an indication of the player's skill and earned credit on the marker of FIG. 19. FIG. 22 illustrates an indication of the player's skill and earned credit on the marker of FIG. 21. For example, during operation, upon determining the skill level value associated with the player's operation timing, the gaming controller 12 may determine an award associated with the skill level value, select a corresponding award image 116, and display the award image 116 within the touch button 46 to notify the player of the received award.

In the illustrated embodiment, with reference to FIGS. 24-26, the data also includes a plurality of award paytables 118 that may be used to execute the skill-based wagering game 22. In one embodiment, the data may include a first award paytable 120 that has a low return to player (RPT) value, a second award paytable 122 having a medium RPT value, and a third award paytable 124 having a high RPT value. For example, in one embodiment, as shown in FIG. 27, the first award paytable 120 may have a low RTP equal to 74%, the second award paytable 122 may have a medium RPT value equal to 97.6%, and the third award paytable 124 may have a high RPT value equal to 220%.

Each award paytable 118 includes plurality of skill event records 126. Each skill event record 126 includes a corresponding selection probability 128 and a plurality of award values 130. The selection probability 128 indicates the probability of the corresponding skill event record 126 being selected from the plurality of skill event records 126 based on random number selection. Each award value 130 is associated with a corresponding skill level value 100. In addition, each skill event record 126 may include a range of skill level values 100 including associated award values 130. For example, as shown in FIG. 24, each skill event record 126 may include a low award value associated with a low skill level value 102, a medium award value associated with a medium skill level value 104, a medium-high award value associate with a medium-high skill level value 106, and a high award value associated with a high skill level value 108. In addition, the award paytable 118 may include a skill event record that includes the same award values for each of the skill level values, and a skill event record that includes a different award value for each skill level. In addition, each skill event record 126 may include a different selection probability 128. FIG. 23 illustrates another embodiment which has a beginner mode game and an expert mode game. Different relationships between the player's operation timing and the player's skill level on each touch are provided to the beginner mode game and the expert mode game. In the expert mode game, it is more difficult to achieve a high skill level than in the beginner mode.

Each skill event record 126 may include event image data 132 that includes information associated with the images being displayed with the skill event. For example, as shown in FIG. 24, the award paytable 118 includes a first skill event record 126 having a first event image data and a second skill event record 126 having a second event image data. The first event image data includes a first sequential image record and first award images shown in FIGS. 19 and 20, respectively. The second event image data includes a second sequential image record and second award images shown in FIGS. 21 and 22, respectively.

During operation, the gaming controller 12 is programmed to select an award paytable 118 for use during the skill-based wagering game 22, and randomly select an event record 126 for each skill event 90 that is included in the skill-based wagering game 22. For example, in one embodiment, the gaming controller 12 is programmed to initiate the skill-based wagering game 22 including accessing the data and selecting the timing chart data record 88 and determine a number of skill events 90 to be displayed with the skill-based wagering game 22. The gaming controller 12 is programmed to select an award paytable 118 from the plurality of paytables 118 and randomly select a skill event record 126 for each of the skill events 90. In one embodiment, the gaming controller 12 may randomly select the same skill event record 126 for more than one skill event 90. The gaming controller 12 may also select an operation timing record 94 associated with each skill event 90. The gaming controller 12 then accesses the corresponding skill event record 126 to determine the event image data associated with the skill event 90 and displays the skill event 90 including the corresponding event image data in accordance with the timing chart data record 88.

During play of the skill-based wagering game, the gaming controller 12 detects the player's operation timing associated with the player's actuation of the corresponding touch button 46, determines a corresponding consecutive operation timing period 98 associated with the player's operation timing, and determines a skill level value 100 based on the corresponding consecutive operation timing period. The gaming controller 12 then accesses the corresponding skill event record 126, determines an award value 130 associated with the determined skill level 100, accesses the award images to determine the award image associated with the award value 130, and displays the selected award image with the touch button 46. The award image is displayed for a predefined period of time to notify the player of the award prior to displaying another skill event 90 with the corresponding touch button 46. At the conclusion of the skill-based wagering game 22, the gaming controller 12 calculates a total award value based on each award value received from the skill events 90 and adjusts the credit balance to include the total award value.

In one embodiment, the data may also include a transition table 134 (shown in FIG. 27) that includes a plurality of award pattern records 136. Each award pattern record 136 includes a pattern selection probability 138 and a plurality of paytable values 140. The pattern selection probability 138 indicates the probability of the corresponding award pattern record 136 being selected from the plurality of award pattern records 136 based on random number selection. Each paytable value 140 indicates a corresponding award paytable 118. For example, the paytable values 140 may indicate a paytable RTP value and include a low RTP value corresponding to the first award paytable 120 (shown in FIG. 24), a medium RTP value corresponding to the second award paytable 122 (shown in FIG. 25), and a high RTP value corresponding to the third award paytable 124 (shown in FIG. 26). In addition, each award pattern record 136 includes a plurality of stages 142. Each stage 142 includes a corresponding paytable value 140 and an associated number of consecutive skill events 90.

For example, during operation of the skill-based wagering game 22, the gaming controller 12 may be programmed to display a plurality of consecutive skill events 90 in consecutive stages 142. The gaming controller 12 is programmed to access the transition table 134 and to randomly select an award pattern record 136 from the transition table 134 and initiate the skill based game using the selected award pattern record 136. As shown in FIG. 27, each award pattern record 136 may include four stages 142 including Stage 1, Stage 2, Stage 3, and Stage 4. Each stage 142 may include a different number of skill events 90 or the same number of skill events 90. For example, Stage 1 may include 10 consecutive skill events 90 and Stage 2 may include 15 consecutive skill events 90. In addition, in one embodiment, each stage 142 may indicate a different type of skill event 90.

During play of the skill-based wagering game 22, for each skill event 90 being displayed, the gaming controller 12 may access the identify a current skill event stage 142 associated with a current skill event 90 being displayed and determine the award paytable 118 associated with the current skill event 90 based on the current skill event stage 142 and the selected award pattern record 136. As the player progresses through the various stages of the skill-based wagering game 22 the paytables 118 being used to provide awards to the player for the completion of the skill events 90 will change based on the award pattern included in the selected award pattern record 136

In one embodiment, referring to FIGS. 28-36, in one embodiment, the data may include a plurality of skill level tables 144 that may be used to determine a skill level value 100 associated with the skill-based wagering game 22. Each skill level table 144 includes a plurality of skill level records 146. Each skill level record 146 includes a game value 148 and a corresponding skill level value 100. The various skill level tables 144 enable to gaming controller 12 to provide a variety of types of skill-based wagering games having different types of skill events, and to determine a skill value 100 associated with each skill event type.

For example, in one embodiment, the gaming controller 12 may be programmed to provide a shooting type game such as, for example, Gradius 2™ published by Konami Ltd. This type of skill-based wagering game requires the player to control a player character and shoot targets in order to proceed through missions. During the missions, a predetermined game score is provided and accumulated when the player shoots and destroys the targets. In addition, bonus scores might be provided to the player based on elapsed time of the mission, extermination of a group of the targets or elimination of a specific target such as a boss character. In another embodiment, the skill-based wagering game 22 may include a role-playing action game such as Metal Gear Solid 4™, published by Konami Ltd. In this type game, the player controls a character and conducts various types of activities in order to proceed through missions. After completion of a mission, activities and achievements of the character is evaluated and corresponding game score is provided to the player. In these games, it is possible to classify the player's skill level based on the game score which the player earned through his game. For example, the data may include a shooting game skill level table 150 (shown in FIG. 28) that includes a skill level records 146 including a game score associated with each skill level value 100.

In another embodiment, the skill-based wagering game 22 may include a racing game such as Road Fighters™, published by Konami Ltd. In this type game, the player controls a car by operating simulated steering, accelerator, brake and/or gearshift to drive the car through a race in the game screen. As a result of the race, predetermined game score is provided to the player based on ranking order and/or recorded time. In addition, bonus score might be provided based on ranking order and/or recorded time of each lap. Moreover, a plurality of virtual objects for showing the most suitable racing line might be allocated on race course.

In these games, it is possible to classify player's skill level based on the number of objects which the car has passed through the game, or to classify player's skill level based on the player's lap time and/or total record time during the whole race. For example, the data may include a racing game skill level table 152 (shown in FIG. 29) that includes skill level records 146 including a number of objects passed associated with each skill level value 100. In addition, as shown in FIG. 30, the racing game skill level table 154 may also include skill level records 146 including an elapsed lap time associated with each skill level value 100.

In another embodiment, the skill-based wagering game 22 may include a sports themed game such as a golf game. In this type game, the player controls a character to play a sports game such as golf, tennis baseball or basketball and the like. As a result of the game, predetermined game score is provided to the player based on his victory/defeat, game score or point spread. In addition, bonus score might be provided based on the character's activity or achievement in the sports game. For example, during a golf game classification of the player's skill level may be based on the direction and the length of each shot in the golf game. For example, the data may include a sports game skill level table 156 (shown in FIG. 31) that includes skill level records 146 including a direction and length of shots associated with each skill level value 100. In another example a classification of the player's skill level based on number of strokes at each hole in the golf game. The skill level may be classified after each hole out. The same classification method might be applicable to a stroke play with a series of holes in the golf game. Moreover, bonus award might be provided when the player achieved a special play such as a hole in one. For example, the data may include a golf game skill level table 158 (shown in FIG. 32) that includes skill level records 146 including a number of strokes required to complete a hole associated with each skill level value 100.

In another embodiment, the skill-based wagering game 22 may include a fighting-type game such as Castlevania Judgment™, published by Konami Ltd. In this type game, a player controls a character and engages in a close combat with an opponent character. During the game, upon player's input to attack the opponent, success/failure of the attack and caused damage are calculated and a stamina meter of the opponent is reduced by a successful attack of the player. On the contrary, a stamina meter of the player is reduced by a successful attack of the opponent. In addition, when the player achieves sequential input correctly and timely, several attacks are chained together. This is known as "combos". Further, some of the fighting game evaluate activities and achievements of the character and corresponding game score is provided to the player. The classification of the player's skill level may be based on caused damage to the opponent in the fighting game. In this example, the skill level is determined each time the player character successfully attacks the opponent. For example, as shown in FIG. 33, the data may include a fighting game skill level table 160 that includes skill level records 146 including an opponent damage value associated with each skill level value.

As shown in FIG. 34, the classification of the player's skill level based on number of combos in the fighting game. In this example, skill level is determined each time the player achieves 2 or more combo. The fighting game skill level table 160 may include skill level records 146 including a hit combination value associated with each skill level value 100.

In another embodiment, the classification of the player's skill level based on a remaining stamina when the player win the fighting game. In this example, skill level is determined after the player wins the fighting game. If the fighting game evaluates activities and achievements of the character and provides corresponding game score, it is possible to classify the player's skill level based on such a game score. For example, as shown in FIG. 35, the fighting game skill level table 160 may include skill level records 146 including a stamina value associated with each skill level value 100.

In addition, the fighting game also has an aspect as a game of engaging in contests of accuracy and speed on inputting a series of commands such as "↓+↓+↑+↑A+A+B+B" and the like which triggers some special attack. Focusing on this aspect of the fighting game, it is possible to design a bonus skill game as follows: 1) displaying a game screen with a character and an opponent; 2. accepting a series of commands which triggers a special attack of the player; 3) evaluating difficulty, speed and accuracy of the commands; 4) classifying the player's skill level based on the evaluation; and 5) randomly determine an award of the bonus game. In addition, it is possible to classify player's skill based on input speed of a predetermined series of commands simply. For example, as shown in FIG. 36, the fighting game skill level table 160 may include skill level records 146 including an evaluation score associated with each skill level value.

Figure 8:
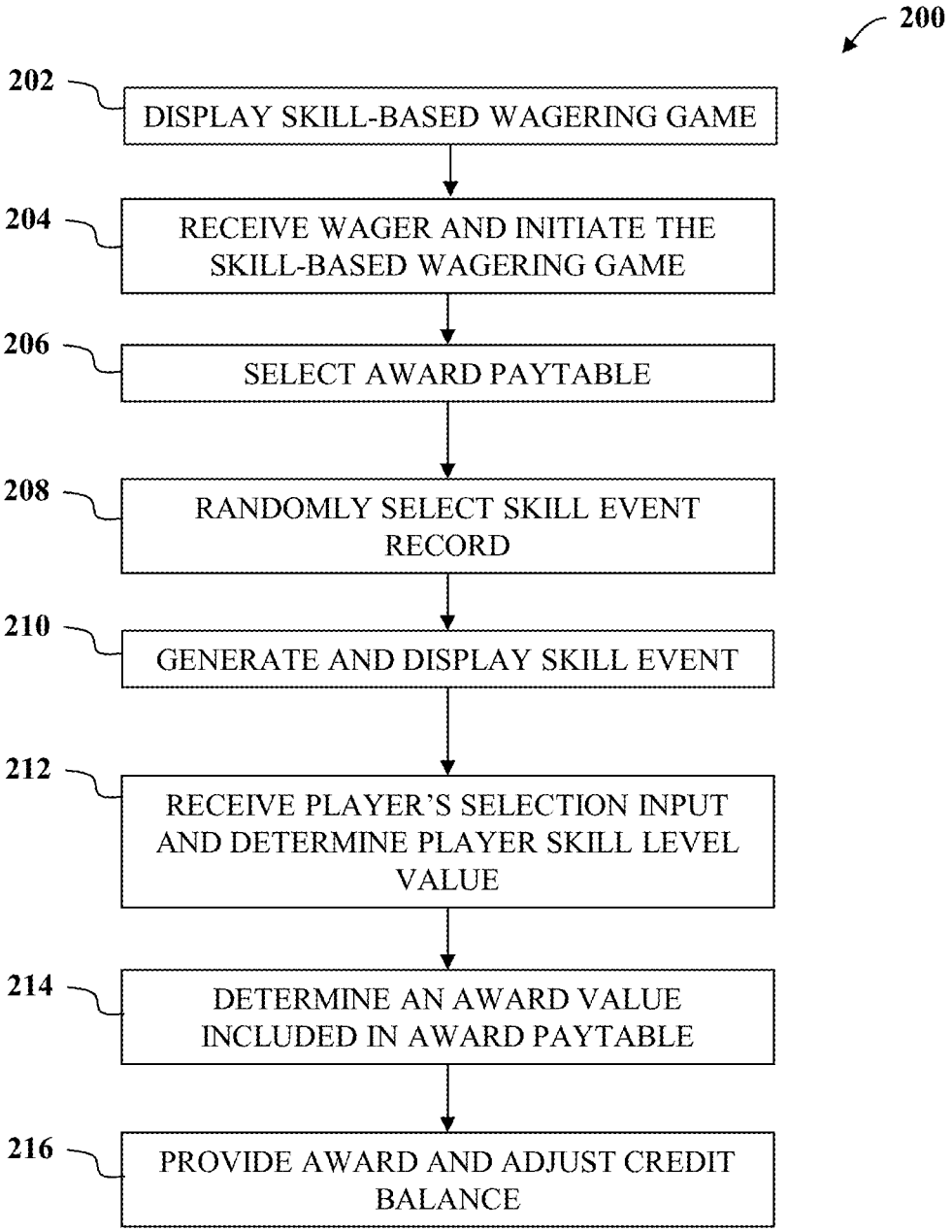
FIG. 8 is a flowchart of a method that may be used with the gaming machine shown in FIG. 1 for providing a skill-based wagering game to a player, according to an embodiment of the present invention.
Figure 9:
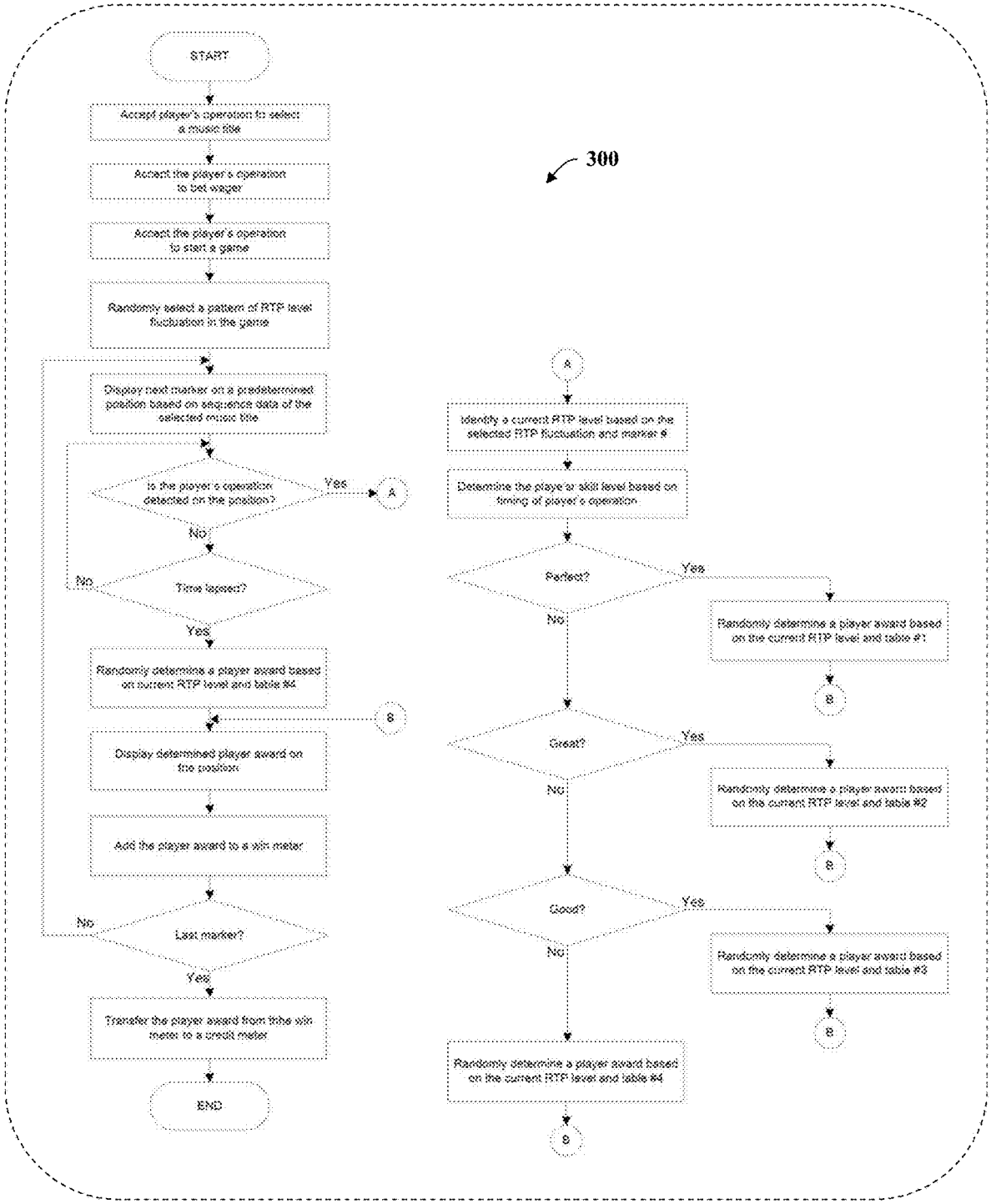
FIGS. 9-11 are flowcharts of methods that may be used with the gaming machine shown in FIG. 1 for providing a game to a player, according to an embodiment of the present invention.
Figure 10:
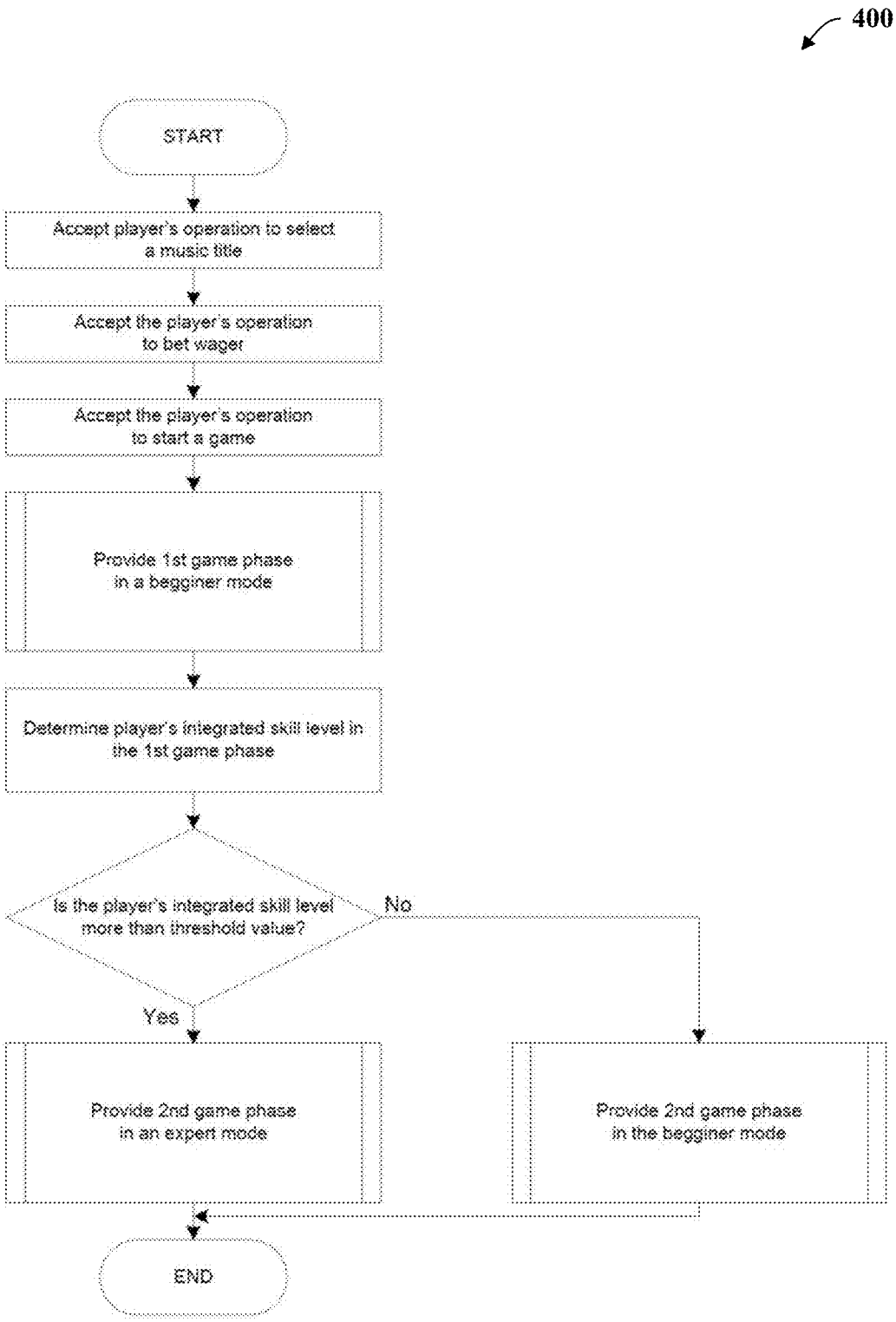
Figure 11:
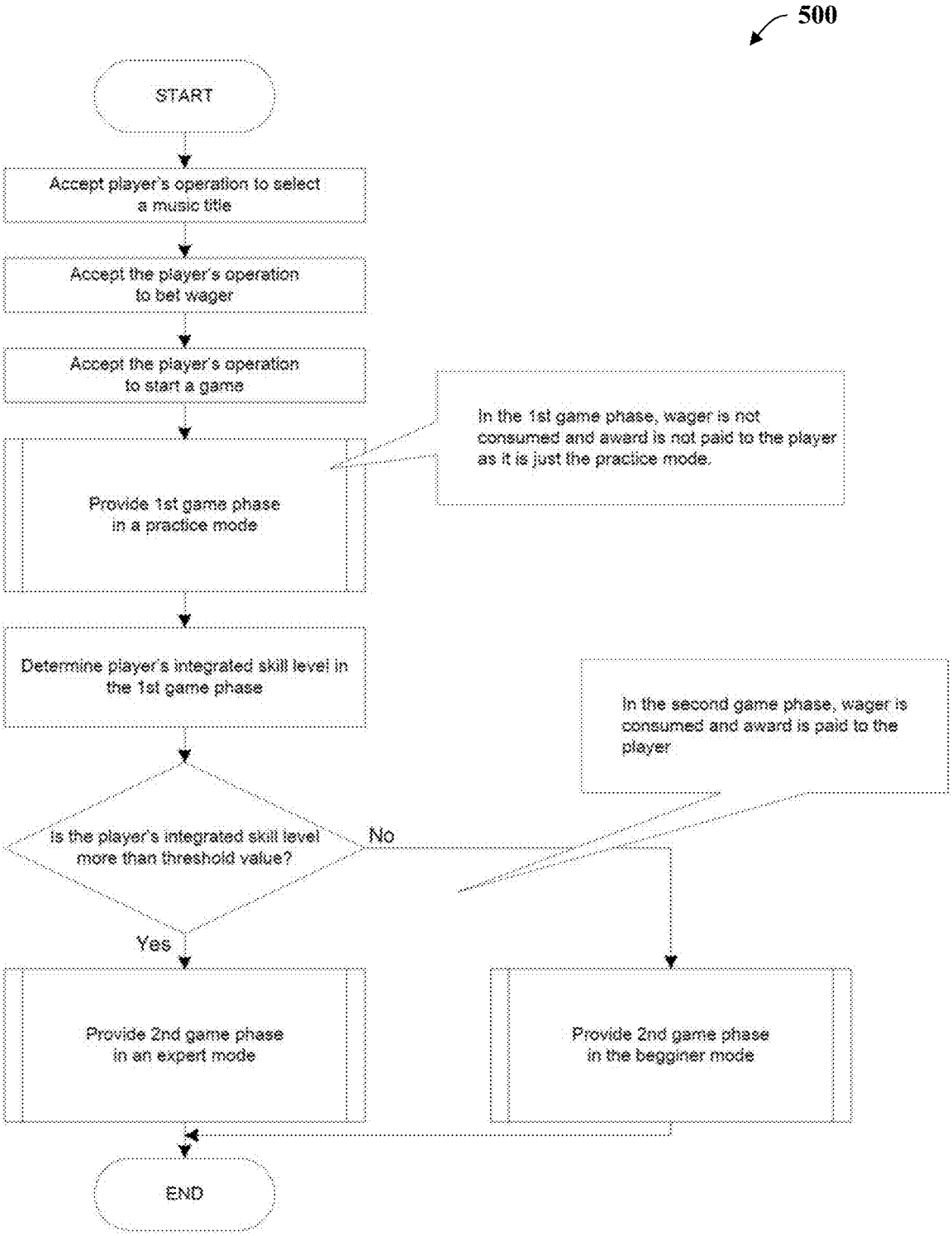

FIG. 8 is a flowchart of a method 200 that may be used to operate the gaming machine 10 to provide a skill-based wagering game to a player. FIGS. 9-11 flowcharts of additional methods 300, 400, and 500 that may be used to operate the gaming machine 10 to provide skill-based wagering games to players. The methods 200, 300, 400, and 500 include a plurality of steps. Each method step may be performed independently of, or in combination with, other method steps. Portions of the methods may be performed by any one of, or any combination of, the components of the one or more gaming machines 10. FIGS. 12-16 and 60-63 are exemplary entertaining graphical displays of a skill-based wagering game that may be played with the gaming machine 10.

In the illustrated embodiment, in method step 202, the gaming controller 12 displays the skill-based wagering game 22 on the display device 14. In one embodiment, the gaming controller 12 displays the skill-based wagering game 22 including a musical skill game that includes a plurality of skill events associated with the timing of a musical soundtrack, such as for example, Jubeat™ published by Konami, Ltd. In the illustrated embodiment, the gaming controller 12 displays the game screen 24 on the first display 26 including an information section 162 and a game section 164. The touch button unit 34 is positioned over the game section 164 and the gaming controller 12 is configured to display a plurality of graphic operational images 48 visible by the player through a corresponding transparent touch button 46. Each of the operational images 48 indicates an operation that may be performed by the gaming controller 12 when a corresponding touch button 46 is actuated by the player, e.g. depressed by the player. The information section 162 is used to display various information related to the operation of the gaming machine 10 and/or play of the skill-based wagering game 22.

Figure 12:
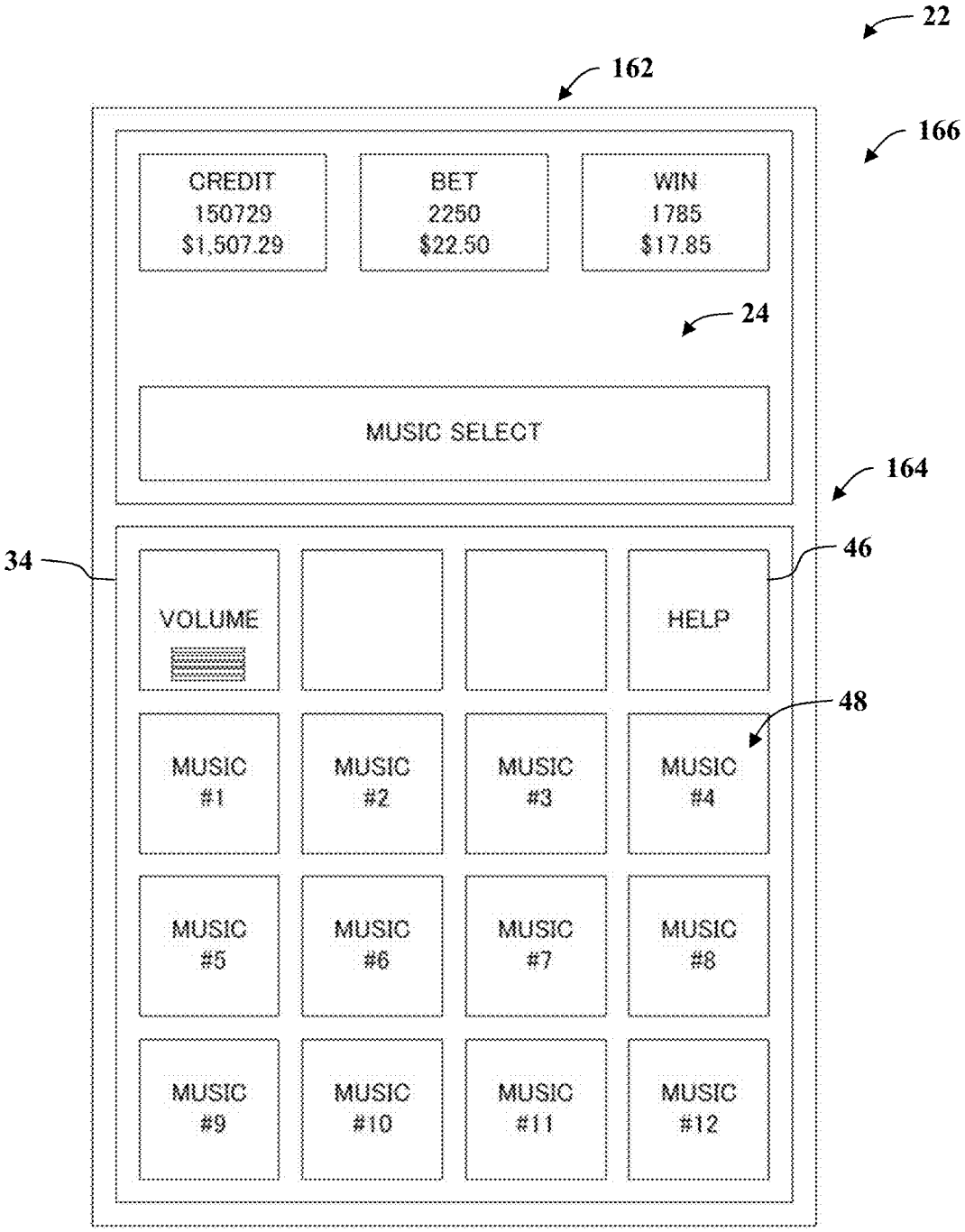
FIGS. 12-14 are exemplary entertaining graphical displays of a game screen including a skill-based wagering game that may be displayed on the gaming machine shown in FIG. 1, according to an embodiment of the present invention.
Figure 13:
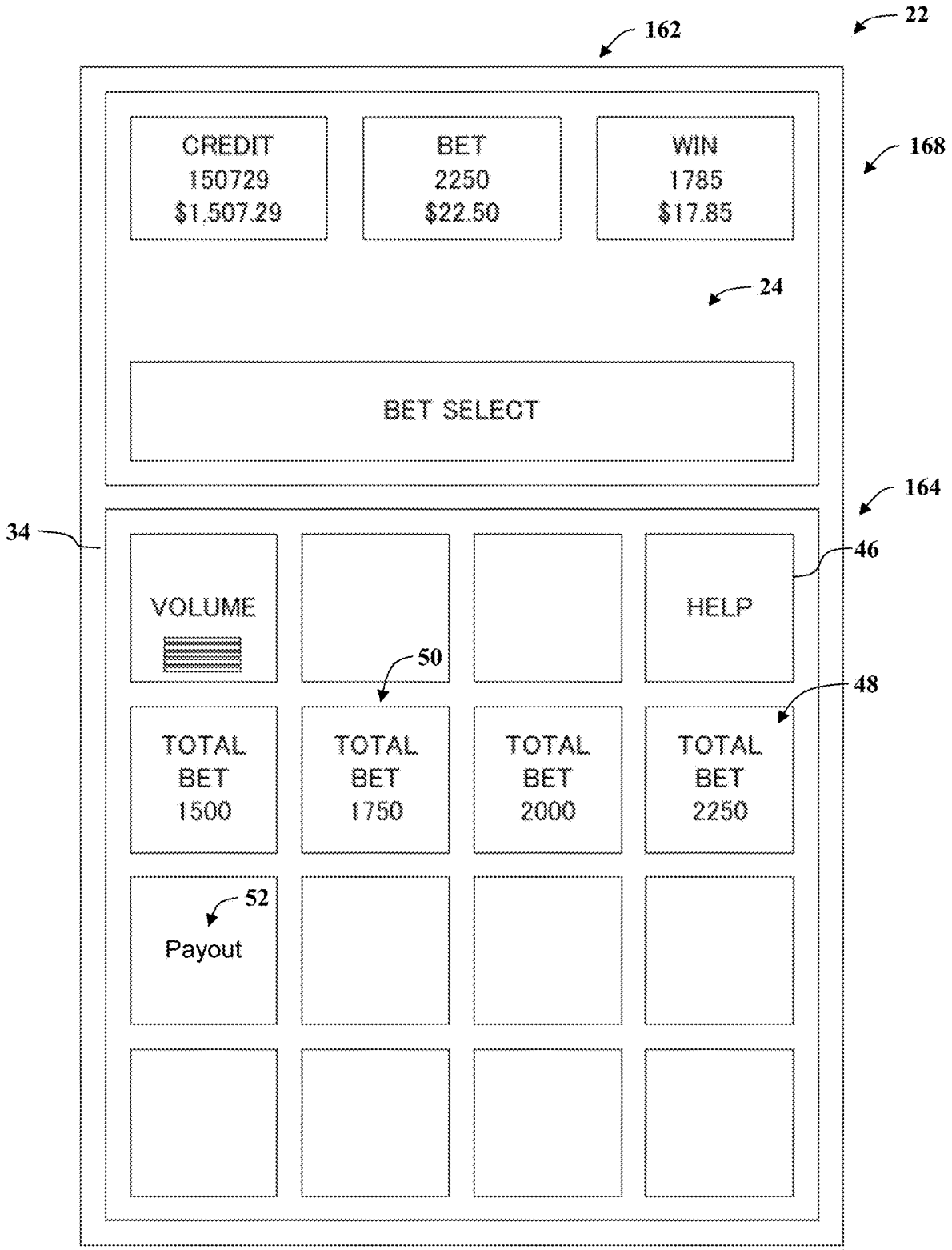

In the illustrated embodiment, the gaming controller 12 initially displays a music selection screen 166 (shown in FIG. 12) including a plurality of music selection operational images 48 to allow the player to select a musical soundtrack for use during the skill-based wagering game 22. FIG. 12 illustrates an initial music selection screen 166 waiting for a player operation. The player selects one of a music title from music #1 to #12 and touch the transparent button displaying the music title.

Upon receiving a player's selection of a musical soundtrack, the gaming controller 12 displays a wagering screen 168 (shown in FIG. 13) on the first display 26. After accepting the player's selection of the music title, the game screen changes to the wagering screen 168 including a "BET SELECT" screen. The player selects one of total bet amount from 1500 credits to 2250 credits and touches transparent button displaying the selected amount. The wagering screen 168 includes instructions for selecting a monetary bet amount to be wagered on the skill-based wagering game 22 including a plurality of betting operational images 48 associated with a plurality of predefined bet amounts.

Figure 14:
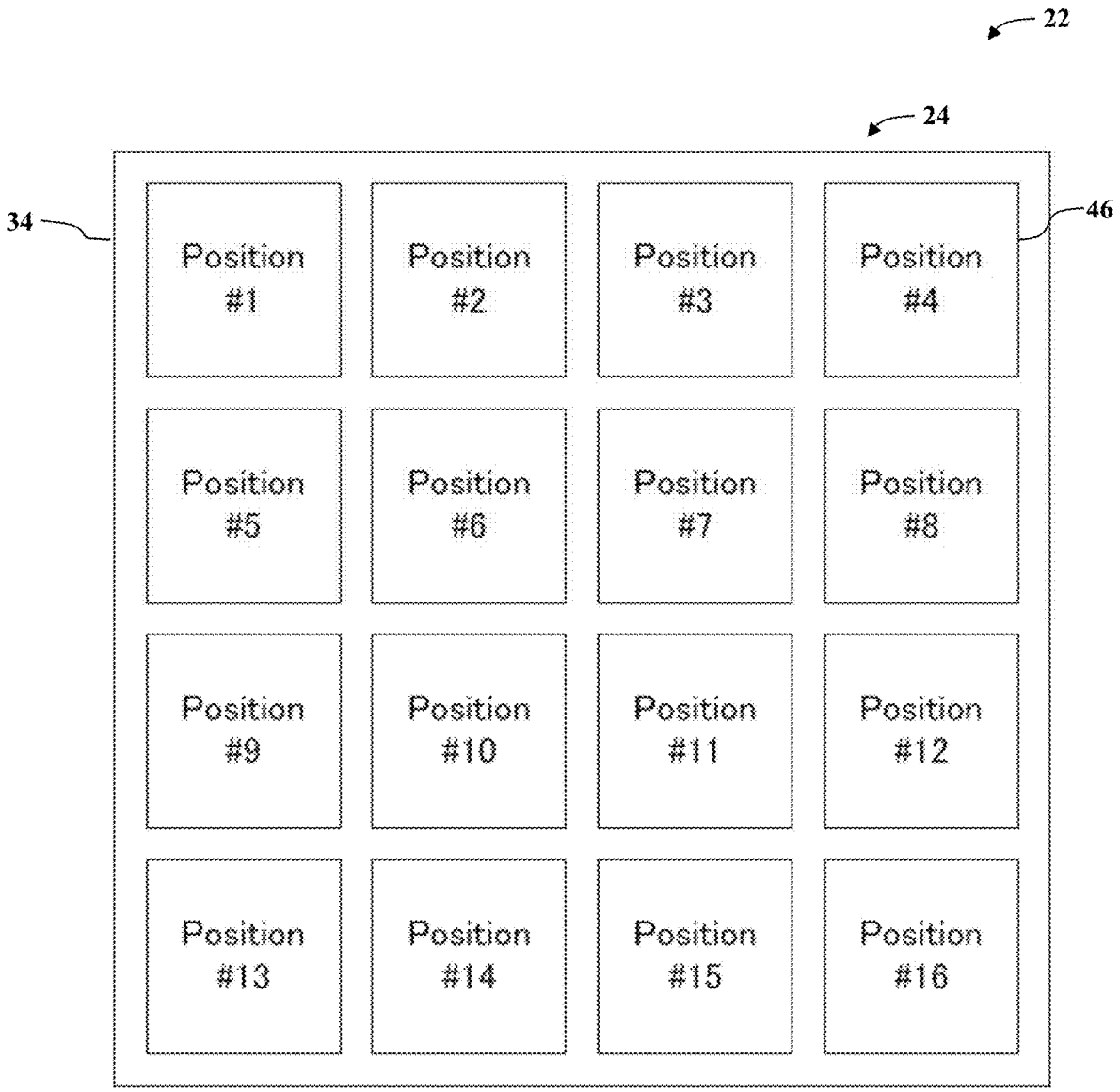

In method step 204, the gaming controller 12 receives a signal from the user input device 16 indicating a wager being placed by the player and initiates the skill-based wagering game 22. The gaming controller 12 accesses the data and selects a timing chart data record 88 associated with the player selected musical soundtrack. In addition, as shown in FIG. 14. The gaming controller 12 selects a timing record 92 for one or more of the touch buttons 46.

In method step 206, the gaming controller 12 selects an award paytable 118 for use with the skill-based wagering game 22. In one embodiment, the gaming controller 12 accesses the data and randomly selects an award paytable 118 from the plurality of award paytables 118. In another embodiment, the gaming controller 12 accesses the transition table 134 and randomly selects an award pattern record 136, and initiate the skill-based wagering game 22 using the select award pattern record 136. In one embodiment, the gaming controller 12 may identify a current skill event stage 142 of the skill-based wagering game 22, determine the award paytable 118 associated with the current skill event based on the current skill event stage, and select the award table 118 associated with the current skill event stage. In one embodiment, the gaming controller 12 may initiate the skill based wagering game including a plurality of consecutive skill event stages, with each skill event stage including a predefined number of skill events, and select a corresponding award table for each skill event stage.

In method step 208, the gaming controller 12 determines a number of skill events being included in the skill-based wagering game 22 and randomly selects a skill event record 126 from the selected award paytable 118 for each of the skill event being included in the skill-based wagering game 22. In one embodiment, the gaming controller 12 initiates the skill-based wagering game including a plurality of skill events and randomly selects a plurality of skill event records. Each of the plurality of skill events being associated with a corresponding skill event record 126. For example, in one embodiment, the gaming controller 12 accesses the selected timing chart data record 88 and determines a number of skill events 90 included in the selected timing chart data record 88. For each of the included skill events 90, the gaming controller 12 accesses the selected award paytable 118 and randomly selects a skill event record 126.

Figure 15:
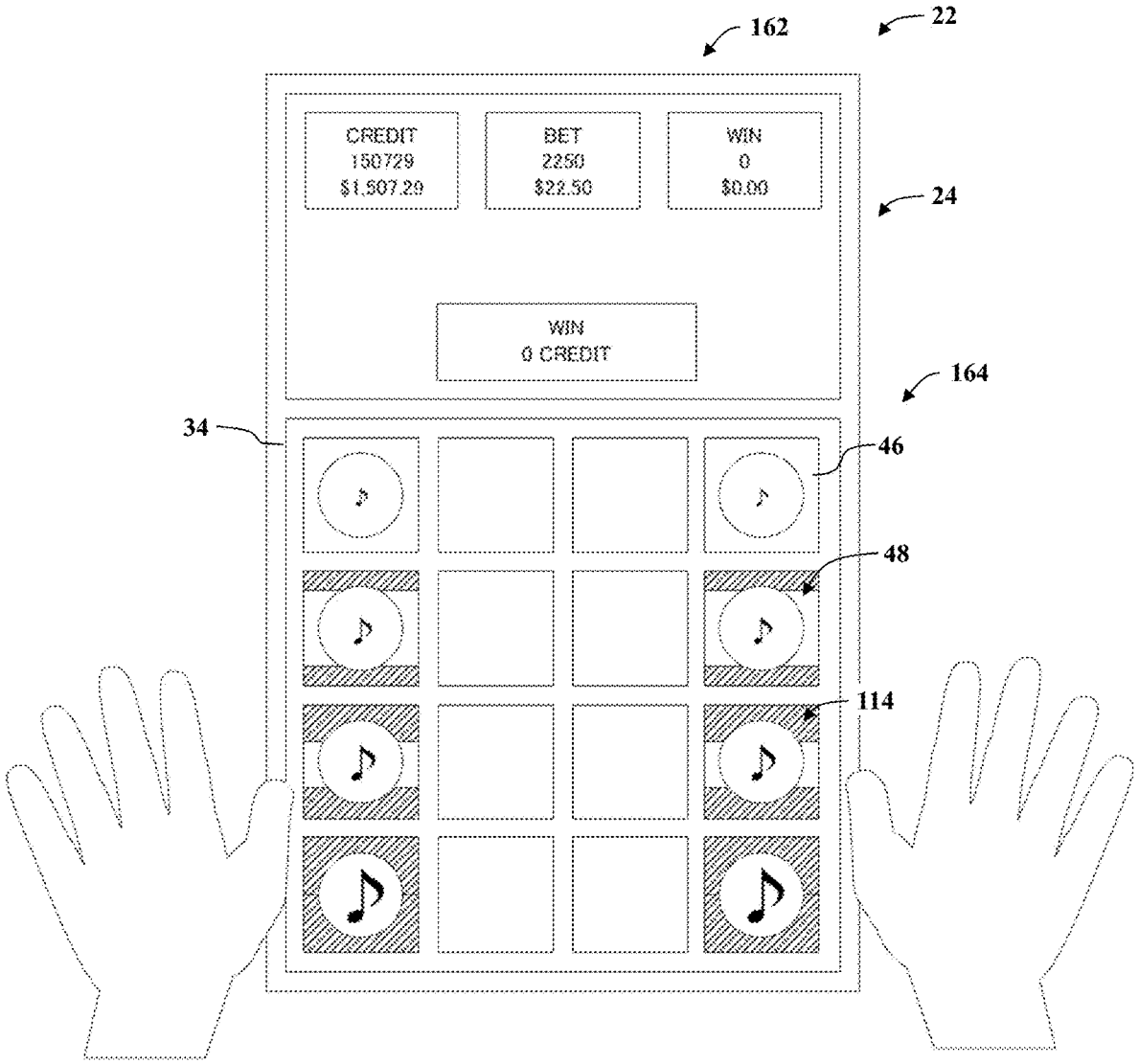
FIGS. 15-16 illustrate a sequence of exemplary entertaining graphical displays of a game screen including a skill-based wagering game that may be displayed on the gaming machine shown in FIG. 1, according to an embodiment of the present invention.
Figure 16:
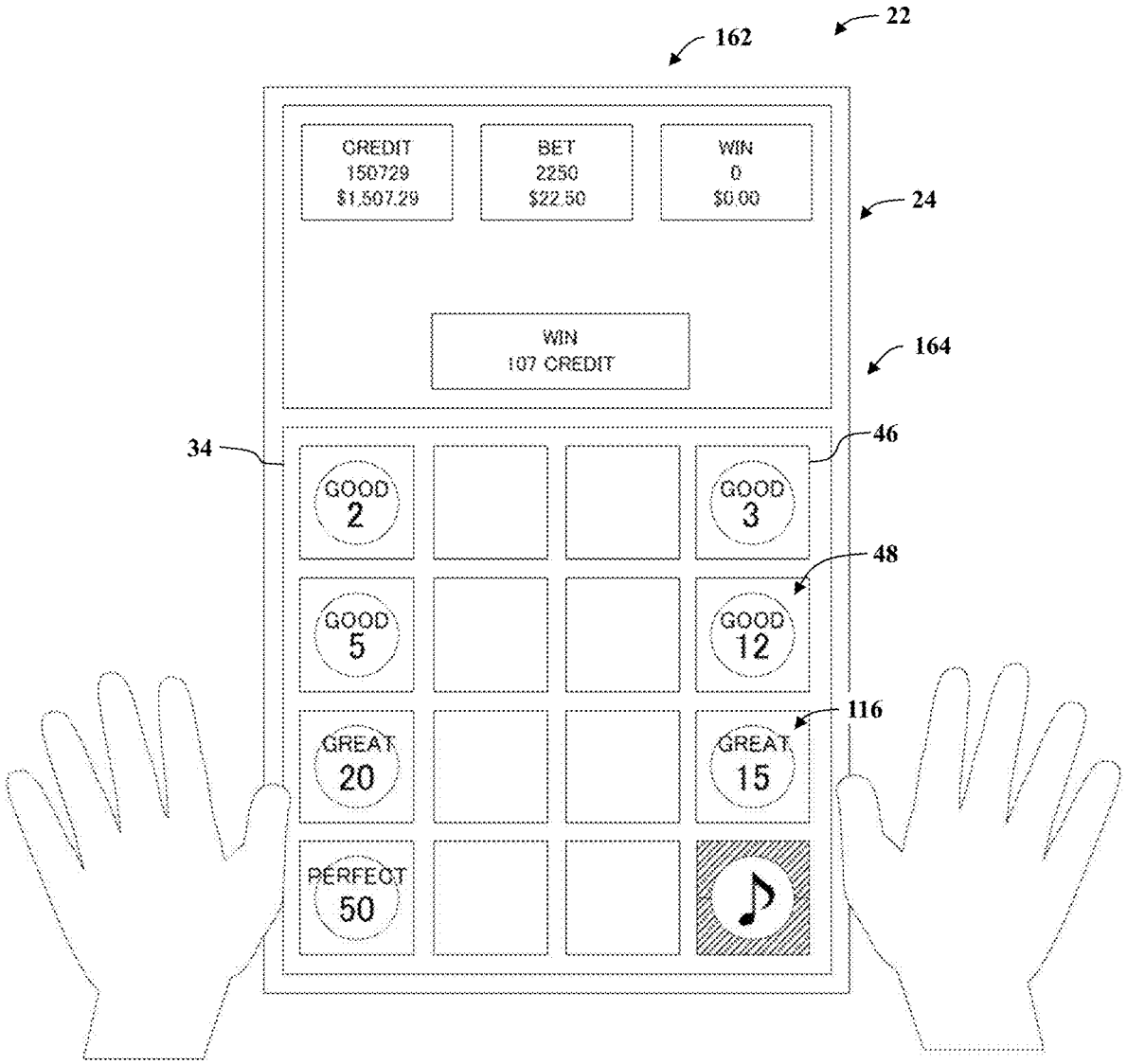

In method step 210, the gaming controller 12 generates and displays a skill event 90 to the player during the skill-based wagering game 22. For example, during the skill-based wagering game 22, the controller 12 generates and displays a skill event associated with the skill-based wagering game and randomly selects a skill event record associated with the skill event. In one embodiment, the gaming controller 12 selects an operation timing record to be used with the skill event and displays the skill event including the event time period associated with the operation timing record. The gaming controller 12 also determines the plurality of consecutive operation timing periods within the event time period and identifies a skill level associated with each consecutive operation timing periods. The gaming controller 12 also accesses the skill event record 126, selects the sequential image record associated with the selected skill event record 126 and displays the event images in coordination with the musical soundtrack (as shown in FIG. 15). For example, as shown in FIG. 15, after accepting the player's selection of the total bet amount, the skill-based wagering game is started. In one embodiment, the game play is a similar to a Whac-A-Mole™ game. The gaming machine 10 starts to play the selected music title and display "markers" with animation at respective transparent button positions on LCD unit along with a timing chart corresponding to the selected music title. The player touches the transparent button which displays the marker to the music. During the game, a series of markers are displayed and the player's touch operation is evaluated respectively. Referring to FIG. 16, when the player touches a button panel displaying the marker, the animation of the marker is switched to indication of the player's skill level and earned prize determined by the player's skill level and random number. The earned prizes are accumulated in win meter, In one embodiment, the selected skill event record may include a range of skill level values including a high skill level and a low skill level. The high skill level having a corresponding high award value and the low skill value having a corresponding low award value. The high award value being larger than the low award value. The gaming controller 12 may be programmed to initiate the event time period having a high skill timing period associated with the high skill level and a low skill timing period associated with the low skill level. In addition, the gaming controller 12 may be programmed to initiate the skill-based wagering game including a low skill mode and a high skill mode, with the low skill mode including a corresponding high skill time period that is longer than the high skill time period included in the high skill mode. In one embodiment, the gaming controller 12 may allow the player to select between the high skill mode or the low skill mode. In another embodiment, the gaming controller may randomly select the high skill mode or the low skill mode to initiate the skill-based wagering game. Moreover, the gaming controller 12 may also be programmed to randomly select the high skill mode or the low skill mode for each stage of the skill-based wagering game.

In one embodiment, the gaming controller 12 may be programmed to initiate an initial skill-based free game before initiating the skill-based wagering game. The initial skill-based free game may include a plurality of consecutive skill events including the low skill mode. The gaming controller 12 may determine a player integrated skill level associated with the initial skill-based free game based on the timing of the player's selection inputs associated with each of the consecutive skill events. The gaming controller 12 may initiate the skill-based wagering game including the low skill mode if the player integrated skill level is less than a predefined integrated skill level and initiate the skill-based wagering game including the high skill mode if the player integrated skill level is equal to or greater than the predefined integrated skill level.

In method step 212, the gaming controller 12 receives a player's selection input via the touch button 46 in response to the displayed skill event and determines a player skill level value based on the received player's selection. For example, in one embodiment, the gaming controller 12 detects a player's operation timing associated with the player's selection input and determines a corresponding consecutive operation timing period within the event time period 96 associated with the player's operation timing.

In method step 214, the gaming controller 12 accesses the corresponding skill event record 126 and determines an award value included in the corresponding skill event record 126. In one embodiment, as shown in FIG. 16, the gaming controller 12 selects an award image associated with the determined award value and displays the award image within the touch button 46 for a predefined period of time to notify the player of the corresponding award.

In method step 216, upon the conclusion of the skill-based wagering game 22, the gaming controller 12 determines the total awards being provided to the player based on the award values achieved during each skill event and adjusts a credit balance associated with the player.

With reference to FIG. 9, in method 300, the gaming controller 12 is programmed to display the music selection screen 166 on the display device 14 and accept a player's selection of a music title. Upon receiving the player's music selection, the gaming controller 12 displays the wagering screen 168 and accepts the player's operation to bet a wager. The gaming controller 12 then receives a signal from the player to start the skill-based wagering game, accesses the transition table 134 and randomly selects an RTP award pattern record 136. The gaming controller 12 then displays a plurality of skill events 90 at various touch button positons based on timing chart data record associated with the player's music selection. The gaming controller 12 then determines if a player's operation of a touch button corresponding to a displayed skill event has been detected. If the gaming controller 12 does detects the player's operation of the corresponding touch button, the gaming controller 12 identifies current stage of the skill event, and identifies the RTP award paytable corresponding to the current stage. The gaming controller 12 then determines the player's skill level based on the timing of the player's operation. The gaming controller 12 then randomly determines a player award based on the determined skill level and the identified RTP award paytable. The gaming controller 12 then displays the determined award on the corresponding touch button position and adds the award value to the displayed win meter (shown in FIG. 16). The gaming controller 12 determines if the last skill event has been displayed. If the last skill event has been displayed, the gaming controller 12 transfers the player award from the win meter to a credit meter (shown in FIG. 16). If the last skill event has not been displayed, the gaming controller 12 displays the next skill event included in the timing chart data record. If the gaming controller 12 does not detect player's operation of the touch button corresponding to a displayed skill event, the gaming controller 12 randomly determines a player award based on a low skill level value and the current award paytable, after a predefined period of time has elapsed.

Referring to FIG. 10, in one embodiment, the gaming controller 12 may be programmed to implement method 400 to adjust a difficulty of the skill-based wagering game as the skill-based wagering game progresses through multiple phases. For example, the gaming controller 12 may accept the player's operation to select a music title and accept the player's operation to bet a wager. Upon receiving a signal from the player to start the skill-based wagering game, the gaming controller 12 provides a $1^{st}$ game phase of the skill-based wagering game in a beginner mode using the low skill operation timing record 110. The gaming controller 12 displays the plurality of skill events and determines the player's integrated skill level in the $1^{st}$ game phase. In one embodiment, the integrated skill level is determined based on a total amount of award values received during the $1^{st}$ game phase. Upon completion of the $1^{st}$ game phase, if the player's integrated skill level is more than a predefined threshold value, the gaming controller 12 initiates a $2^{nd}$ phase of the skill-based wagering game using the high skill operation timing record 112. If the player's integrated skill level is less than the predefined threshold value, the gaming controller 12 initiates the $2^{nd}$ phase of the skill-based wagering game using the low skill operation timing record 110.

Referring to FIG. 11, in one embodiment, the gaming controller 12 may be programmed to implement method 500 to initiate a skill-based free game prior to initiating the skill-based wagering game to determine a player's integrated skill level and select a skill mode used during the skill-based wagering game. For example, the gaming controller 12 may accept the player's operation to select a music title and accept the player's operation to bet a wager. Upon receiving a signal from the player to start the skill-based wagering game, the gaming controller 12 provides a $1^{st}$ game phase using a skill-based free game in which the wager is not consumed and an award is not paid out to the player. The $1^{st}$ game phase is initiated in a beginner mode using the low skill operation timing record 110. The gaming controller 12 displays the plurality of skill events and determines the player's integrated skill level in the $1^{st}$ game phase. In one embodiment, the integrated skill level is determined based on a total projected amount of award values received during the $1^{st}$ game phase. Upon completion of the $1^{st}$ game phase, if the player's integrated skill level is more than a predefined threshold value, the gaming controller 12 initiates the skill-based wagering game using the high skill operation timing record 112. If the player's integrated skill level is less than the predefined threshold value, the gaming controller 12 initiates the skill-based wagering game using the low skill operation timing record 110.

Figure 68:
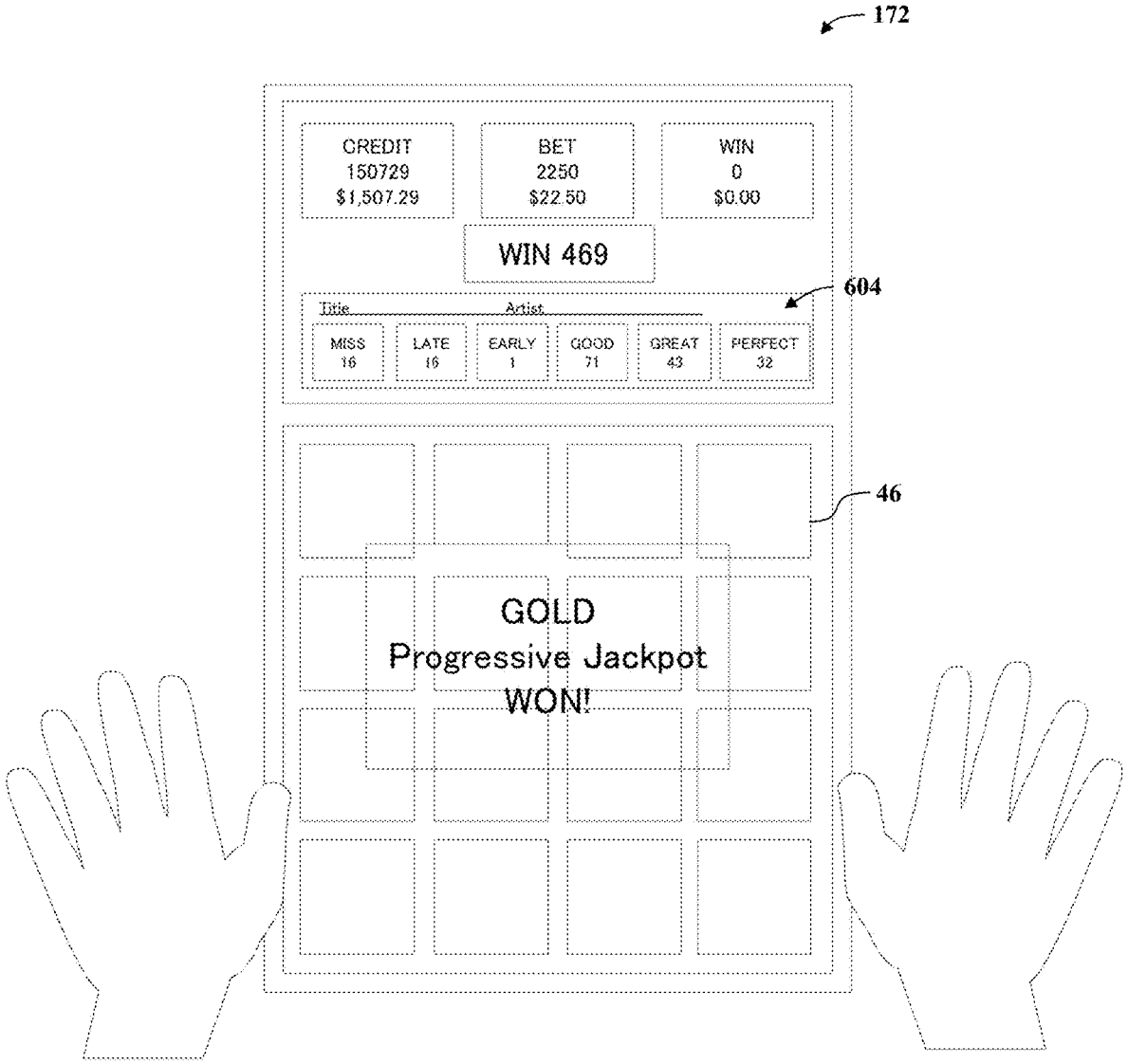

In one embodiment, the gaming controller 12 may be programmed to provide a primary skill-based wagering game 22 (shown in FIGS. 12-16 and 60-63), a skill contest bonus game 170 (shown in FIGS. 64-67), and progressive jackpots 172 (shown in FIG. 68). In one embodiment, during the primary skill-based wagering game 22, the player selects a music piece among the displayed music list. The player determines the bet value for a game, e.g. the minimum bet is 500 credits. The player presses either the directly play button or the practice mode plus play button. The pattern for music notes is randomly determined when the play button is pressed. Each music piece has 4 patterns of music notes and 100 lit squares (e.g. skill event markers). The result of player's skill is determined by the timing when the player presses the button. The results are "Perfect", "Great", "Good", "Early", "Late" or "Miss". Each result has the different pay table, but "Early", "Late" and "Miss" have same pay table.

In one embodiment, the skill contest bonus game is triggered when any 3, 4 or 5 coins is collected during the primary game. The number of the gold coins is randomly determined when the play button is pressed. If the player obtains all perfects at Skill Contest, the score is 100,000 points. If the player obtains all Misses at Skill Contest, the score is 30,000 points. The upper score and the lower score are not different each music pieces. Number of Lit Square of each music pieces for skill contest is different. Wins are calculated by the obtained scores. The wins are calculated "1 credits=100 points of score when this bonus game is triggered by collecting 3 gold coins during primary game. The wins are calculated "1 credits=10 points of score when this bonus game is triggered by collecting 4 gold coins during primary game. The wins are calculated "1 credits=1 points of score when this bonus game is triggered by collecting 5 gold coins during primary game. Wins are multiplied by the bet level. If the obtained score is ranked in Top 10, the player can register his initials on the ranking board.

In one embodiment, the progressive jackpots "Gold Crown", "Silver Crown" and "Bronze Crown". A jackpot symbol is randomly shown after the last lit square appears during Skill Contest Bonus Game. Shown Gold Crown symbol, $1,000 (reset value) is paid to the player. Shown Silver Crown symbol, $100 (reset value) is paid to the player. Shown Bronze Crown symbol, $30 (reset value) is paid to the player.

Figure 56:
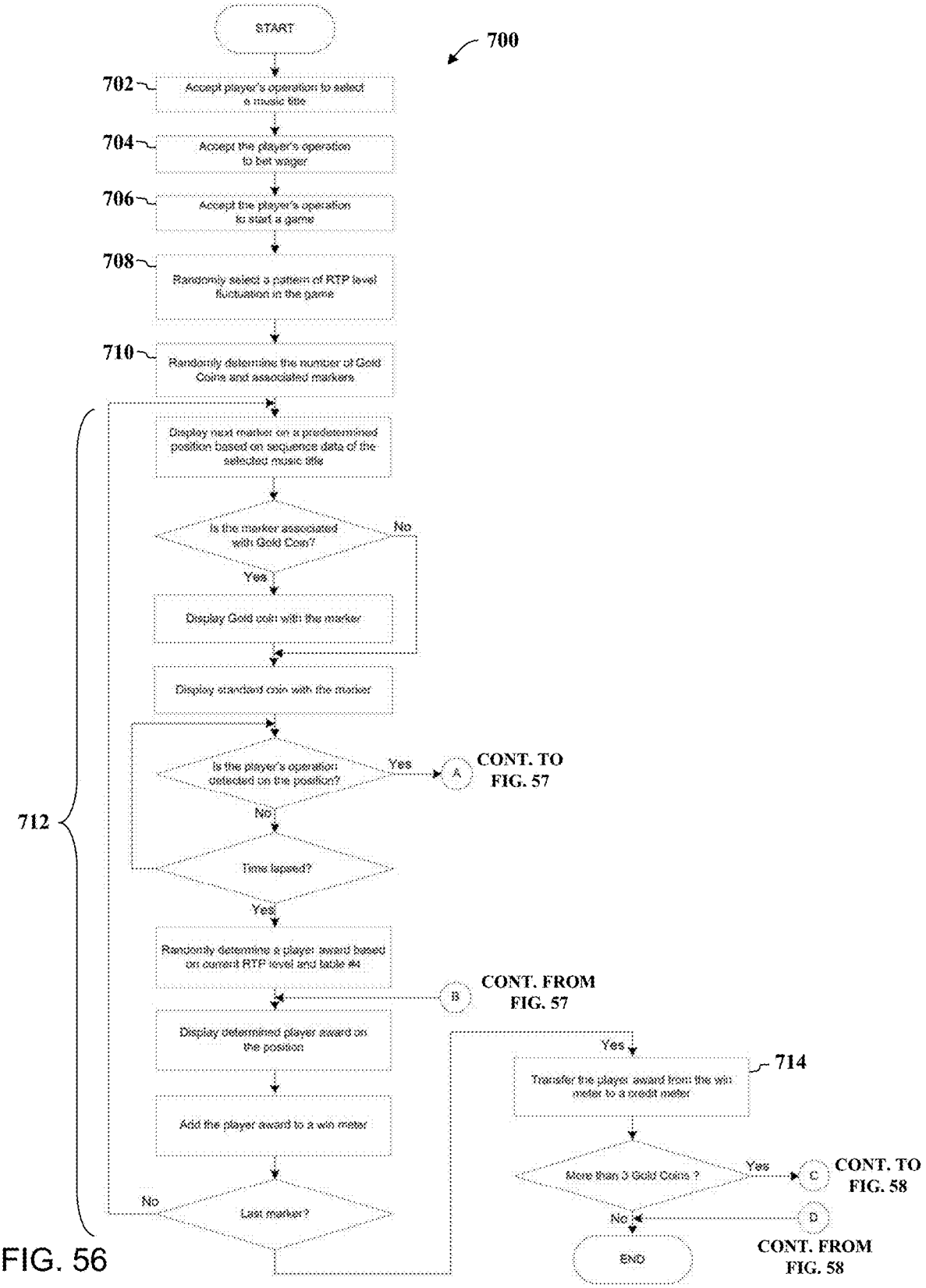
FIGS. 56-59 are flowcharts a methods that may be used with the gaming machine shown in FIG. 1 for providing a skill contest game to a player, according to an embodiment of the present invention.
Figure 57:
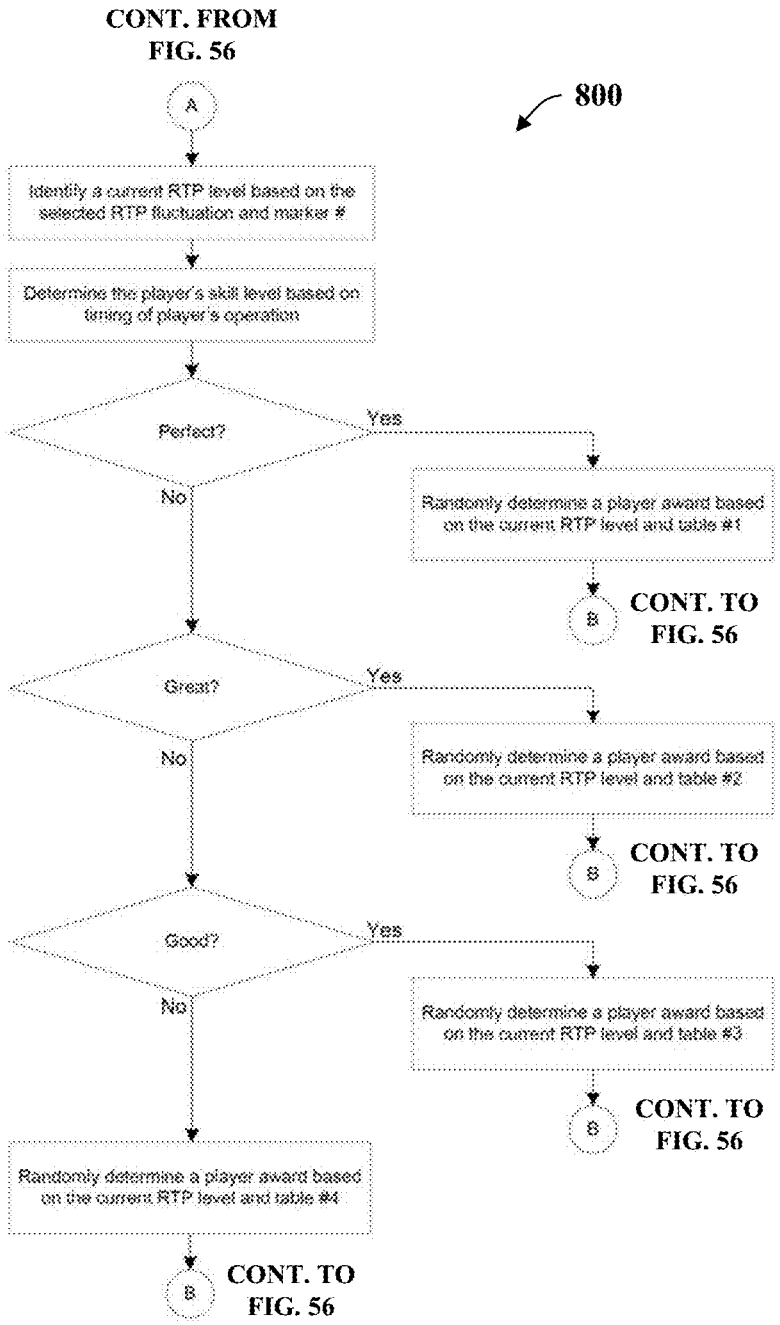
Figure 58:
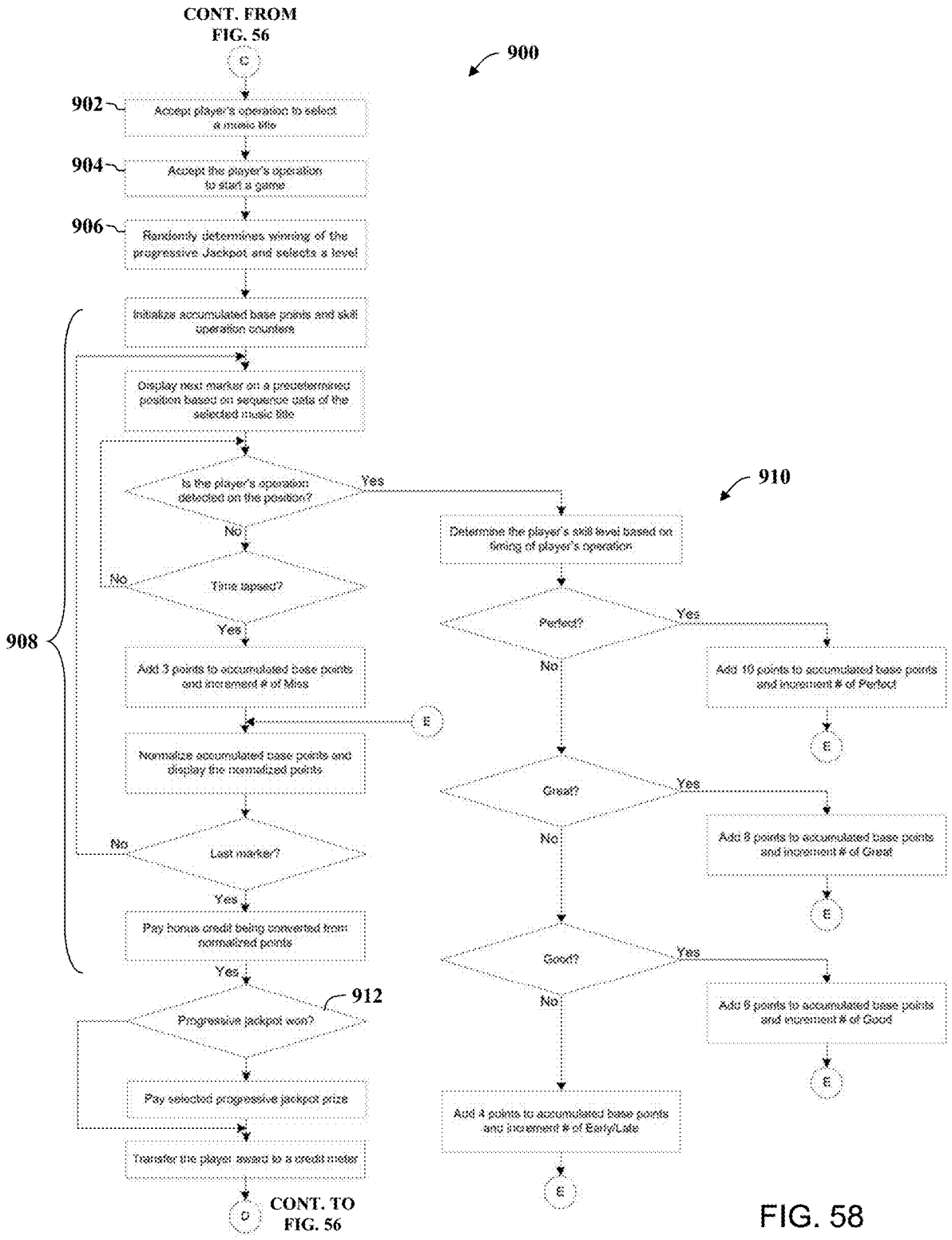

FIG. 56-58 are flowcharts of methods 700, 800, 900, 1000 that may be used to operate the gaming machine 10 to provide a primary skill-based wagering game and a bonus skill contest game to a player. Each method step may be performed independently of, or in combination with, other method steps. Portions of the methods may be performed by any one of, or any combination of, the components of one or more gaming machines 10. FIGS. 60-68 are exemplary entertaining graphical displays of the skill-based wagering game and the skill contest game that may be played with the gaming machine 10.

In the illustrated embodiment, in method step 702 the gaming controller 12 is programmed to display a music selection screen 166 (shown in FIGS. 60 and 65) to allow the player to select a music soundtrack associated with the skill-based wagering game from a plurality of music soundtracks being stored in the data.

The music selection screen 166 may be displayed at the play waiting condition. The music selection screen 166 includes Music pieces buttons displayed in the touch buttons 46, which player determines a piece for game play. One page can display up to 8 music pieces with additional music selections displayed on additional other pages. The display order of music pieces are sorted by number of game play. The music piece which the most number of the gameplay is displayed on the upper left corner. That order will be updated every game. A Help button, help screen will be displayed on above music selection area. Sound Volume buttons adjust the game sound volume. Page switching buttons switch the music list page.

In the illustrated embodiment, the data includes a music data file 174 (shown in FIG. 37) associated with each music soundtrack that may be used by the gaming controller 12 to generate the timing chart data records 88 (shown in FIG. 17) used during the skill-based wagering game 22 and to generate and display information associated with the music soundtrack. As shown in FIG. 37, each music data file 174 includes data and information associated with a corresponding musical soundtrack including, but not limited to, music title, artist name, difficulty level, beats per minute (BPM), music genre, sound label data files, source code data, time length of music, and number of markers and/or skill events 90.

In one embodiment, the gaming controller 12 may be configured to determine a difficulty level associated with a musical soundtrack based on previous instances of the skill-based wagering game and skill contest game that have used the music soundtrack. The gaming controller 12 may be programmed to retrieve previous scores associated with the music soundtrack, calculate an average score of the previous scores, and normalize the average score based on a difficulty range between 0 and 10. The gaming controller 12 may then access a difficulty level data file 176 (shown in FIG. 39) being stored in the data that includes a plurality of difficulty levels associated with subsets within the difficulty range between 0 and 10, and selects a difficulty level associated with the normalized average score. The gaming controller 12 then accesses a difficulty level indication file 178 (shown in FIG. 38) stored in the data and selects a difficulty level indicator (e.g. a number of "Stars") associated with the selected difficulty level that is displayed to the player to indicate the current difficulty level associated with the music soundtrack. The difficulty level indication will be updated by average of every game play. The score played is calculated internally. The score calculation is same one of skill contest. For example, an all "perfect" skill game is 100,000 points (top score), and an all "miss" skill game is 30,000 points (bottom score). The gaming controller 12 calculates the average score of each music piece, normalize that average score by 0 (lower) and 10 (upper), and Difficulty Level is determined by the result of the normalized.

In method step 704, upon receiving a selection of a musical soundtrack from the player, the gaming controller 12 displays a wagering screen 168 (shown in FIGS. 13 and 60) that allows the player to indicate an amount of credits bet on the skill-based wagering game. The wagering screen 168 is displayed after player selected a music piece for game play. A Bet button selects a bet for a game play. The selected button is highlighted. Play and Play via practice buttons, these buttons are highlighted, activated by selecting a bet button. A Return to music select button, it is able to be back to music select screen. In one embodiment, a Minimum Bet is 500 credits (=5 credits per lit square×100 lit squares). Music pieces may have 100 lit squares (i.e. skill event markers), player bets the amounts for 100 lit squares in advance.

In method step 706, the gaming controller 12 receives a signal from the player to initiate the skill-based wagering game, and proceeds to method step 708. In general, referring to FIG. 60, during play of the skill-based wagering game 22 a "Lit Square" (skill event marker) will pop up on the play button. The pattern (positons and timing) of each music piece is different. All music pieces for primary game have 100 lit squares. The judgement of skill is determined by tapping timing. Wins are determined based on the judgement of skill. The results of skill judgement are displayed during the primary game. The Gold coin may pop up instead of the normal coin during the primary game. The Skill Contest Bonus Game is triggered by the number of the gold coins.

In method step 708, the gaming controller 12 selects a pattern of RTP level fluctuation in the primary skill-based wagering game. For example, in one embodiment, the gaming controller 12 is programmed to access the transition data file 134 (shown in FIGS. 27 and 41) and randomly selects an award pattern record 136 from the transition data file 134. The gaming controller 12 then determines the current event stage of the skill-based wagering game and selects the appropriate award paytable 118 from the data. For example, in one embodiment, the gaming controller 12 may access the transition data file 134 shown in FIG. 41, randomly select an award pattern record 136 from the transition data file 134. For example, one award pattern record 136 may be selected from the thirty-one patterns included in the transition data file 134 when player presses the Play button. An award pattern record 136 has 4 stages, a stage has 25 lit Squares (i.e. skill events). Wins per lit square is determined based on the scenario and the pay table by player's skill is judged when player tapped the button.

In method step 710, the gaming controller 12 determines the number of skill events and the sequential display pattern to be generated during the skill-based wagering game. For example, in one embodiment, the gaming controller 12 access display pattern data 180 associated with the selected music soundtrack (shown in FIG. 40) being stored in the data, and randomly selects a display pattern 182 for use in the skill-based wagering game 22. As shown in FIG. 40, in one embodiment, the display pattern data 180 associated with each music soundtrack includes a plurality of display patterns 182. Each display pattern 182 includes an appearance time and position indicator corresponding to an associated touch button 46 (shown in FIG. 14). The gaming controller 12 is configured to randomly select a display pattern 182 for use during the skill-based wagering game 22.

In one embodiment, each music piece has 4 patterns of music notes. One of the music notes is randomly selected when Play button is pressed. The details (Time and Position of each lit square) are written in the display pattern data 180. For example, in one embodiment, the gaming controller 12 may generate the timing chart data record 88 using the randomly selected display pattern 182. In one embodiment, the gaming controller 12 may be programmed to generate each display pattern 182 using a touch button position table 184 included in the display pattern data 180. The touch button position table 184 includes a plurality of button patterns associated with the touch buttons 46. For example, in one embodiment, the touch button position table 184 may include four button patterns, labeled P1, P2, P3, and P4, respectively. Position pattern P1 includes a basic button position with touch button labels 1-16 starting from left to right. Position pattern P2 includes the basic button position orientated in a flip-horizontal orientation. Position pattern P3 includes the basic button position orientated in a flip-vertical orientation. Position pattern P4 includes the basic button position rotated 180 degrees.

In one embodiment, the gaming controller 12 is programmed to generate appearance count data 186 associate with each display pattern 182 that includes a number of times a marker (e.g. skill event 90) appears in a corresponding touch button 46.

Figures 48, 49:
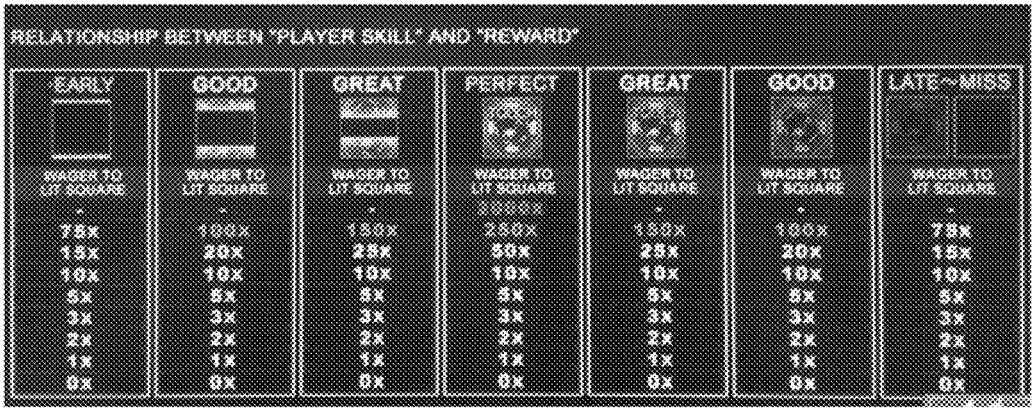

In addition, the gaming controller 12 is programmed to determine whether a triggering condition associated with the skill contest game 170 (shown in FIGS. 64-67) will appear during the skill-based wagering game 22. For example, the triggering condition may be defined as the appearance of three or more "Gold Coins" during the skill-based wagering game 22. In one embodiment, the gaming controller 12 may access a skill contest game triggering data file 188 (shown in FIG. 49) stored in the data for use in randomly determine whether a triggering condition will occur during the primary skill-based wagering game 22. As shown in FIG. 49, in the illustrated embodiment, the skill contest game triggering data file 188 includes information associated with a plurality of triggering events 190. For example, each triggering event 190 includes a number of "Gold Coins" appearing in the primary skill-based wagering game, a trigger cycle, a credit award ratio, and a range of bonus credits. The gaming controller 12 is programmed to access the skill contest game triggering data file 188 and randomly determine if a triggering event 190 will occur during the primary skill-based wagering game based on the trigger cycle data included in the skill contest game triggering data file 188.

Upon determining the number of skill events and the sequential display pattern to be generated during the skill-based wagering game, and whether a triggering event 190 will occur during the primary skill-based wagering game 22, the gaming controller 12 conducts a round of the primary skill based wagering game and implements method step 712.

In the illustrated embodiment, the gaming controller 12 implements method step 712 for each skill event 90 included in the primary skill-based wagering game 22. In method step 712, the gaming controller 12 determines an award to be provided to the player based on each skill event marker 90. In the illustrated embodiment, the gaming controller 12 is configured to calculate an event wager amount associated with each skill event based on the wager amount placed on the skill-based wagering game by the player. The gaming controller 12 is programmed to calculate the event wager amount by dividing the total amount of the wager placed by the player by the number of skill events associated with the selected music soundtrack, and assign the event wager amount to each skill event. For example, a wager of 500 credits being placed on a game having 100 skill markers in the selected music soundtrack generates a 5 credit event wager amount associated with each skill event. During the skill-based wagering game, the gaming controller 12 is programmed to randomly determine an event award for each skill event, and provide a total award to the player based on each randomly determined event award.

In the illustrated embodiment, for each skill event 90, the gaming controller 12 displays the skill event marker 90 on a predefined touch button positon based on the sequence data of the selected music soundtrack. The gaming controller 12 also determines when a "Gold Coin" associated with a triggering event will be displayed with the skill event marker 90. As show in FIGS. 19, 45 and 61, the gaming controller 12 displays the skill event marker 90 with a plurality of sequential images associated with a corresponding sequential image record 114. As shown in FIGS. 45 and 46, each sequential image is associated with a corresponding operation timing period 98. Each operation timing period 98 includes a subset of time of the event time period 96 associated with the skill event marker 90. In the illustrated embodiment, the gaming controller 12 displays the skill event marker 90 using the sequential image record 114 and detects a touch operation of the player using the corresponding touch button 46.

Upon detecting the touch operation associated with the corresponding touch button 46, the gaming machine proceeds to implement method 800 (shown in FIG. 57). In the illustrated embodiment, in method 800, upon detecting the touch operation from the player, the gaming controller 12 is programmed to identify the current RTP level associated with the corresponding skill event marker 90. For example, in one embodiment, the gaming controller 12 is programmed to determine the order number assigned to the corresponding skill event marker 90 based on the selected display pattern 182, determine the event stage 142 associated with the determined order number, and access the selected RTP award pattern record 136 to determine the corresponding award paytable 118.

The gaming controller 12 also determines a player's skill level based on the timing of the player's touch operation. In the illustrated embodiment, that gaming controller 12 determines a judgement of skill bases on the time of button input of when player taps the button which the lit square (skill event marker) is being popped up. The skill-based wagering game 22 includes eight different kinds of the judgements, which are "Perfect", "Great", "Good", "Early", "Late" and "Miss". For example, the gaming controller 12 may be programmed to determine the operation timing period 98 associated with the timing of the detected touch operation, and assign a skill value 100 to the player's touch operation based on the corresponding operation timing period 98. The gaming controller 12 then selects the award paytable 118 associated with the assigned skill value 100 and determines an event award based on the selected award paytable 118 and the calculated event wager amount. For example, each Judgement has three kinds of the award tables (Low, Middle and High) which RTP and the weight for payment are different The gaming controller 12 repeats method step 712, until the last skill event marker 90 in the selected display pattern 182 has been displayed.

Referring again to FIG. 56, upon determining that the last skill event marker 90 has been displayed, the gaming controller 12 proceeds to method step 714, and determines a primary award to be provided to the player based on each of the event awards. The gaming controller 12 also displays an award screen 192 (shown in FIG. 62) to notify the player of the primary award being provided. In the illustrated embodiment, the gaming controller 12 also records the outcome of each skill event in a game results data file 194 that may be displayed in a game results screen 196 (shown in FIG. 63). The game results data file 194 may include information associated with each displayed skill event including, but not limited to, the position and time the skill event was displayed, the detected timing of the touch operation, the determined skill level, and the amount of the event award. The gaming controller 12 may also display a graphic including the number of times each corresponding skill level was achieved by the player.

Upon completion of the primary skill-based wagering game 22, the gaming controller 12 determines whether a triggering event has occurred during the skill-based wagering game 22. For example, in one embodiment, the gaming controller 12 may determine a number of "Gold Coins" appearing in the primary skill-based wagering game, and display the bonus skill contest game to the player if three or more "Gold Coins" appeared in the primary skill-based wagering game 22. Upon detecting the occurrence of a triggering event, the gaming controller 12 implements method 900 (shown in FIG. 58) to provide a skill contest game 170 to the player. For example, when 3, 4 or 5 gold coins are collected during primary game, this bonus game is triggered. Each trigger cycle is not different by bet amounts. This bonus wins range are different by number of gold coins.

Referring to FIG. 58, the gaming controller 12 implements method 900 to generate and display a skill contest game 170 (shown in FIGS. 64-67) to the player. In the illustrated embodiment, in method step 902, the gaming controller 12 displays the music selection screen 166 and receives a selection of a music soundtrack from the player. When the skill contest game is triggered, player selects a music piece for this game. Music pieces for skill contest may be different from ones for primary game, music length, number of lit squares, positions of notes.

In method step 904, the gaming controller 12 receives a signal from the player to initiate the skill contest game 170 and accesses the music data file 174 (shown in FIG. 37) associated with the player selected music soundtrack. In addition, the gaming controller 12 accesses the skill contest game triggering data file 188 to determine the credit award ratio and the range of bonus credits associated with the triggering event 190 detected in the primary skill-based wagering game 22.

In method step 906, the gaming controller 12 randomly determines whether a progressive award 172 will be provided to the player upon the completion of the skill contest game 170. For example, in one embodiment, the gaming controller 12 may access a progressive award data files 198 stored in the data to determine whether a progressive award is provided to the player. The progressive award data files 198 include information including, but not limited to, progressive award reset values, award increment rates, and award trigger cycles. In the illustrated embodiment, the gaming controller 12 accesses the progressive award data files 198 and randomly determines a progressive award being provided to the player based on the progressive award trigger cycles included in the progressive award data files 198.

In method step 908, the gaming controller 12 initiates a round of the skill contest game 170. In the illustrated embodiment, during a round of the skill contest game, the player accumulates points based on the timing of touch operations performed by the player during the displayed skill events 90. Upon initiating the skill contest game 170, the gaming controller 12 is programmed to accesses the music data file 174 (shown in FIG. 37) associated with the player selected music soundtrack, determine a number of skill events 90 associated with the selected music data file 174, and determine the sequential display pattern to be generated during the skill contest game. For example, in one embodiment, the gaming controller 12 access display pattern data 180 (shown in FIG. 40) associated with the selected music soundtrack, randomly selects a display pattern 182 for use in the skill contest game 170, and generates timing chart data records 88 using the randomly selected display pattern 182.

Figure 61:
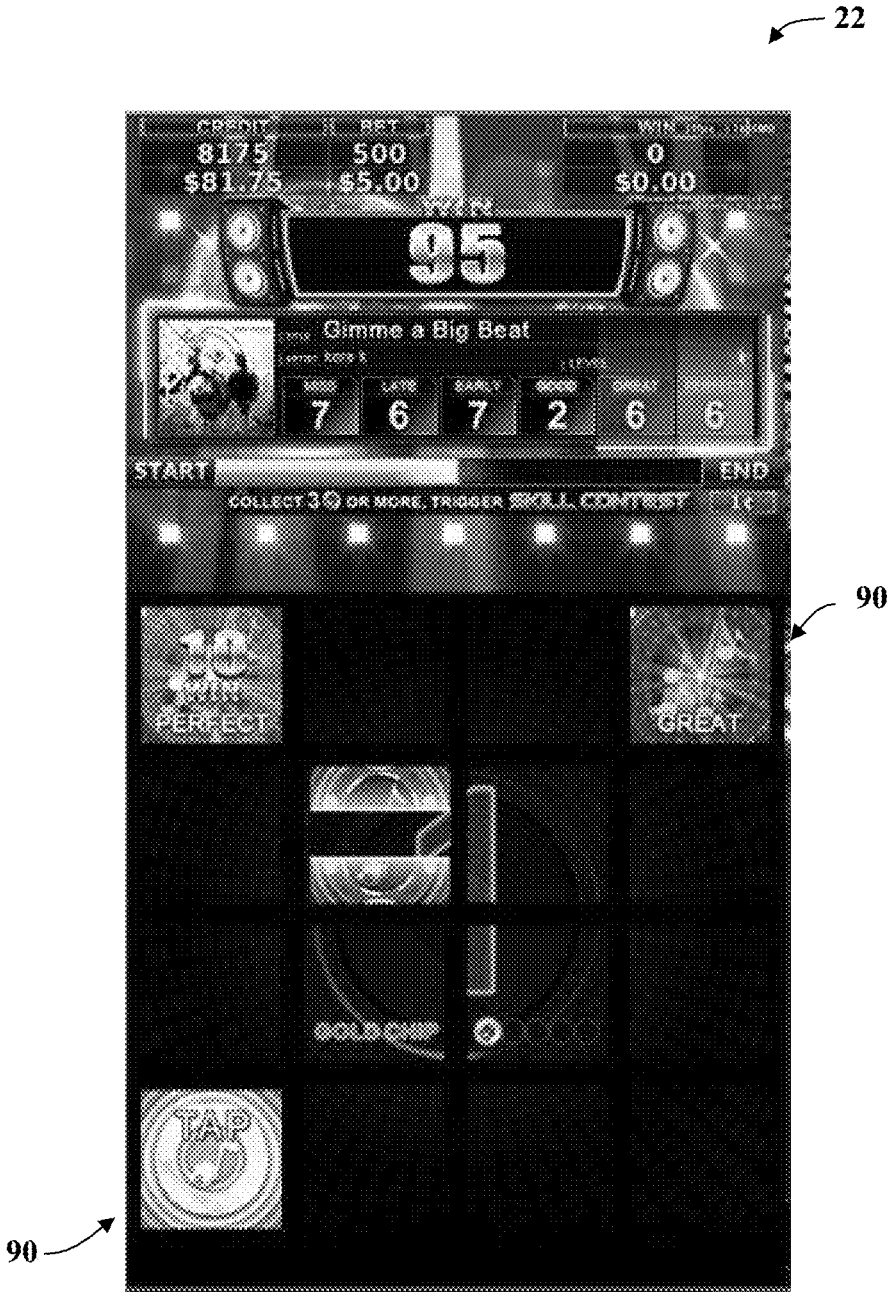
FIGS. 61-63 are exemplary entertaining graphical displays of a game screen including a primary skill-based wagering game that may be displayed on the gaming machine shown in FIG. 1, according to an embodiment of the present invention.
Figure 62:
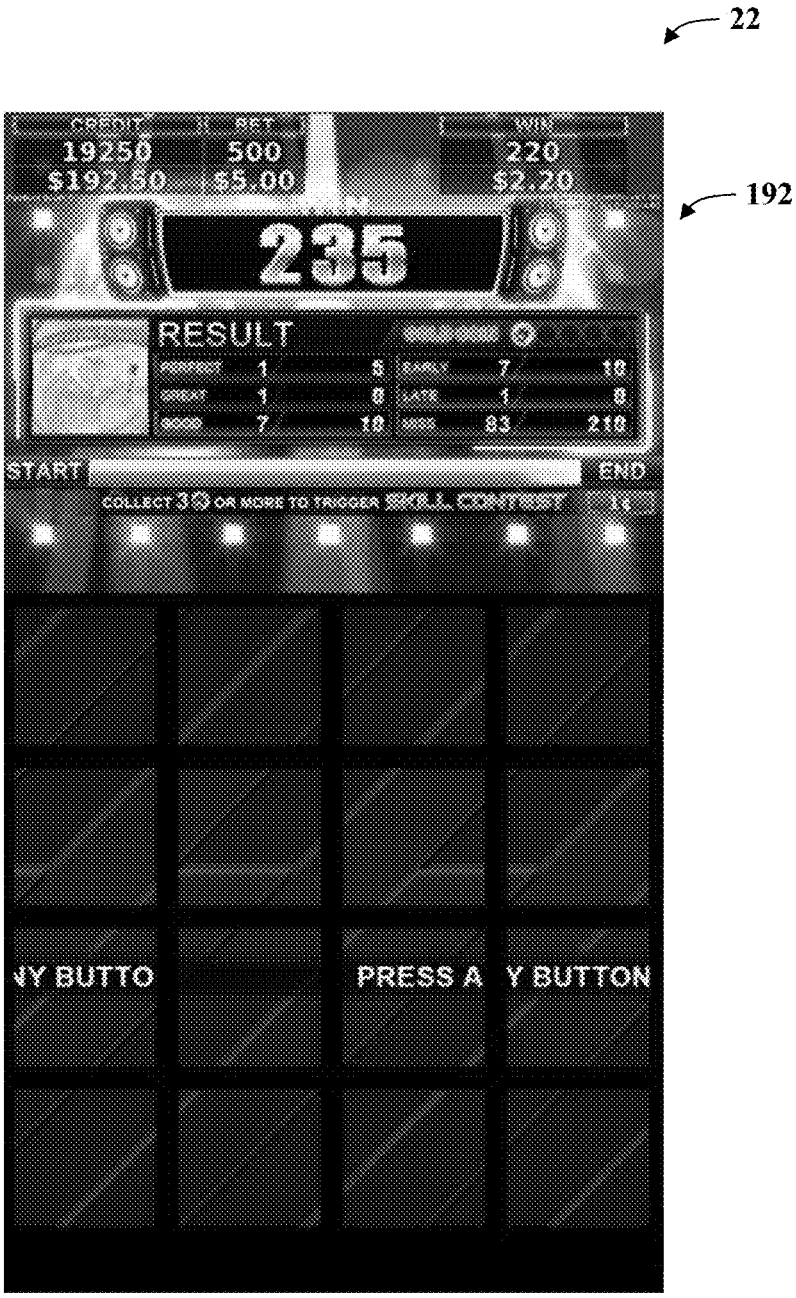
Figure 63:
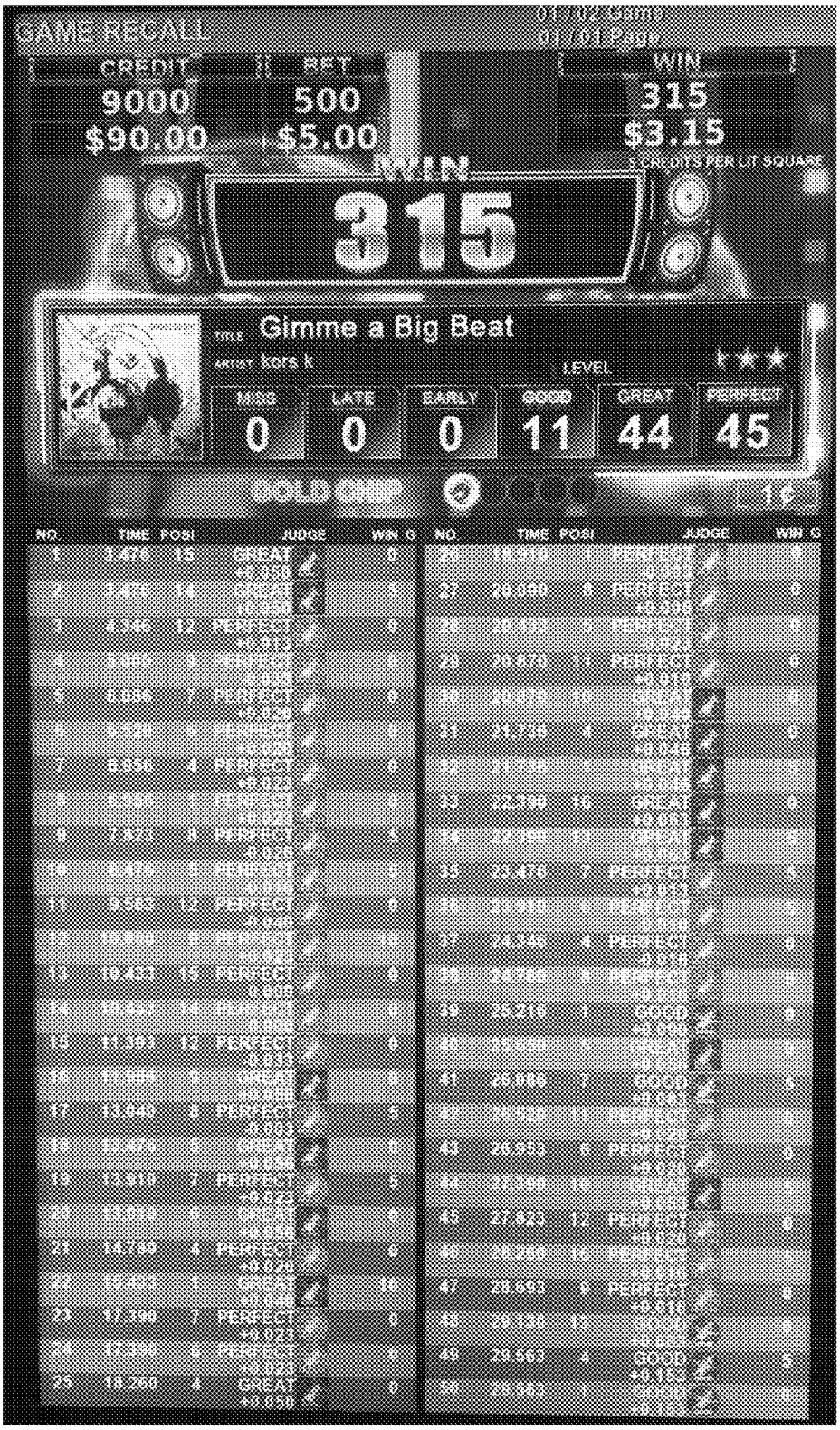

In the illustrated embodiment, for each skill event 90, the gaming controller 12 displays the skill event marker 90 on a predefined touch button positon based on the sequence data included in the selected a display pattern 182 and the selected music soundtrack. As shown in FIGS. 19, 45 and 61, the gaming controller 12 displays the skill event marker 90 with a plurality of sequential images associated with a corresponding sequential image record 114, with each sequential image associated with a corresponding operation timing period 98. In the illustrated embodiment, the gaming controller 12 displays the skill event marker 90 using the sequential image record 114 and detects a touch operation of the player using the corresponding touch button 46.

Upon detecting the touch operation associated with the corresponding touch button 46, the gaming machine proceeds to implement method step 910. In the illustrated embodiment, in method step 910, upon detecting the touch operation from the player, the gaming controller 12 is programmed to determine a player's skill level associated with the timing of the detected touch operation. For example, the gaming controller 12 detects the timing of the player's touch operation, determines the operation timing period 98 associated with the timing of the detected touch operation, and assigns a skill value 100 to the player's touch operation based on the corresponding operation timing period 98.

Upon determining the skill value 100 associated with the player's detected touch operation, the gaming controller 12 accesses a base point data file 600 (shown in FIG. 50) stored in the data and determines an amount of base points 602 associated with the determined skill value 100. The gaming controller 12 may also generate skill game result data 604 (shown in FIG. 52) including an accumulated amount of base points associated with the skill contest game, and increment a count of the corresponding achieved skill level 100. In one embodiment, the gaming controller 12 tracks the skill levels achieved from each skill event marker 90 in skill game result data 604 and displays a running count of achieved skill levels 100 to the player during the skill contest game 170. If a touch operation is not detected during the operation timing period 98, the gaming controller 12 is programmed to assign a predefined minimum amount of base points to the skill event 100 and increments a "Miss" counter in the skill game result data 604.

Upon determining the skill value 100 associated with the player's detected touch operation and the corresponding amount of base points 602 associated with the determined skill value 100, the gaming controller 12 determines an accumulated amount of base points 602 that have been achieved by the player and generates a normalized skill game point value 606 (shown in FIG. 53) based on the accumulated base points. The normalized skill game point value 606 is determined based on the number of skill events included in the skill game contest and a maximum amount of base points available for each skill event.

In the illustrated embodiment, the gaming controller 12 is programmed to determine a normalized skill game point value 606 based on a reference point total and the accumulated number of base points. For example, as shown in FIG. 51, the gaming controller 12 is programmed to generate reference point data 608 including determining a reference point total 610 as a function of the number of skill events 90 included in the skill contest game and the amount of base points associated with a high skill level value 108. In one embodiment, the gaming controller 12 is programmed to calculate the reference point total 610 using the following Equation (1): No. of Reference Points=Number of Skill Event Markers×Base Points for High Skill Level. The Number of Skill Event Markers is equal to the number of skill event markers 90 included with the selected music data file 174. The Base Points for High Skill Level is equal to the amount of base points 602 associated with a high skill level value 108 included in the base point data file 600. For example, in reference to FIG. 51, a skill contest game including 300 skill event markers, and 10 base points assigned to the high skill level results in 3,000 reference points (i.e. 300×10=3000). The reference point is calculated based on perfect's points and number of lit squares of music piece. All "perfect" score becomes the top score by this calculation.

The gaming controller 12 also generates normalized point data 612 (shown in FIG. 53) that includes a calculated normalized skill game point value 606 using the following Equation (2): Normalized skill game point value=(Accumulated Amount of Base Points×Maximum Skill Game Point Value Score)/Reference Points. The Accumulate Amount of Based Points is equal to the amount of accumulated base points included in the skill game result data 604. The Maximum Skill Game Point Value Score is equal to a predefined maximum score available for the skill contest game. The Reference Points is equal to the amount of reference points 610 included in the reference point data 608 and determined using Equation (1). For example, a skill contest game including a predefined maximum score equal to 100,000 points, 3,000 reference points, and an accumulate base points of 2391 results in a normalized skill game point value equal to 79,700 points (i.e. (2391*100000)/3000=79,700). The earned score is normalized as the upper value Top Score is 100,000 points In the illustrated embodiment, upon determining that the last skill event marker 90 has been displayed, the gaming controller 12 calculates a total amount of base points achieved by the player and calculates a normalized skill game point total based on the total amount of base points and the reference point total. The gaming controller 12 may also determine the credit award ratio included in the corresponding the skill contest game triggering data file 188 and determine a credit award to be provided to the player as a function of the normalized skill game point total 606 and the credit award ratio. For example, as shown in FIG. 49, the credit award ratio may include a predefined ratio of gaming credits to normalized skill game points. The gaming controller 12 determines an amount of gaming credits award to the player by multiplying the normalized skill game point total by the predefined ratio of gaming credits to normalized skill game points. For example, if the skill contest game 170 was triggered with the appearance of three gold coins in the primary skill-based wagering game 22, the gaming controller 12 may select a credit award ratio equal to 1 credit=100 points, and determine a credit award equal to the normalized skill game points multiplied by the credit award ratio 1/100. For example, if the normalized skill game point value is equal to 79,700 points, the gaming controller 12 determines the credit award to be equal to 797 credits (i.e. 79,700*(1/100)=797). In one embodiment, the credit award may also be multiplied by the total credits wagered in the primary skill-based wagering game 22.

Figure 64:
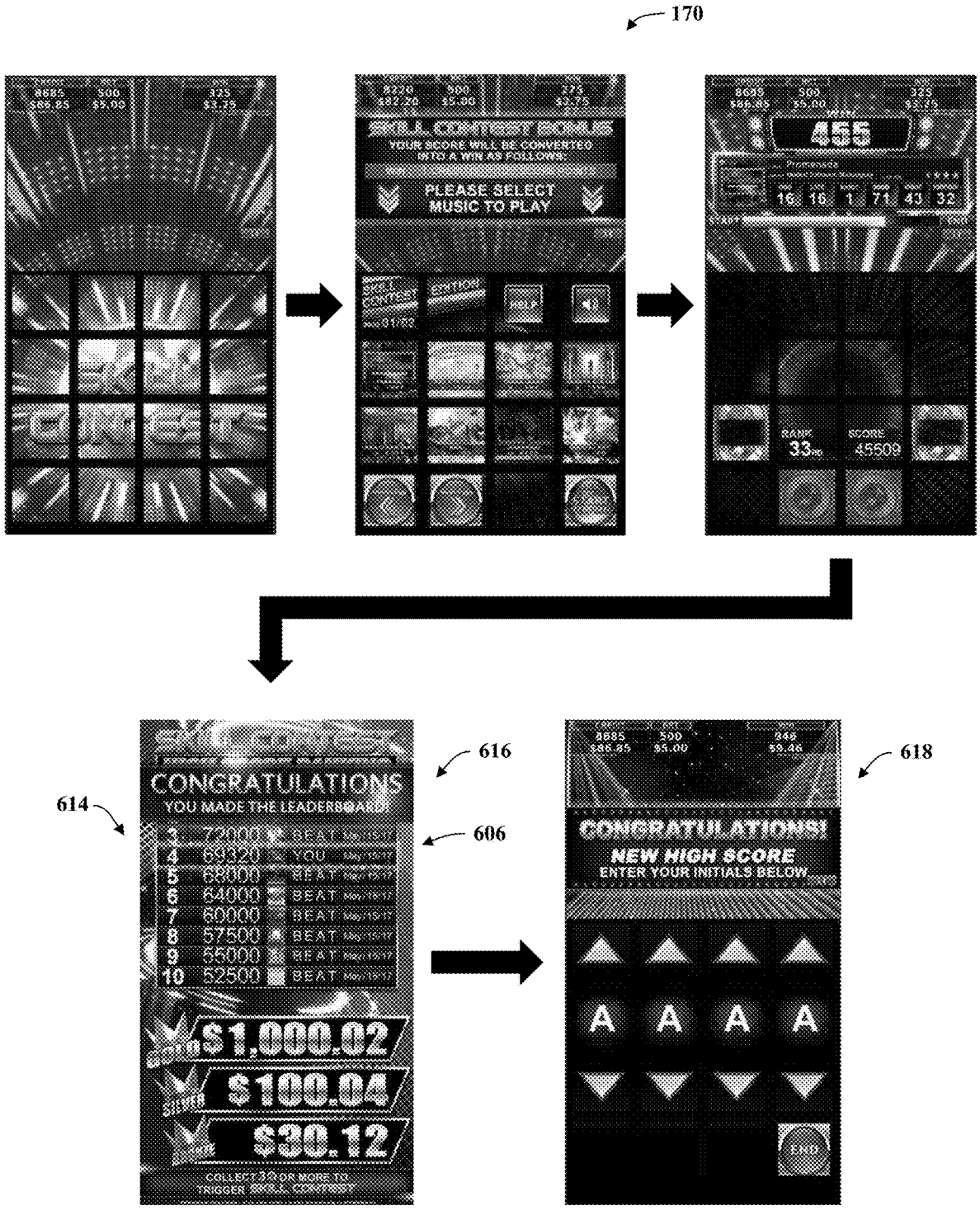
FIG. 64 illustrates a sequence of exemplary entertaining graphical displays of a game screen including a skill contest game that may be displayed on the gaming machine shown in FIG. 1, according to an embodiment of the present invention.
Figure 65:
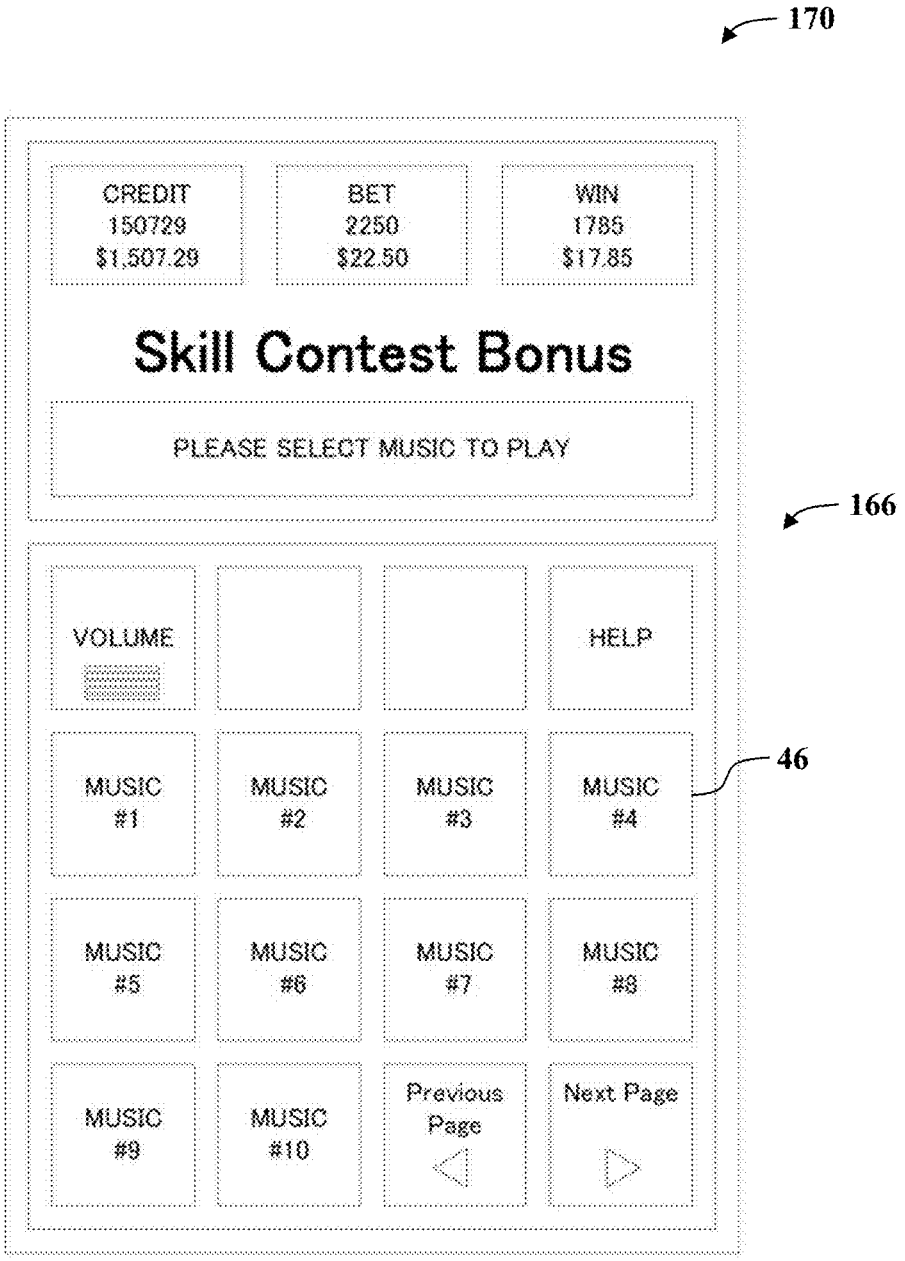
FIGS. 65-68 are illustrations of graphical displays of a game screen including a skill contest game that may be displayed on the gaming machine shown in FIG. 1, according to an embodiment of the present invention.
Figure 66:
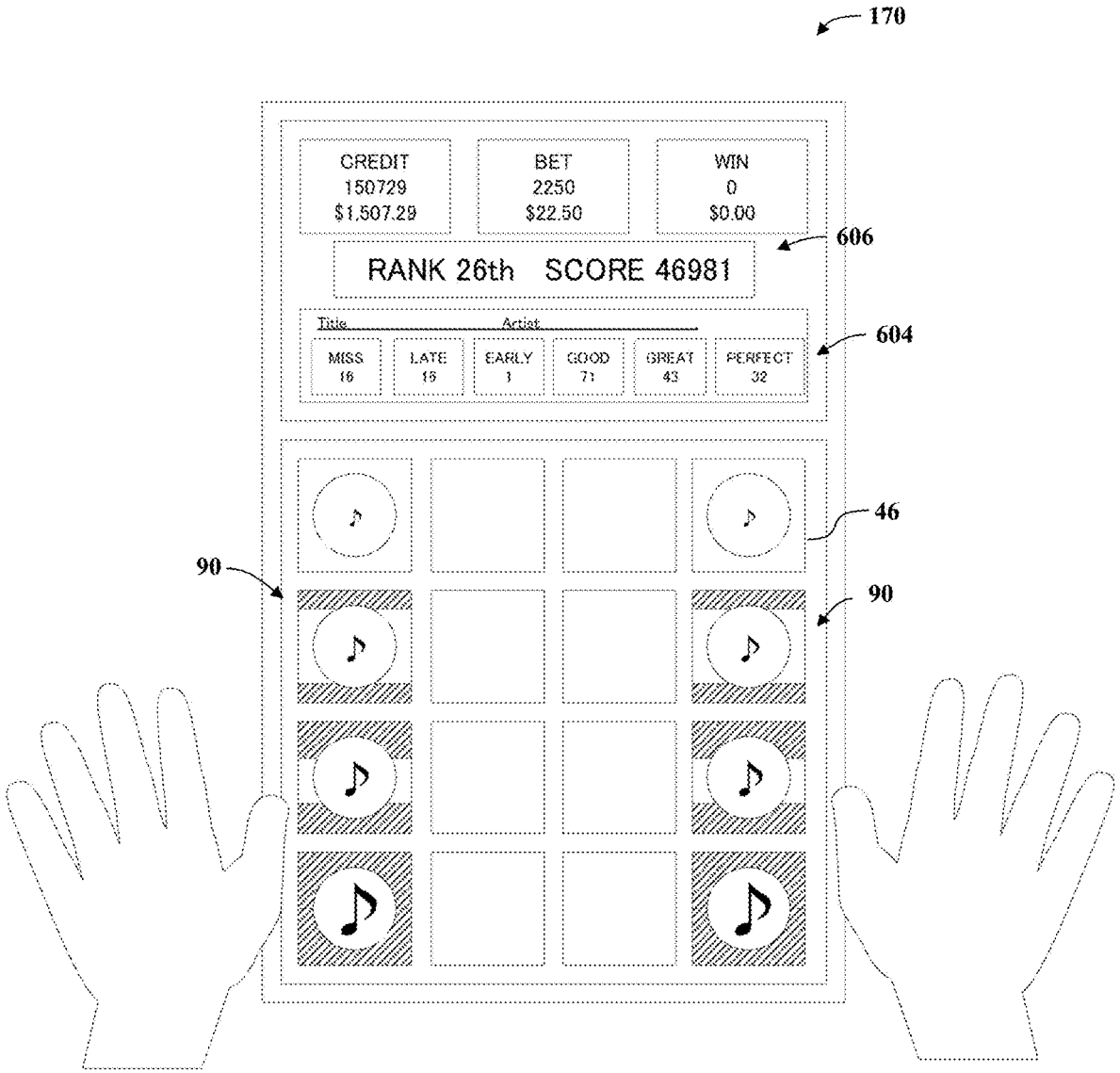
Figure 67:
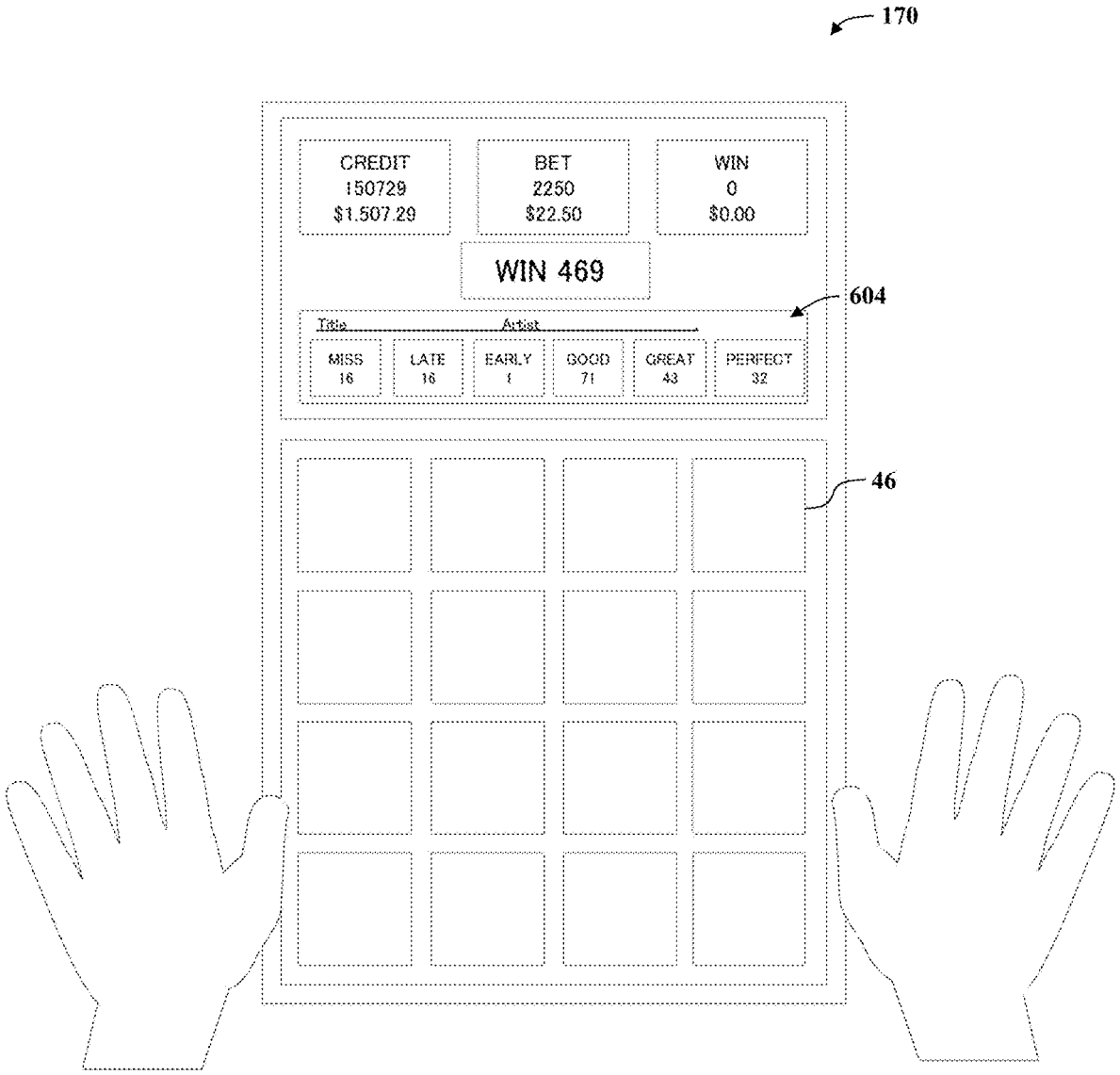

In one embodiment, the gaming controller 12 may also maintain a ranked list 614 of previous normalized skill game point total achieved during previous skill contest games, and display the ranked list 614 on a leaderboard screen 616 (shown in FIG. 64). If the earned score which player played the skill contest bonus game ranked in top 10 of the leaderboard. The players can entry their name on the leaderboard. Each high score entry can record up to a four character string. The character set is A-Z, SPACE, "-" and ".". The default string will be "AAAA" initially. The gaming controller 12 may compare the current player's normalized score achieved during the skill contest game against the ranked list 614 displayed on the leaderboard screen 616. Upon determining that the current player's normalized score falls within the current ranked list 614, the gaming controller 12 displays a player initials screen 618 and prompts the player to enter player initials on the player initials screen 618, and records the player initials in the player score record and adjusts the ranked list 614 to display the player initials and corresponding player normalized score.

In method step 912, the gaming controller 12 randomly determines whether the progressive award 172 will be provided to the player upon the completion of the skill contest game 170. The gaming machine 10 implements a 3 level progressive jackpots, Gold Crown Jackpot, Silver Crown Jackpot and Bronze Crown Jackpot. A jackpot may trigger after skill contest bonus game. The last lit square appears during skill contest bonus game. After that, a jackpot symbol (Gold crown, Silver crown or Bronze crown) may appear on the play button unit. If that appears, player wins the jackpot.

Figure 59:
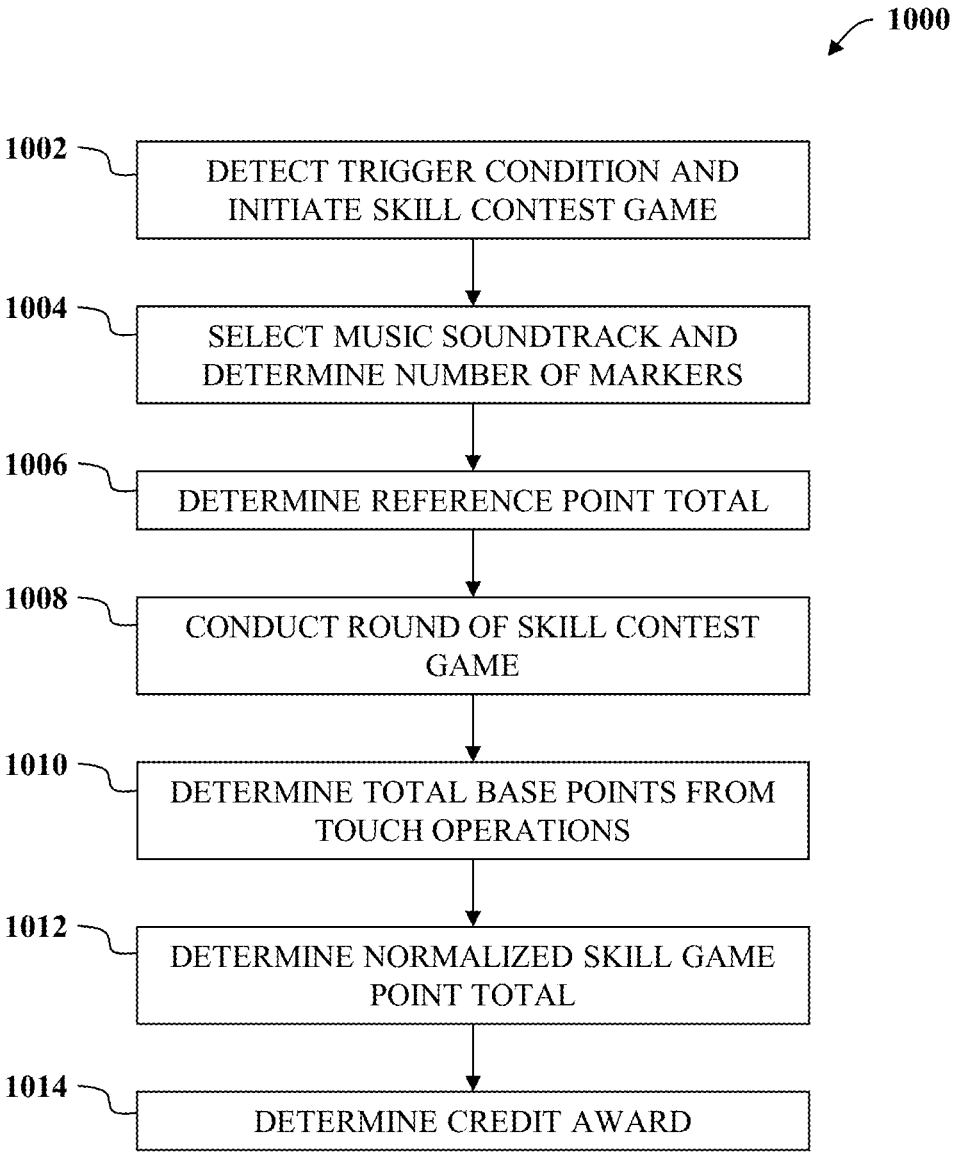
Figure 60:
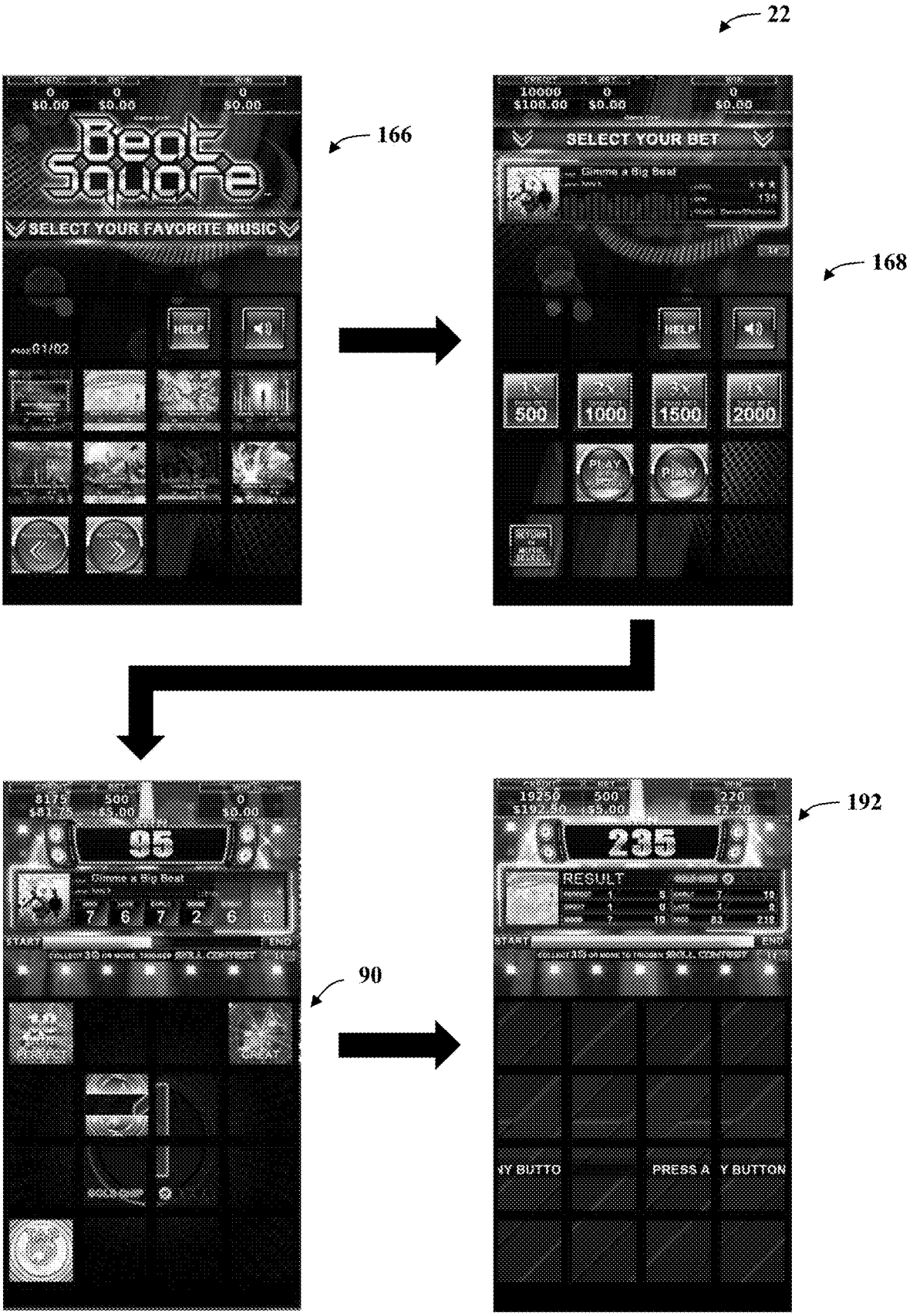
FIG. 60 illustrates a sequence of exemplary entertaining graphical displays of a game screen including a primary skill-based wagering game that may be displayed on the gaming machine shown in FIG. 1, according to an embodiment of the present invention.

FIG. 59 is flowchart of another method 1000 that may be used to operate the gaming machine 10 to provide a skill contest game to a player. Portions of the method may be performed by any one of, or any combination of, the components of one or more gaming machines 10.

In the illustrated embodiment, in method step 1002, the gaming controller 12 is programed to detect the occurrence of a trigger event occurring in the primary skill-based wagering game and initiate a skill contest game. For example, in one embodiment, the gaming controller 12 is programmed to initiate a primary skill-based wagering game upon receiving the wager from the player, randomly determine if a trigger condition occurs with the primary skill-based wagering game, and initiate the skill contest game upon detecting the occurrence of the trigger condition.

In method step 1004, the gaming controller 12 selects a music soundtrack for use during the skill contest game, accesses the music data file 174 associated with the selected music soundtrack, and determines a number of skill event markers 90 associated with the selected music soundtrack. For example, in one embodiment, the data may include a plurality of music data files. Each music data file is associated with a musical soundtrack and includes a predefined number of skill events and a timing record including a predefined sequential display pattern. The gaming controller 12 is programmed to receive a player's selection of the musical soundtrack, select a music data file associated with the selected musical soundtrack, and determine the number of skill events associated with the selected musical soundtrack.

In method step 1006, the gaming controller 12 determines a reference point total associated with the selected music track. For example, in one embodiment, the gaming controller 12 determines a number of skill events being included in the skill contest game and determines a reference point total as a function of the number of skill events. In addition, the gaming controller 12 may be programmed to determine the reference point total as a function of the number of skill events associated with the selected musical soundtrack and a maximum base point amount associated with each skill event. For example, in one embodiment, the reference point total is a maximum total amount of base points associated with the skill contest game. The gaming controller 12 may access the base point data file 600 to determine the maximum amount of base points 602 awarded in a skill event, and calculating the reference point total by multiplying the number of skill events by the maximum amount of base points 602 awarded in a skill event.

In method step 1008, the gaming controller 12 conducts a round of the skill contest game 170 including displaying the skill events on the game screen in a sequential display pattern. For example, the gaming controller 12 may be programed to select a musical soundtrack associated with the skill contest game and synchronize the display of the skill events in the sequential display pattern with the selected musical soundtrack.

In method step 1010, the gaming controller 12 detects a player's touch operation associated with each displayed skill event marker 90 and determines a total amount of base points as a function of the detected touch operations. For example, in one embodiment, the gaming controller 12 is programmed to display each skill event including an event time period having a plurality of consecutive operation timing periods. Each operating timing period is associated with a predefined base point amount. For each skill event, the gaming controller 12 determines a consecutive operation timing period associated with the player touch operation, and determines a number of base points acquired during the skill event by determining the predefined base point amount associated with the determined consecutive operation timing period associated with the player touch operation. The gaming controller 12 then calculates the total amount of base points as the sum of the number of base points acquired for each skill event.

In method step 1012, the gaming controller 12 determines a normalized skill game point total as a function of the total amount of base points achieved by the player. For example, in one embodiment, the gaming controller 12 detects a player touch operation associated with each skill event, determines a total amount of base points associated with the detected player touch operations, and determines a normalized skill game point total based on the total amount of base points and the reference point total. The gaming controller 12 may also calculate the normalized skill game point total by dividing the product of the total amount of base points and a predefined maximum skill game point total by the reference point total.

In method step 1014, the gaming controller 12 determines as credit award as a function of the normalized skill game point total. For example, in one embodiment, the gaming controller 12 may be programmed to determine a ratio of gaming credits to skill game points, and calculate the amount of gaming credits included in the award by multiplying the normalized skill game point total by the ratio of gaming credits to skill game points.

In one embodiment, the skill-based wagering game 22 and/or the skill contest game 170 may also be provided via a gaming server that includes a gaming controller 12 to a plurality of player devices. For example, the player devices could be personal computer, tablet, mobile device or mobile phone. The primary game could be played via a computer program application or app running on the player device or accessed via a website running on the world-wide web (WWW). In one embodiment, the skill-based wagering game 22 and/or the skill contest game 170 may be provided by the computer program application or app. The game server is in communication with the player devices to track game play, provide access to a player account (including funds used to make wagers), and to track wagers and wins (awards). In another embodiment, the skill-based wagering game 22 and/or the skill contest game 170 may be provided via the gaming server. In other words, the game server may run an instance of a program application to provide the skill-based wagering game 22 and/or the skill contest game 170 for each (active) player device. The outcome(s) of the game are communicated to the player device, on which the outcome is displayed.

Figure 69:
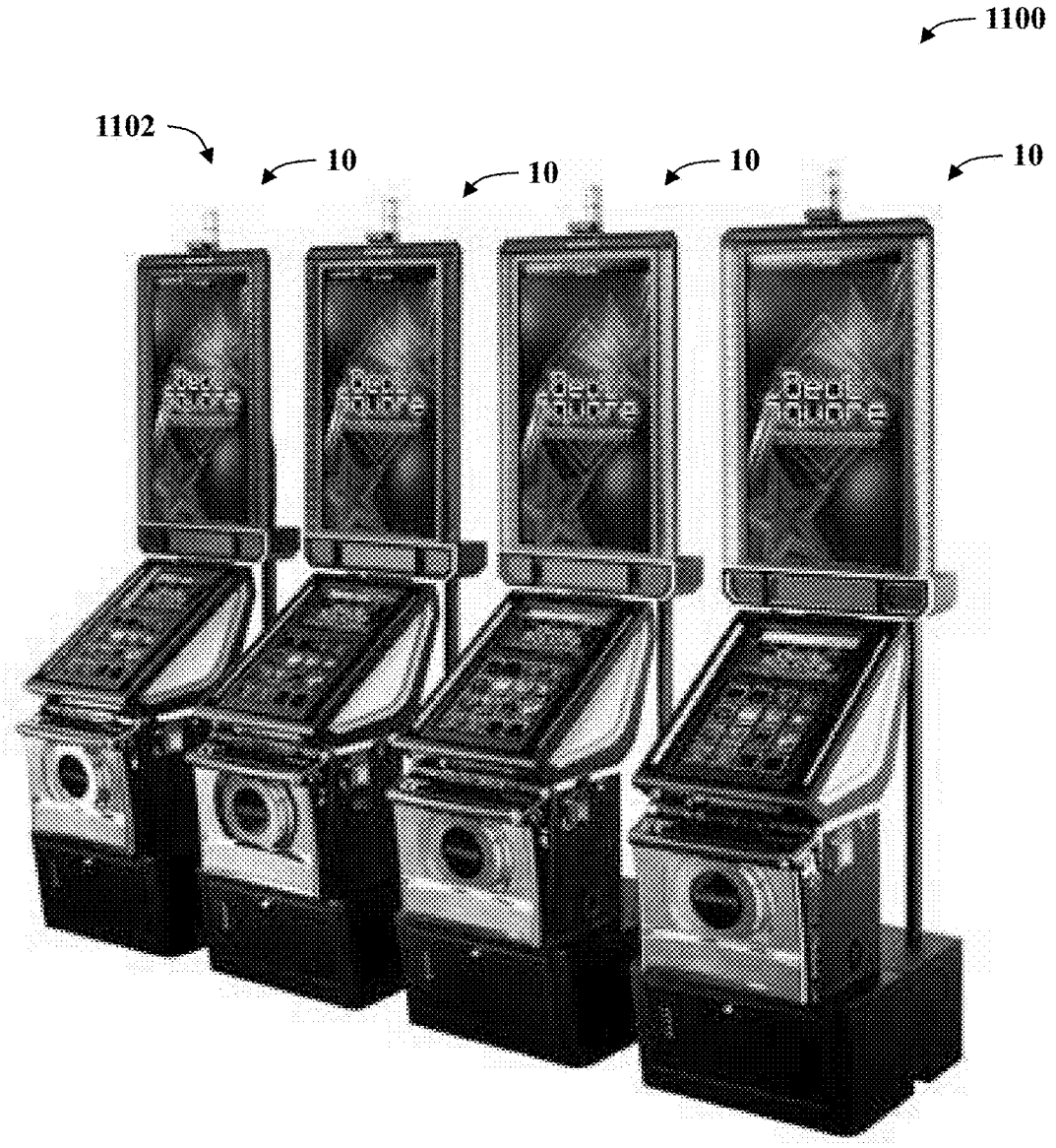
FIG. 69 is a perspective view of an exemplary gaming system for use in providing a tournament skill game to players, according to an embodiment of the present invention.
Figure 70:
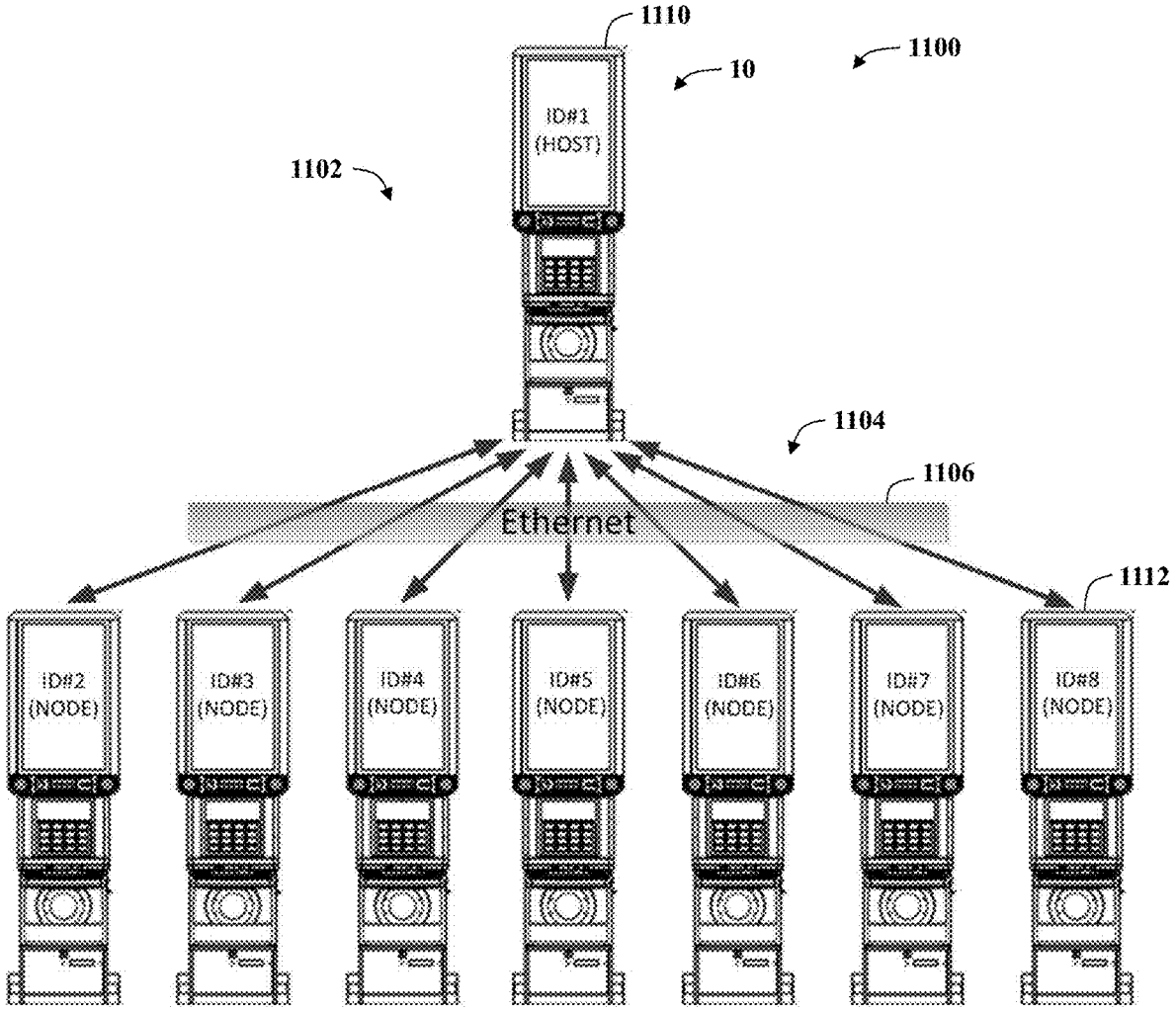
FIGS. 70-72 are schematic illustrations of the gaming system shown in FIG. 69.
Figure 71:
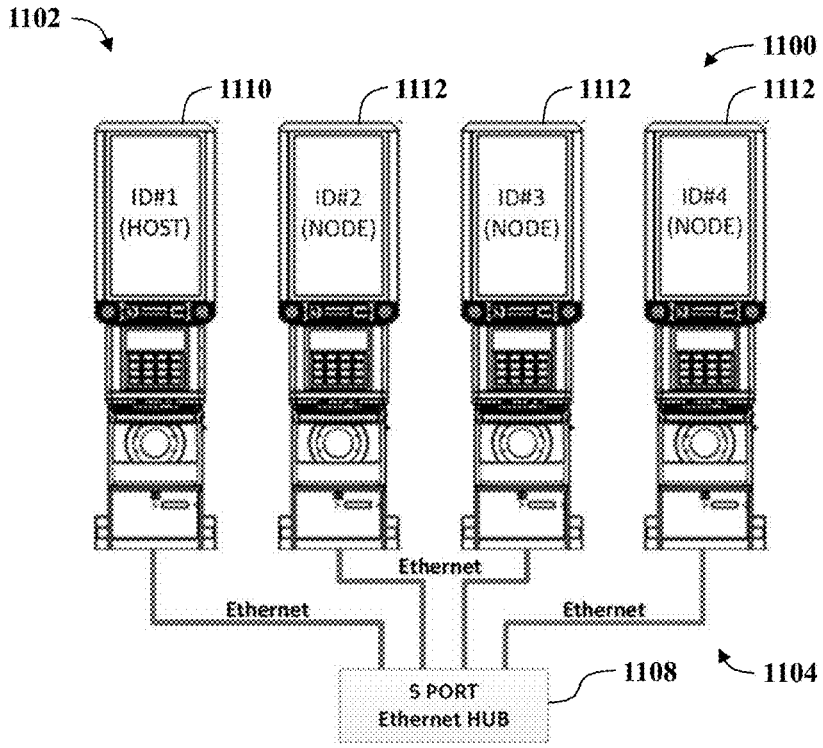
Figure 72:
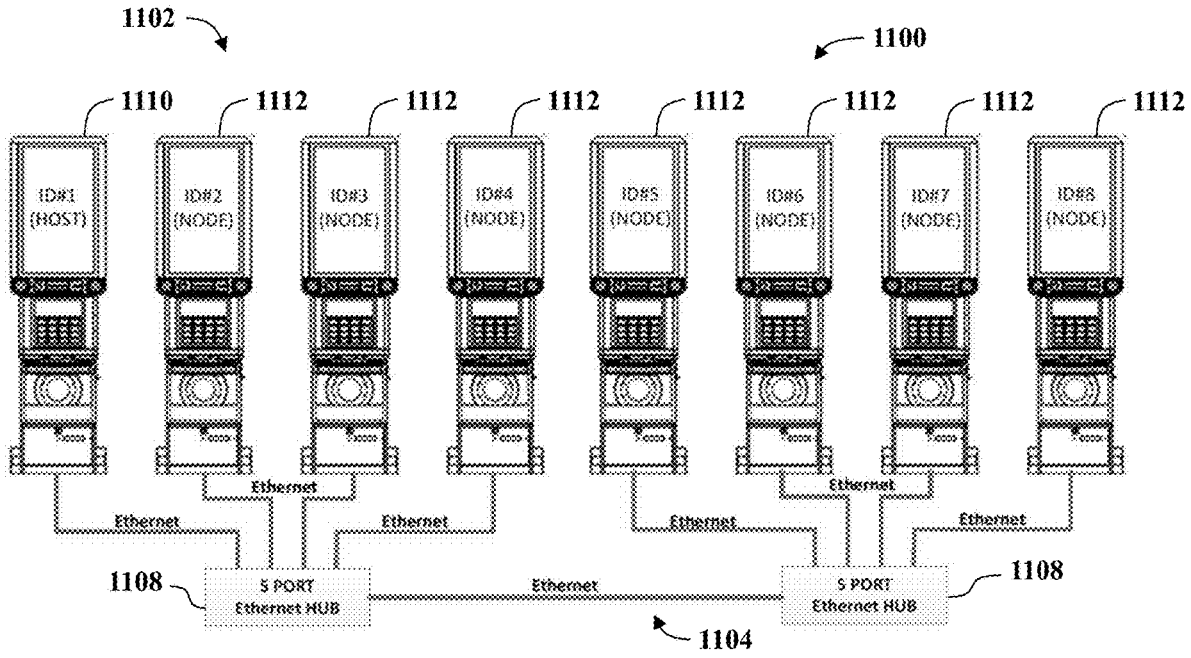

FIGS. 69 and 70 are schematic views of gaming system 1100 that may be used to provide a tournament skill game to players. In the illustrated embodiment, the gaming system 1100 includes bank 1102 of electronic gaming machines (EGM) 10 including a plurality of gaming machines 10 that are connected together via a communications network 1104. In one embodiment, the communications network 1104 includes an Ethernet network 1106. For example, as shown in FIGS. 71 and 72, in one embodiment, the gaming system 1100 may include one or more multi-port Ethernet hubs 1108.

In the illustrated embodiment, the gaming controller 12 (shown in FIGS. 7 and 87) of each of the gaming machines 10 is programmed to operate in a tournament mode to simultaneously provide a tournament skill contest game at each of the gaming machines 10. When operating in the tournament mode, the gaming system 1100 includes one gaming machine 10 of the bank 1102 of gaming machines 10 operating as a host gaming machine 1110 and the remaining gaming machines 10 operating as node gaming machines 1112. The host gaming machine 1110 is programmed to transmit and receive instructions from each of the node gaming machines 1112 to enable each of the gaming machines 10 to simultaneously display a tournament skill contest game 1114 (shown in FIG. 83). In one embodiment, the tournament skill contest game 1114 includes the skill contest game 170 (shown in FIGS. 64-68). In another embodiment, the tournament skill contest game 1114 includes the skill-based wagering game 22 (shown in FIGS. 15-16 and 60-63).

Each node gaming machine 1112 receives instructions to execute the tournament skill contest game 1114 from the host gaming machine 1110. The host gaming machine communicates with each node gaming machine 1112 via the Ethernet network 1106. Upon receiving instructions from the host gaming machine 1110, the gaming controller 12 of each node gaming machines 1112 executes a game program stored on the node gaming machines 1112. In addition, the host gaming machine 1110 also executes a game program stored on the host gaming machine 1110 such that the tournament skill contest game 1114 is simultaneously executed on the host gaming machine 1110 and the node gaming machines 1112. In one embodiment, the gaming controller 12 of each gaming machine 10 includes an extended Ethernet port of Windows controller used for communication between a Host EGM and Nodes EGMs. A LAN module is inserted to Mini-PCI connector on the main PC board. An Ethernet cable is hooked up to LAN Windows connector on the PC board.

In the illustrated embodiment, the host gaming machine 1110 is programmed to display a plurality of tournament set-up screens 1116 (shown in FIGS. 78-82) to enable an operator to select operating parameters associated with the tournament skill game 1114. For example, in one embodiment, the host gaming machine 1110 allows an operated to identify a number of players and/or gaming machines 10 participating in the tournament skill game 1114, identify a number of rounds of the tournament skill game 1114, a number of music soundtracks included in tournament skill game 1114, and/or identify one or more gaming machines 10 that may be used to select a music soundtrack for use during the tournament skill game 1114.

In one embodiment, the gaming controller 12 of the host gaming machine 1110 may be programmed to display a tournament selection screen 1118 (shown in FIG. 78) that includes a player setting button 1120, a music setting button 1122, and a tournament start button 1124, that are each selectable by an operator via corresponding touch buttons 46. For example, when the host gaming machine 1110 is transferred to the tournament mode from the normal game mode, the host gaming machine 1110 will display the tournament selection screen 1118 to enable the operator to set the number of players participating in the tournament skill game 1114 and the number of music pieces per round of completion.

Upon receiving a signal indicating a selection of the player setting button 1120, the host gaming machine 1110 displays a player setting screen 1126 (shown in FIGS. 79-81) to enable the operator to identify a number of players and/or a number of gaming machines 10 that are participating the tournament skill game 1114. In addition, the player setting screen 1126 allows the operator to select a tournament mode that will be used to execute the tournament skill game 1114. For example, in one embodiment, the host gaming machine 1110 is programmed to execute the tournament skill game 1114 in an individual competition mode and a team competition mode. In the individual competition mode, the host gaming machine 1110 monitors scoring from each participating gaming machine 10. For example, the winning player of the tournament skill game 1114 operated in the individual competition mode is determined by the total score of the individual. In the team competition mode, the host gaming machine 1110 assigns two or more gaming machines 10 to a team identifier, and aggregates the score of the corresponding gaming machines 10 to obtain an aggregate team score. For example, the winning players of the tournament skill game 1114 operated in the team competition mode is determined by the total score of the team members (e.g. 1 team by 2, 3, or 4 players).

Figure 80:
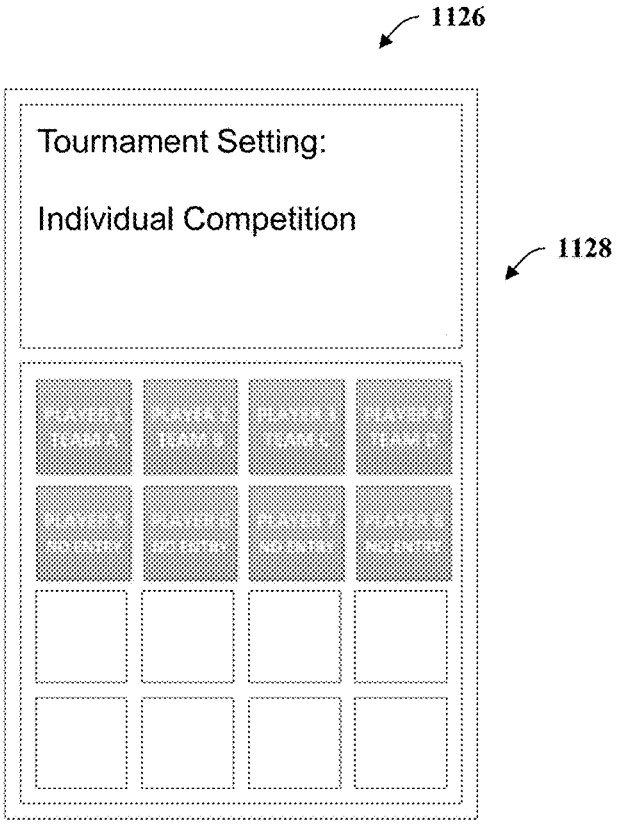

Referring to FIG. 80, in one embodiment, the host gaming machine 1110 is programmed to display an individual competition player setting screen 1128 that allows the operator to configure the tournament skill game 1114 in the individual competition mode. Using the individual competition player setting screen 1128, the host gaming machine 1110 allows the operator to select a number of players and/or gaming machines 10 that will participate in the tournament skill game 1114. In the illustrated embodiment, the host gaming machine 1110 receives the operator's selections of each gaming machine 10 that will participate in the tournament skill game 1114, and assigns a team identifier to each of the participating gaming machines 10. For example, as shown in FIG. 80 participating gaming machines 10 are assigned individual team identifiers, e.g. "TEAM A", "TEAM B", "TEAM C", and "TEAM D". The gaming machines 10 that are included in the bank 1102 of gaming machines 10 but are not participating in the tournament skill game 1114, are designated as "NO ENTRY". For example, as shown in FIG. 80, the gaming machine 10 associated with Player 1 is assigned to Team A, the gaming machine 10 associated with Player 2 is assigned Team B, the gaming machine 10 associated with Player 3 is assigned Team C, and the gaming machine 10 associated with Player 4 is assigned Team D.

Figure 81:
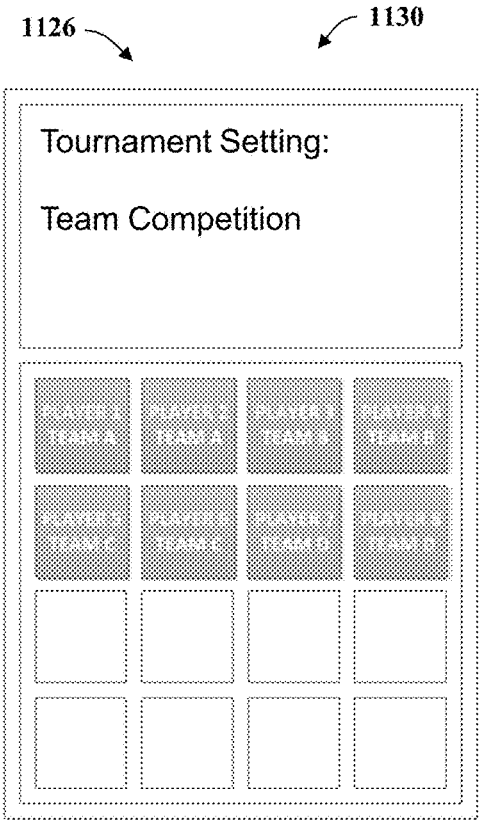

As shown in FIG. 81, in one embodiment, the host gaming machine 1110 is programmed to display a team competition player setting screen 1130 that allows the operator to configure the tournament skill game 1114 in the team competition mode. The team competition player setting screen 1130 allows the operator to assign two or more gaming machines 10 to a team identifier. For example, the gaming machines 10 associated with Players 1 and 2 are assigned Team A, the gaming machines associated with Players 3 and 4 are assigned Team B, the gaming machines 10 associated with Players 5 and 6 are assigned to Team C, and the gaming machines 10 associated with Players 7 and 8 are assigned Team D. In one embodiment, each team identifier is associated with a predefined color. Each gaming machines 10 may be programmed to operate the illumination lighting devices 44 to display the color associated with the selected team identifier.

In one embodiment, the host gaming machine 1110 is programmed to access a team data file 1132 (shown in FIG. 75) being stored in the data and generate a EGM identification file 1134 (shown in FIGS. 76-77) based on the information included in the team data file 1132 and selections being made by the operator via the player setting screens 1128 and 1130. The team data file 1132 data includes information associated with a plurality of team identifiers such as, for example, a cabinet color and team assignment identifier. In one embodiment, each gaming machine 10 includes a unique identifier, e.g. a cabinet number. Upon receiving operator selections via the individual competition player setting screen 1128, the host gaming machine 1110 may generate an individual competition EGM identification file 1136 that includes a single team identifier assigned to each of the participating gaming machines 10. Moreover, upon receiving operator selections via the team competition player setting screen 1130, the host gaming machine 1110 may generate a team competition EGM identification file 1138 that includes two or more participating gaming machines 10 assigned to each team identifier. The host gaming machine 1110 may then transmit the EGM identification file 1134 to each participating gaming machine 10 for use in executing the tournament skill game 1114.

Figure 82:
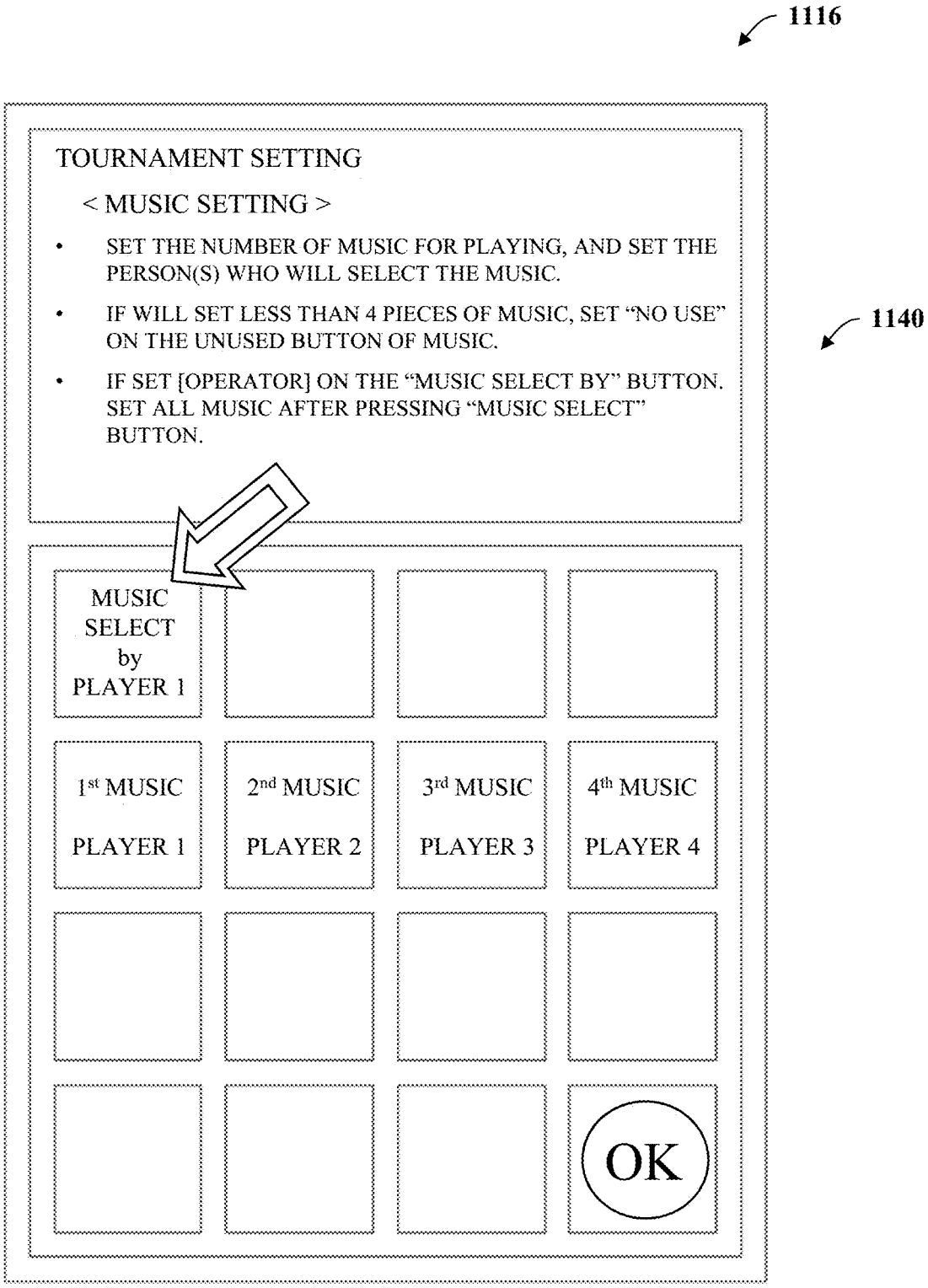

Referring to FIG. 82, in one embodiment, the host gaming machine 1110 is programmed to display a music setting screen 1140 upon receiving an operator's selection of the music setting button 1122 via the tournament selection screen 1118. The host gaming machine 1110 allows the operator to identify whether a player selection setting is set and the players will select the music soundtracks used during the tournament skill game 1114 or whether an operator selection setting is set and the operator will select the music soundtracks using the host gaming machine 1110. If the operator designates the players will select the music soundtracks, the host gaming machine 1110 prompts the operator to identify the number of soundtracks to be used during the tournament skill game 1114 and to identify the gaming machines 10 and/or players who can select the music soundtracks. In addition, if the operator designates that the operator will select the music soundtracks, the host gaming machine 1110 will prompt the operator to select a number of music soundtracks to be included in the tournament skill game 1114.

Upon receiving a music selections via the music setting screen 1140 and the completion and player settings via the host gaming machine 1110 displays the tournament selection screen 1118 including a tournament start button 1124, to prompt the operator to initiate the tournament skill game 1114 using the received settings.

Figure 83:
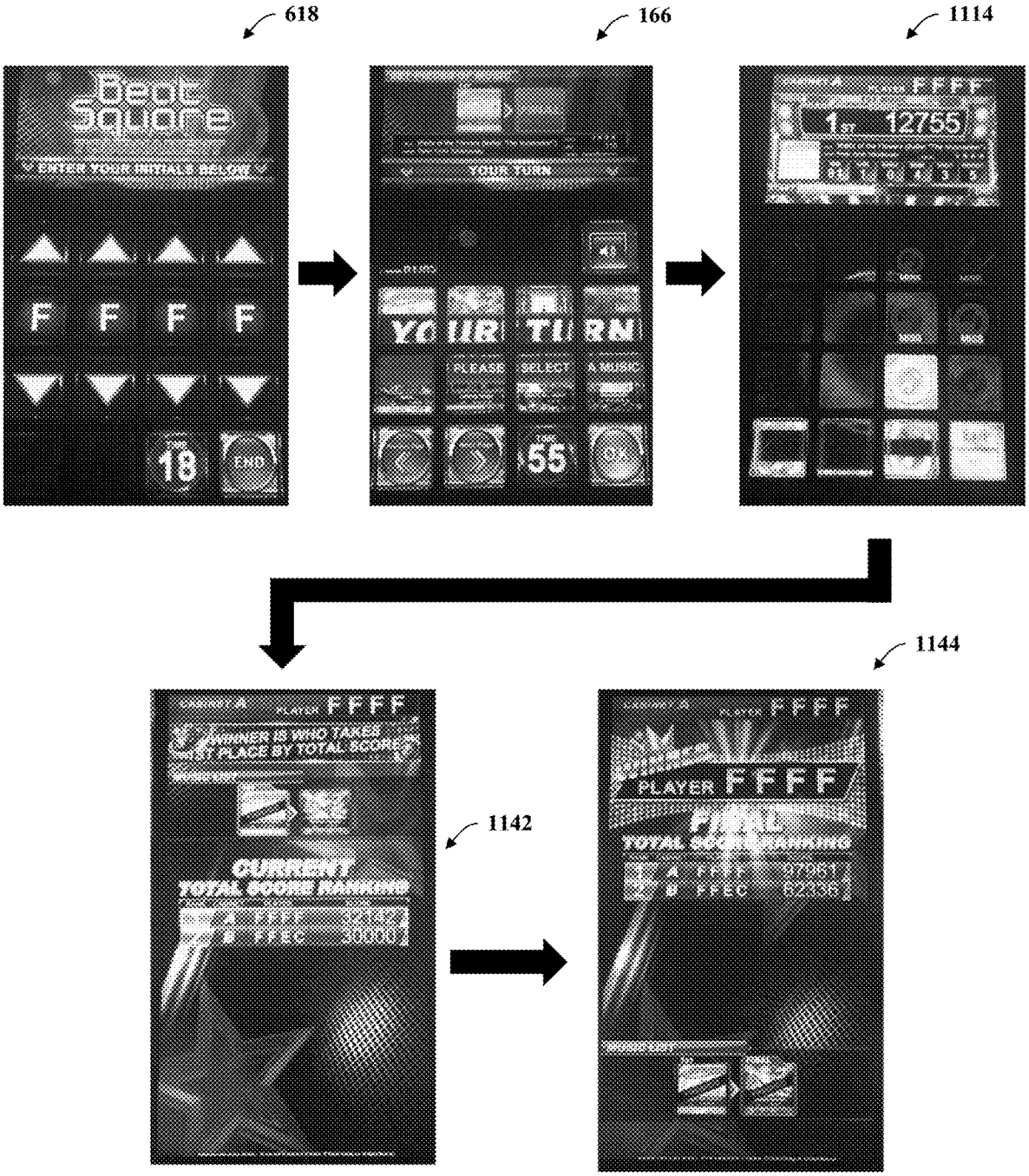
FIG. 83 illustrates a sequence of exemplary entertaining graphical displays of a game screen including the tournament skill game, according to an embodiment of the present invention.

Referring to FIG. 83, in the illustrated embodiment, upon receiving a signal indicating the operators selection of the tournament start button 1124, the host gaming machine 1110 transmits instructions to each participating gaming machine 10 to display the player initials screen 618 (also shown in FIG. 64) and prompts each player to enter player initials on the player initials screen 618. In one embodiment, the host gaming machine 1110 is also a participating gaming machine 10 and also displays the player initials screen 618 to prompt a player to register their initials.

All players enroll their initials using the player initials screen 618. Each node gaming machine 1112 transmits signals indicating the player selected initials to the host gaming machine 1110. The host gaming machine 1110 registers the player selected initials and stores data indicating the player selected initials in the data as the signals are received from the node gaming machines 1112. If initials received from a node gaming machine 1112 are the same as initials already registered, the host gaming machine 1110 sends a signal to the node gaming machine 1112 to prompt the player to select different player initials.

Upon receiving the player selected initials from each participating gaming machines 10, the host gaming machine 1110 determines which players have been designated to select the music soundtracks, identified the gaming machines 10 associated with the designated players, and transmits instructions to the identified gaming machines 10 to display the music selection screen 166. Upon receiving the instructions from the host gaming machine 1110, each identified gaming machine 10, which may include the host gaming machine 1110, displays the music selection screen 166 to allow the corresponding player to select a music soundtrack for use in the tournament skill game 1114. Once the selections have been made, each of the identified gaming machines 10 transmit signals identifying the player selected music soundtracks to the host gaming machine 1110. For example, in a case of a player selection setting, the identified players will be prompted to select the music pieces. In a case of an operator selection setting, the host gaming machine 1110 will prompt the operator to select the music pieces. In one embodiment, if the operator selection setting has been made in the music setting screen 1140, the host gaming machine 1110 will prompt the operator to select the music soundtracks before the player initials screen 618 is displayed.

In the illustrated embodiment, upon receiving the selected music soundtracks from each identified gaming machine 10, the host gaming machine 1110 accesses the music data files 174 and determines a number of skill events 90 and a sequential display pattern 182 associated with the selected musical soundtracks, and transmits a data file to each participating node gaming machine 1112 indicating the selected musical soundtrack, the associated number of skill events, and the associated sequential display pattern. The host gaming machine 1110 then waits to receive a ready signal from each participating node gaming machine 1112.

Upon receiving a ready signal from each participating node gaming machine 1112, the host gaming machine 1110 then transmits an initiation signal to each participating node gaming machine 1112 that causes each participating node gaming machine 1112 to initiate the tournament skill game 1114 in coordination with the host gaming machine 1110, such the game play at each participating gaming machine 10 is conducted simultaneously. In the illustrated embodiment, the game play of the tournament skill game 1114 is the same as the skill contest game 170 described herein.

In the illustrated embodiment, the tournament skill game 1114 includes a plurality of game rounds. Each game round includes one of the selected music soundtracks. For example, if the operator designated four music pieces to be included in the tournament skill game 1114 via the music setting screen 1140, the host gaming machine 1110 will conduct the tournament skill game 1114 including four rounds of the game. During each round, all participating gaming machines 10 play the same music and notes pattern together. In one embodiment, the music soundtracks used are the same with the contest bonus game of the normal game. In addition, the player score calculation is the same method used during the skill contest game 170. For example, during the tournament skill game 1114, each gaming machine 10 is programmed to implement method 900 and/or method 1000 to conduct each round of the tournament skill game 1114 including displaying the skill events on the game screen in a sequential display pattern, detecting a player touch operation associated with each skill event, determining a total amount of base points associated with the detected player touch operations, and determining a normalized skill game point total based on the total amount of base points and the reference point total. In one embodiment, all music pieces included in the tournament skill game 1114 may include an upper score of 100,000 points and bottom score of 30,000 points.

After each round of the tournament skill game 1114, each node gaming machine 1112 calculates a normalized score and transmits the calculated normalized score to the host gaming machine 1110. The host gaming machine 1110 generates player rankings based on the received normalized scores. For example, the host gaming machine 1110 is programmed to generate a current score ranking for the current round of the game, and a total score ranking based on the current round and the previous game rounds. The host gaming machine 1110 then transmits the generated player rankings to each participating node gaming machine 1112. After finishing the play of each music piece, each participating gaming machine 10 displays an initial leaderboard screen 1142 that displays the ranking associated with the current music soundtrack on the top monitor, and then displays a current leaderboard screen 1144 including the current total score and ranking for each participating player. Game will repeat the phase 3 and 4 at an assigned number of music pieces. In case of team competition, the current total score will be displayed the sum of team members. After finished to play all music pieces, final total score will be displayed on the top monitor. The winner is a player or team who got a highest score on the final total score ranking.

In one embodiment, during the tournament skill game, if any lockout occurs on EGM, or EGM power down, the tournament of that time is invalid. After that, it will start over from the beginning. There is no "Game Recall" for tournament mode. EGM cannot accept a bill or ticket during the Tournament mode. EGM cannot cash out during the Tournament mode. EGM returns to the previous state before transaction to Tournament mode. EGM will record status for "start" tournament and "end" tournament as GAME EVENTS.

In one embodiment, a digital signage display might be added to the gaming machines 10. The digital signage display might have a display unit connected to a controller unit which communicates with the host gaming machine 1110. In this case, the host gaming machine communicates to the controller unit information of tournament configuration and progress of the game on each gaming machine 10. And the controller displays the information of tournament configuration and a leaderboard based on progress of the game at each gaming machines 10 on the display unit of the digital signage display. The digital signage display may help audiences of the tournament to see progress and result of the tournament.

The network topologies of the gaming machines 10 are not limited to above. In one embodiment, the gaming machines 10 might be connected to a host system different than the gaming machine 10. For example, the host system might be a personal computer or a server computer connected to each gaming machine 10. In this case, the personal computer or the server computer works as a host gaming machine 1110 and each gaming machine 10 works as a server gaming machine 1112.

Figure 73:
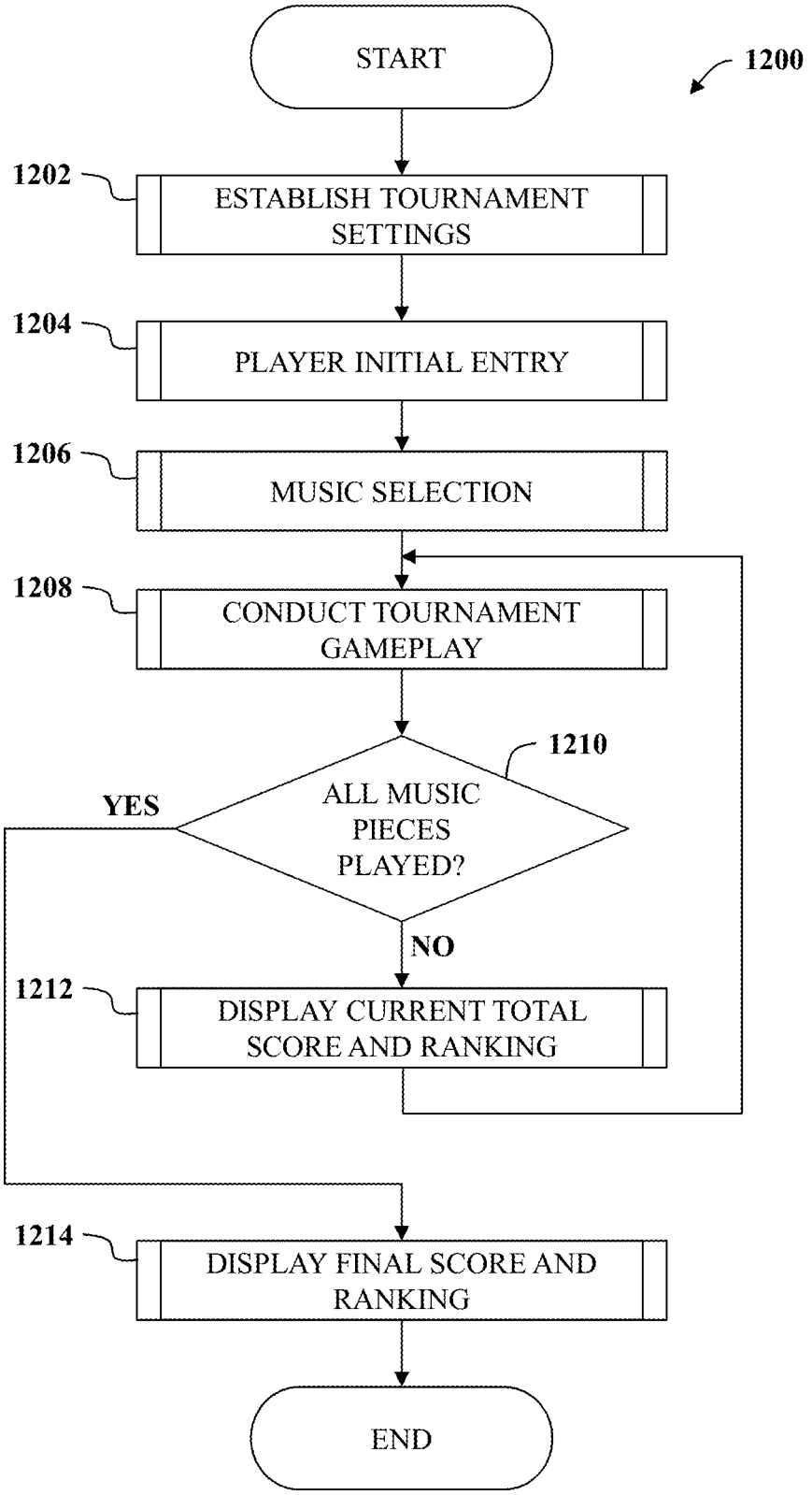
FIGS. 73-74 are flowcharts a methods that may be used with the gaming system shown in FIGS. 69-72 for providing a tournament skill game to players, according to an embodiment of the present invention.

FIG. 73 is flowchart of method 1200 that may be used to operate the gaming system 1100 to provide a tournament skill game using a plurality of networked gaming machine 10. Portions of the method may be performed by any one of, or any combination of, the components of one or more gaming machines 10.

In the illustrated embodiment, in method step 1202, the host gaming machine 1110 is programmed to establish the tournament settings. The host gaming machine 1110 displays the player setting screen 1126 to accept operator selections of tournament settings associated with the competition modes and the gaming machine player assignments. For example, the host EGM 1110 accepts a selection of 1) individual competition or 2) team competition. The host EGM 1110 accepts an allocation of each EGM to a team when team competition is selected. The host EGM 1110 assigns all EGMs to different team when individual competition is selected. The host gaming machine 1110 displays the music setting screen 1140 to accept operator selections of tournament settings associated with the music soundtracks used during the tournament skill game 1114. For example, the host EGM 1110 accepts the number of music pieces for a competition. The host EGM 1110 accepts a selection of 1) music selection by player or 2) music selection by operator. The host EGM 1110 accepts a selection of an EGM to accept music selection input when music selection by player is selected. The host EGM 1110 accepts operator's selections of music pieces when music selection by operator is selected.

In method step 1204, the host gaming machine 1110 initiates a player initial entry stage to display the player initials screen 618. Each EGM 10 accepts a player's input of initials and sends the initials to the host EGM 1110. The host EGM 1110 requests player's re-input when a collision of the initials is detected.

In method step 1206, the host gaming machine 1110 initiates the music selection for the tournament skill game 1114. For example, the selected EGM 10 accepts player's selection of music pieces. The selected EGM 10 sends information of selected music pieces to the host EGM 1110. The host EGM 1110 sends information of selected music pieces to the node EGMs 1112.

In method step 1208, the host gaming machine 1110 initiates play of the tournament skill game 1114. For example, the host EGM 1110 inquire each node EGM 1112 whether it is ready to start gameplay. After receiving "ready" from all node EGMs 1112, the host EGM 1110 sends a signal indicating that it is ready to start the tournament gameplay to all node EGMs 1112. In response to sending/receiving the signal, each EGM 10 starts gameplay of the tournament gameplay. Each EGM 10 provides a gameplay of the same music piece with the same marker pattern simultaneously with score calculation method of the skill contest game 170.

During a gameplay, each node EGM 1112 sends a current score of the player to the host EGM 1110 for every 20 skill event markers 90 that are played. The host EGM 1110 aggregates the current score of all EGMs 10 and generates a current ranking and score of the players. The host EGM 1110 sends the current ranking and score to node EGMs 1112. The current ranking and score is displayed on the second display 28 of all EGMs 10. After completion of a gameplay, each node EGM 1112 sends final score of the player to the host EGM 1110. The host EGM 1110 aggregates the final score of all EGMs 10 and generates a total ranking and score of the gameplay. The host EGM 1110 sends the final ranking and score to node EGMs 1112. The final ranking and score is displayed on the second display of all EGMs 10.

In method step 1210, the host gaming machine 1110 determines if each music soundtrack, e.g. round of the tournament skill game 1114, has been played. If the host gaming machine 1110 determines that not all of the music soundtracks have been played, the host gaming machine executes method step 1212 to continue tournament game play. Upon determining that each music soundtrack has been played, the host gaming machine executes method step 1214.

In method step 1212, the host gaming machine 1110 generates and displays the current total score and ranking. For example, the host EGM 1110 generates a current total score and ranking with accumulating the players score for the completed gameplay. The host EGM 1110 sends the current total score and ranking to node EGMs 1112. The current total score and ranking is displayed on the second display of all EGMs 10.

In method step 1214, the host gaming machine 1110 is programmed to generate a final score and ranking for each player. The host EGM 1110 generates a final total score and ranking with accumulating the players score for the all gameplay. The host EGM 1110 sends the final total score and ranking to node EGMs 1112. The final total score and ranking is displayed on the second display 28 of all EGMs 10. Each player's final total score and ranking is displayed on the display of the player's EGM 10. The operator of the tournament game may pay a winner some prize or award to the player with hand-pay. Alternatively, the EGMs 10 may calculate a credit award using method 1014 and pay the award to the winner automatically.

Figure 74:
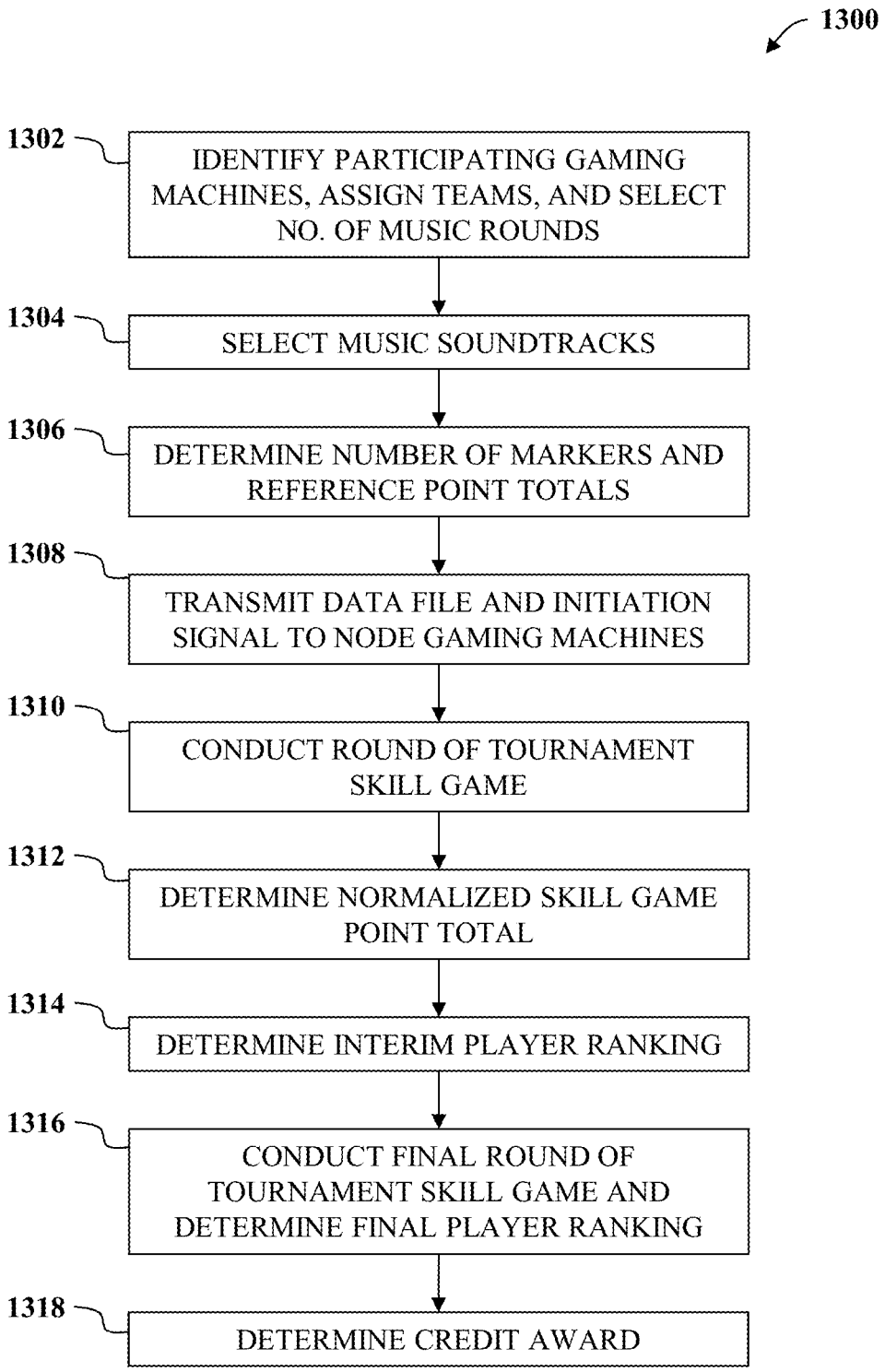
Figure 78:
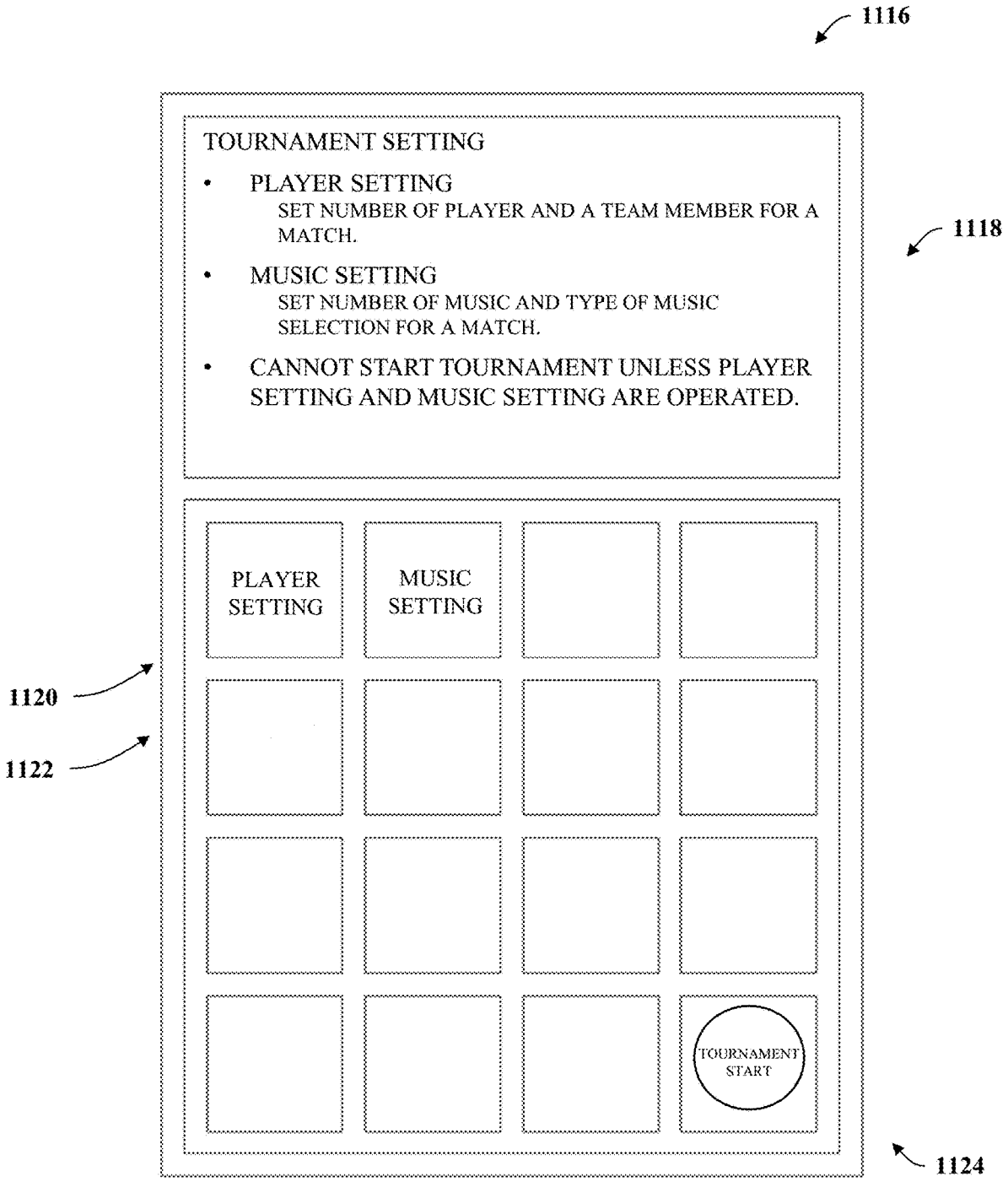
FIGS. 78-82 are illustrations of graphical displays of a game screen including the tournament skill game that may be displayed on the gaming machine shown in FIG. 1, according to an embodiment of the present invention.
Figure 79:
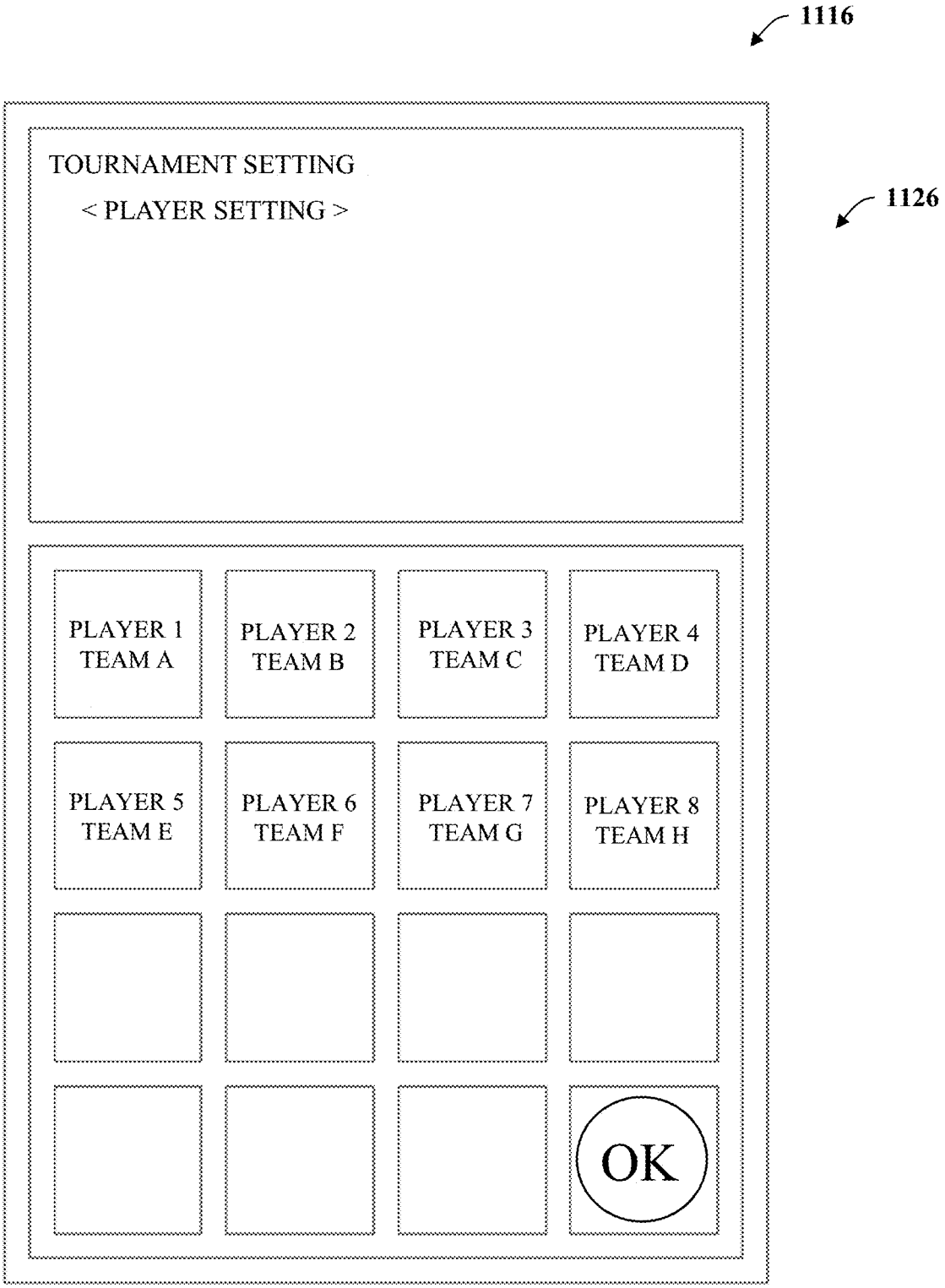

FIG. 74 is flowchart of another method 1300 that may be used to operate the gaming system 1100 to provide a tournament skill game using a plurality of networked gaming machine 10. Portions of the method may be performed by any one of, or any combination of, the components of one or more gaming machines 10.

In the illustrated embodiment, in method step 1302, the host gaming machine 1110 is programmed to identify participating gaming machines 10, assign team identifiers to each participating gaming machine 10, and select a number of music rounds included in the tournament skill game 1114.

For example, the host gaming machine 1110 may display the tournament set-up screens 1116 and receive selections from a tournament operator. In one embodiment, the host gaming machine 1110 is programmed to receive a request to initiate a tournament skill game with the plurality of gaming machines 10 and responsively display the tournament set-up screens 1116. Upon receiving an operators selection of the player setting button 1120, the host gaming machine 1110 displays a player setting screen 1126 to enable the operator to identify a number of players and/or a number of gaming machines 10 that are participating the tournament skill game 1114.

In one embodiment, the host gaming machine 1110 may display the individual competition player setting screen 1128 that allows the operator to configure the tournament skill game 1114 in the individual competition mode. The host gaming machine 1110 is programmed to display a team competition player setting screen 1130 that allows the operator to configure the tournament skill game 1114 in the team competition mode.

Upon receiving the operator's selections using the individual competition player setting screen 1128 or the team competition player setting screen 1130, the host gaming machine 1110 identifies the participating gaming machines from the plurality of gaming machines that are participating in the tournament skill game and assigns a team identifier to each participating gaming machine 10. In the illustrated embodiment, the participating gaming machines include the host gaming machine 1110 and at least one participating node gaming machine 1112. In one embodiment, the host gaming machine 1110 is programmed to generate to access a team data file 1132 being stored in the data and generate an EGM identification file 1134 including information associated with each identified participating gaming machine 10 based on the information included in the team data file 1132 and selections being made by the operator via the player setting screens 1128 and 1130.

In one embodiment, the host gaming machine 1110 is configured to operate the tournament skill game in an individual competition mode and a team competition mode. The host gaming machine 1110 assigns each team identifier to a single participating gaming machine in the individual competition mode, and assigns each team identifier to at least two participating gaming machines in the team competition mode.

In method step 1304, the host gaming machine 1110 receives selection of music soundtracks associated with the tournament skill game 1114. In one embodiment, the host gaming machine 1110 receives an operator's selections of participating gaming machines 10 that will be used to select the music soundtracks via the music setting screen 1140, and transmits a signal to each selected participating gaming machine 10 to display the music selection screen 116 to prompt the corresponding player to select a music soundtrack. The host gaming machine 1110 may also prompt the operator to select the music soundtracks.

In method step 1306, the host gaming machine 1110 determines a number of skill events 90 and a sequential display pattern 182 associated with each selected musical soundtrack. For example, in one embodiment, the host gaming machine 1110 may access the music data file 174 (shown in FIG. 37) to determine the number of skill events 90 and the sequential display pattern 182 associated with each selected musical soundtrack.

In method step 1308, the host gaming machine 1110 generates and transmits a data file to each participating node gaming machine 1112 indicating the selected musical soundtracks and the number of skill events and the sequential display pattern associated with each musical soundtrack.

In method step 1310, the host gaming machine 1110 transmits an initiation signal to each participating node gaming machine 1112 to cause each participating node gaming machine 1112 to initiate the tournament skill game in coordination with the host gaming machine 1110. Each of the participating gaming machines 10 simultaneously conducts a round of the tournament skill game including displaying the skill events in the sequential display pattern with the selected musical soundtrack. In one embodiment, each participating gaming machine 10 executes method 900 and/or method 1000 to simultaneously display the skill contest game 170 to each participating tournament player. For example, each participating gaming machine 10 is configured to conduct the round of the tournament skill game including detecting a player touch operation associated with each skill event and determining an amount of skill game points associated with each detected player touch operation.

In method step 1312, each participating gaming machine 10 calculates a normalized score associated with the corresponding player for the current round of the tournament skill game 1114 and transmits the normalized score to the host gaming machine 1110. For example, in one embodiment, each participating gaming machine 10 is programmed to execute method 900 and/or method 1000 to determine a reference point total as a function of the number of skill events displayed in a round of the game, determine a total amount of base points associated with the detected player touch operations, and determine a normalized skill game point total based on the total amount of base points and the reference point total. In one embodiment, the host gaming machine 1110 may be programmed to receive total base points from each participating gaming machine 10, generate the normalized skill game point total 606 from each participating player, and transmit the generated normalized skill game point total 606 to each participating gaming machine 10.

In method step 1314, the host gaming machine 1110 receives the normalized skill game point totals from each participating gaming machine 10 at the completion of each round of the tournament skill game 1114, and generates an interim player ranking based on the received scores. For example, each participating gaming machine 10 may be configured to calculate an interim normalized skill game point total upon the completion of a predefined number of skill events during a round of the tournament skill game. The host gaming machine 1110 is configured to receive a corresponding interim normalized skill game point total from each participating node gaming machine, establish an interim ranked list 1142 (shown in FIG. 83) of participating players based on the received interim normalized skill game point totals and transmit the interim ranked list to each participating node gaming machine for use in displaying the interim ranked list to the participating players during the round of the tournament skill game. In one embodiment, the host gaming machine 1110 may be programmed to generate the interim ranked list at the completion of each round. In another embodiment, the host gaming machine 1110 may update the interim ranked list during a current round after a predefined number of skill event markers 90 have been displayed, to allow participating players to view their corresponding rankings while playing the tournament game.

In method step 1316, the host gaming machine 1110 is programmed to determine when the final music soundtrack has been completed, and request a final normalized skill game point total from each participating gaming machine 10. For example, the host gaming machine may be configured to receive a signal from each participating node gaming machine indicating a corresponding normalized skill game point total, generate a final ranked list of participating players based on the received corresponding normalized skill game point total and transmit the final ranked list to each participating node gaming machine for use in displaying the ranked list to the participating players via the participating node gaming machines.

In method step 1318, each participating gaming machine 10 calculates an amount of gaming credits included in a corresponding award by multiplying a corresponding normalized skill game point total by a ratio of gaming credits to skill game points and adjusts the credit balance associated with a corresponding player as a function of the corresponding award. For example, in one embodiment, each participating gaming machine 10 may be programed to execute method 1014 to calculate an amount of gaming credits to be provide to a corresponding player.

Figure 84:
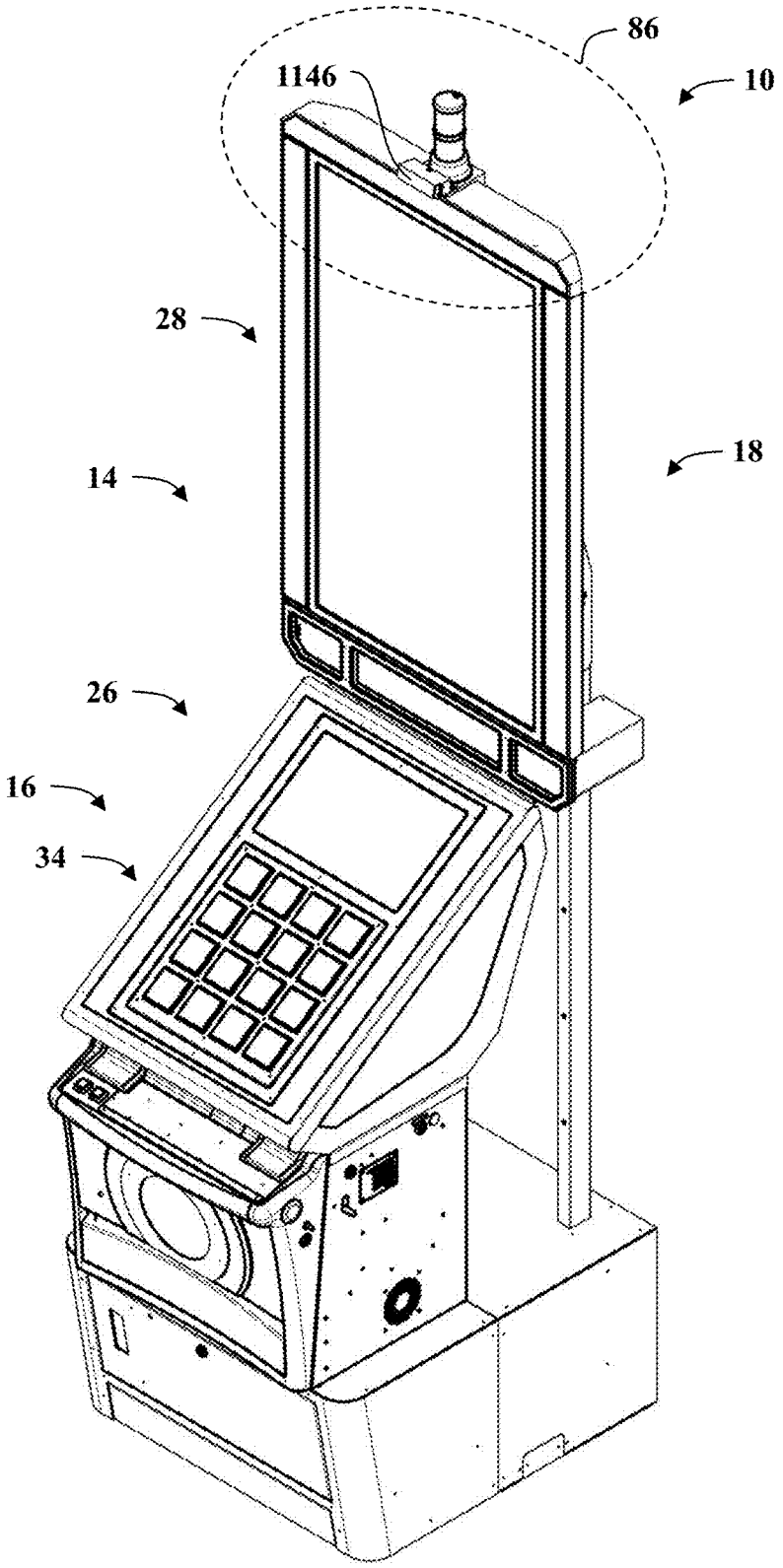
FIG. 84 is another perspective view of the gaming machine show in FIG. 1, according to an embodiment of the present invention.
Figure 85:
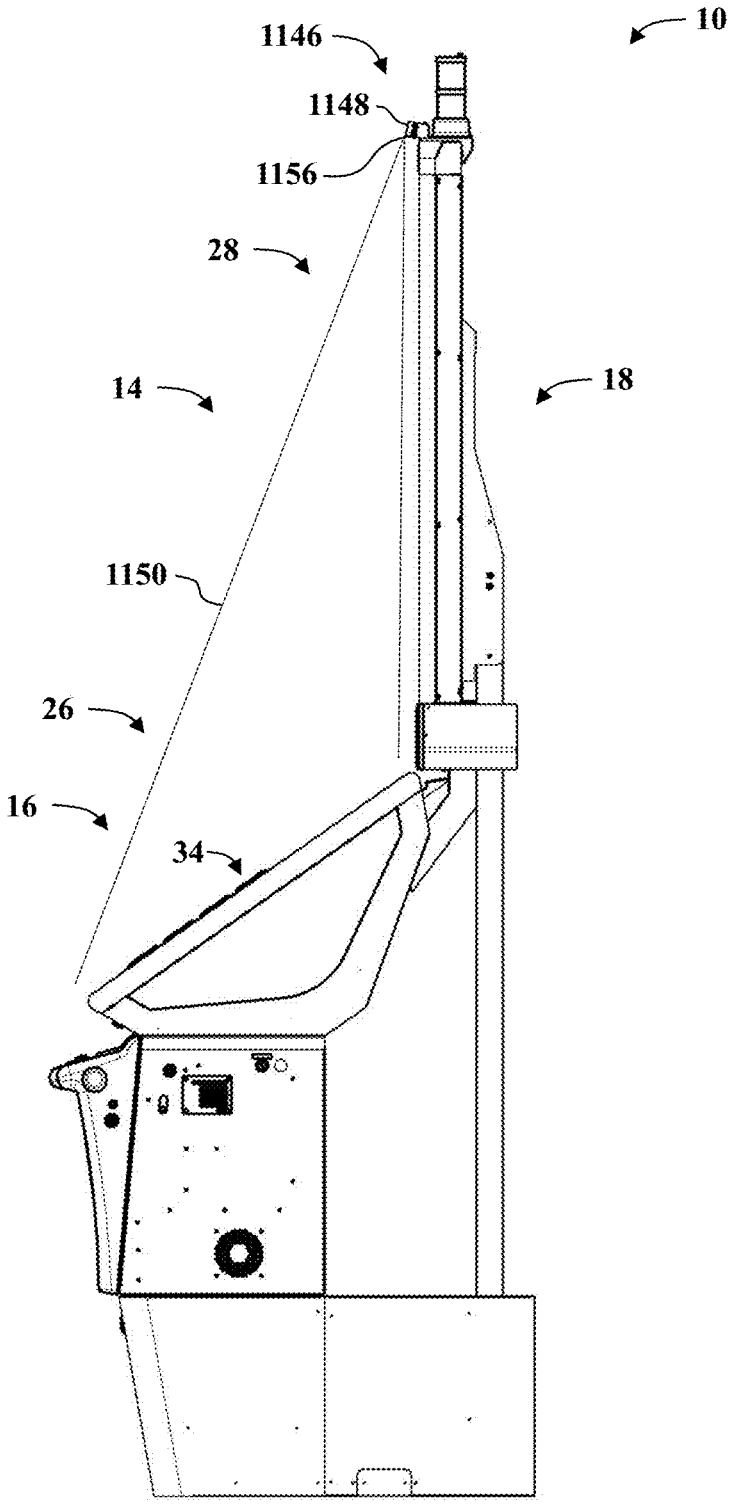
FIG. 85 is a perspective side view of the gaming machine show in FIG. 84.
Figure 86:
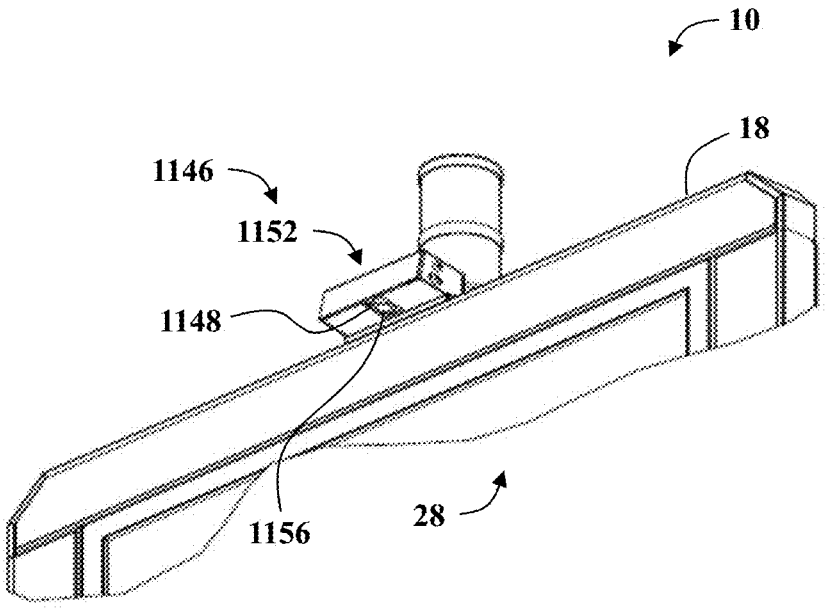
FIG. 86 is an enlarged perspective view of the gaming machine show in FIG. 84, taken along area 86 shown in FIG. 84.
Figure 87:
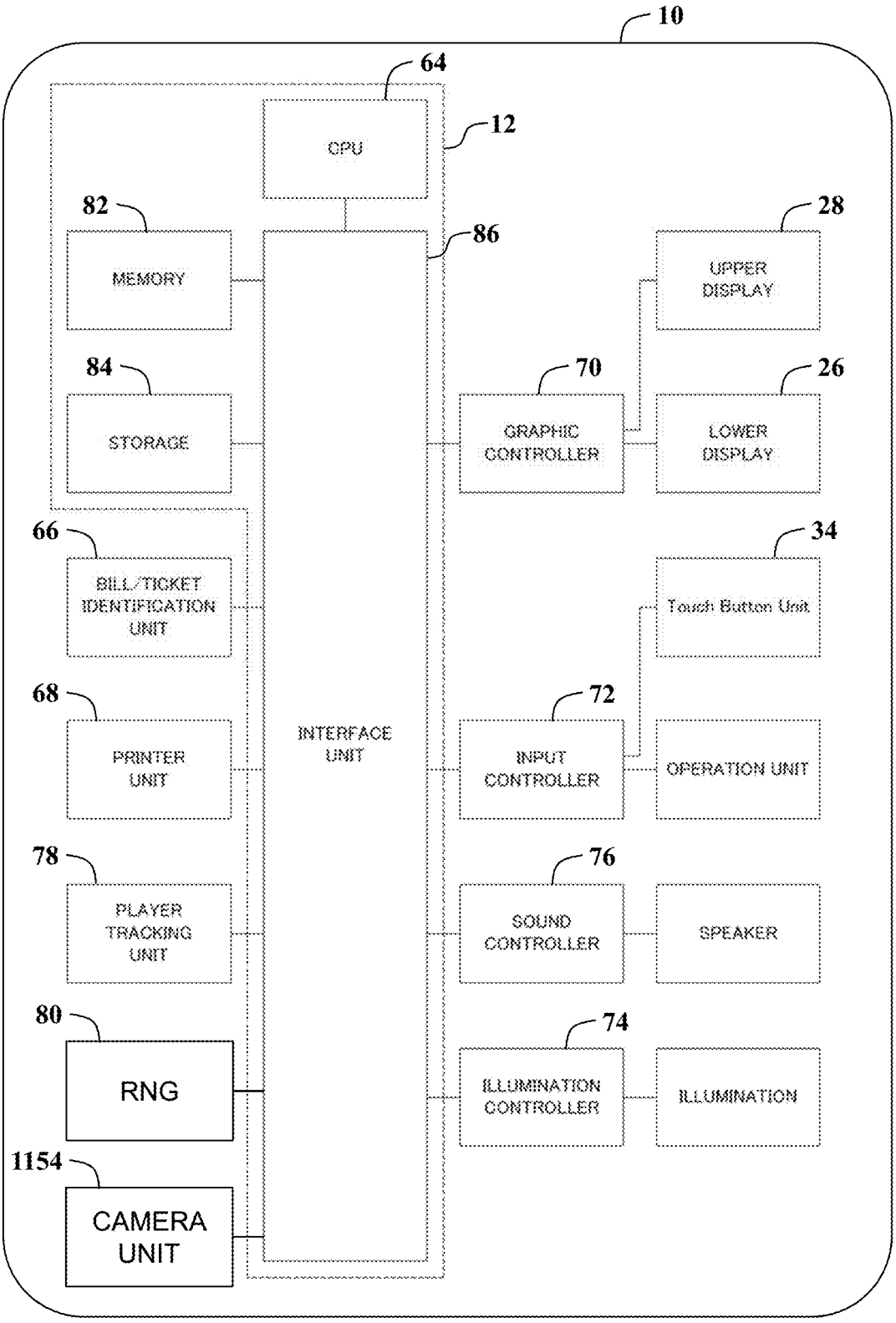
FIG. 87 is a functional block diagram of the gaming machine shown in FIG. 84, according to an embodiment of the present invention.
Figure 88:
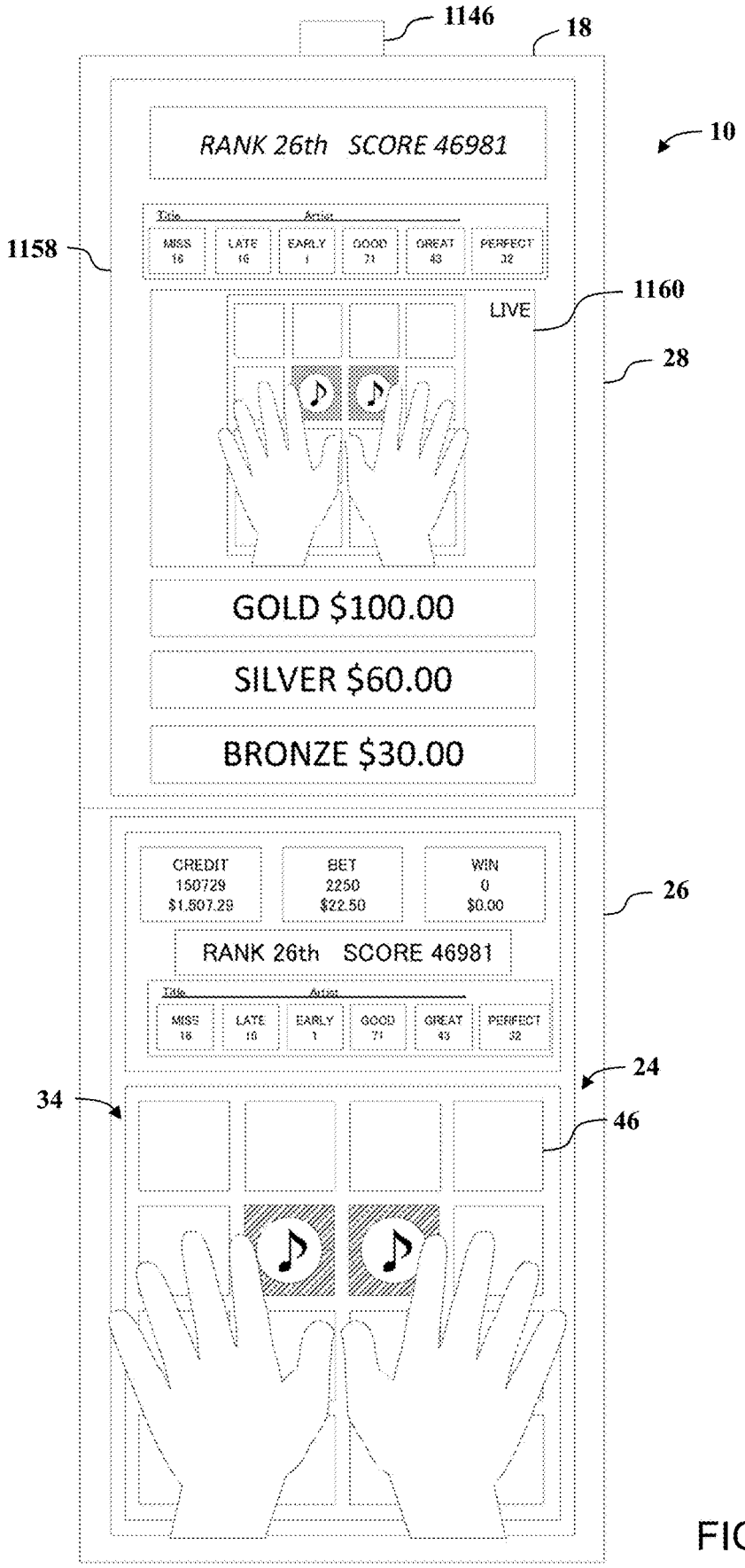
FIG. 88 is a schematic illustration of the gaming machine show in FIG. 84, according to an embodiment of the present invention.

FIG. 84 is perspective view of the gaming machine show in FIG. 1, according to an embodiment of the present invention. FIG. 85 is a perspective side view of the gaming machine show in FIG. 84. FIG. 86 is an enlarged perspective view of the gaming machine show in FIG. 84, taken along area 86 shown in FIG. 84. FIG. 87 is a functional block diagram of the gaming machine shown in FIG. 84, according to an embodiment of the present invention. FIG. 88 is a schematic illustration of the gaming machine show in FIG. 84, according to an embodiment of the present invention.

In the illustrated embodiment, the gaming machine 10 includes a video imaging camera assembly 1146 mounted to the cabinet assembly 18 and positioned above the upper LCD second display unit 28 of the cabinet assembly 18. The video imaging camera assembly 1146 has a lens system 1148 that is configured to concentrate light rays in an imaging range 1150, an imaging sensor 1152 for detecting the light rays being concentrated by the lens system 1148, and a camera control unit 1154 for controlling the lens system 1148 and the imaging sensor 1152. The lens system 1148 includes an imaging lens 1156 that is orientated such that the imaging sensor 1152 captures live video images of game play performed on the touch button unit 34 of the first display 26.

The lens system 1148 of the camera assembly 1146 faces touch button unit 34 in downward orientation so as to capture a player's skill operation on the touch button unit 34 in the imaging range 1150. As shown in FIG. 85, the imaging lens 1156 of the video imaging camera assembly 1146 is orientated such that the imaging range 1150 of the video imaging camera assembly 1146 extends over the touch button unit 34 and captures a player's hand motions as the player operates the touch button unit 34 during game play.

Referring to FIG. 87, in the illustrated embodiment, the gaming machine 10 includes the camera control unit 1154 that is programmed to operate the lens system 1148 and the imaging sensor 1152 to capture and transmit video images within the imaging range 1150 including images of a player's operation of the touch button unit 34 during game play. The camera control unit 1154 is coupled to the interface unit 86 and the gaming controller 12, and is programmed to transmit video images captured by the imaging sensor 1152 to the gaming controller 12.

The camera control unit 1154 is controlled by executing software program on the CPU 64. Under control of the camera control unit 1154, the video imaging camera assembly 1146 takes a video of the player's skill operation on the touch button unit 34 and displays the video image on the upper display 28 in real time (broadcast function). With broadcast function, player can show off his skillful play on the upper display.

In one embodiment, the gaming controller 12 is configured to display the video images received from the imaging sensor 1152 on a game progress screen 1158 being displayed on the second display 28.

For example, as shown in FIG. 88, during game play, the gaming controller 12 displays the skill-based game and/or skill contest game 170 on a game screen 24 being displayed with the touch button unit 34 on the first display 26. The gaming controller 12 also receives live video images of the game screen 24 and the player's hand movements from the imaging sensor 1152, and displays the live video images 1160 on the game progress screen 1158 being displayed in the second display 28. By displaying live video images 1160 on the second display 28, other spectators may view the player's actions during the game without distracting the player during game play.

FIG. 88 illustrates game screens that may be displayed on the upper display 28 and lower display 26 during a gameplay of skill contest game 170 with the broadcasting function (the camera enabled mode). In one embodiment, the gaming controller 12 is programmed to display a camera select button (not shown) on the music selection screen 166 to allows the player to enable or disable the use of the video imaging camera 1146 prior to game play.

Exemplary embodiments of a gaming machine, a gaming system, and a method of providing an award to a player are described above in detail. The gaming machine, system, and method are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, the gaming controller and/or the storage device may include a database which stores and retrieves data described herein as data records. The database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine for providing a skill-based wagering game to a player, comprising:

a display device configured to display a game screen using computer generated graphical images;

a user input device including a player selection device, an acceptor device, and a cashout device, the player selection device including a plurality of touch buttons arranged in a matrix, each touch button configured to display computer generated images and transmit a signal indicating a player touch operation associated with each of the user input buttons, the acceptor device configured to accept an item associated with a monetary value to establish a credit balance being increasable and decreasable based at least on wagering activity, the cashout device configured to receive an input to cause an initiation of a payout associated with the credit balance; and a controller including a processor programmed to:

receive a signal from the user input device indicating a wager being placed by the player;

initiate a skill contest game and display the skill contest game on the display device;

determine a number of skill events being included in the skill contest game;

determine a reference point total as a function of the number of skill events;

conduct a round of the skill contest game including displaying the skill events on the plurality of touch buttons in a sequential display pattern and synchronizing the display of the skill events with a musical soundtrack, each skill event including a plurality of sequential images being displayed in a corresponding touch button for a predefined event time period;

detect a player touch operation associated with each skill event being displayed in the plurality of touch buttons and determine a timing period of each detected player touch operation;

determine a total amount of base points associated with the detected player touch operations based on a corresponding timing period associated with each detected player touch operation;

determine a normalized skill game point total based on the total amount of base points and the reference point total;

determine an award as a function of the normalized skill game point total; and adjust the credit balance based on the award.

2. The gaming machine of claim 1, wherein the award includes an amount of gaming credits, the controller is programmed to:

determine a ratio of gaming credits to skill game points; and calculate the amount of gaming credits included in the award by multiplying the normalized skill game point total by the ratio of gaming credits to skill game points.

3. The gaming machine of claim 1, wherein the controller is programmed to:

calculate the normalized skill game point total by dividing the product of the total amount of base points and a predefined maximum skill game point total by the reference point total.

4. The gaming machine of claim 3, wherein the reference point total is a maximum total amount of base points associated with the skill contest game.

5. The gaming machine of claim 1, wherein the controller is programmed to:

select the musical soundtrack associated with the skill contest game from a plurality of musical soundtracks.

6. The gaming machine of claim 5, further comprising:

a memory device including a plurality of music data files, each music data file being associated with a musical soundtrack and including a predefined number of skill events and a timing record including a predefined sequential display pattern, the controller programmed to:

receive a player's selection of the musical soundtrack and select a music data file associated with the selected musical soundtrack;

determine the number of skill events associated with the selected musical soundtrack; and determine the reference point total as a function of the number of skill events associated with the selected musical soundtrack and a maximum base point amount associated with each skill event.

7. The gaming machine of claim 6, wherein the controller is programmed to:

display each skill event including an event time period having a plurality of consecutive operation timing periods, each operating timing period being associated with a predefined base point amount; and for each skill event:

determine a consecutive operation timing period associated with the player touch operation;

determine a number of base points acquired during the skill event by determining the predefined base point amount associated with the determined consecutive operation timing period associated with the player touch operation; and calculate the total amount of base points as the sum of the number of base points acquired for each skill event.

8. The gaming machine of claim 1, wherein the controller is programmed to:

initiate a primary skill-based wagering game upon receiving the wager from the player;

randomly determine if a trigger condition occurs with the primary skill-based wagering game; and initiate the skill contest game upon detecting the occurrence of the trigger condition.

9. A method of operating a gaming machine, the gaming machine including a display device, a user input device, and a controller including a processor, the method including the processor performing the steps of:

displaying a skill-based wagering game on the display device including a game screen using computer generated graphical images;

receiving a signal from the user input device indicating a wager being placed by the player, the user input device including a player selection device, an acceptor device, and a cashout device, the player selection device including a plurality of touch buttons arranged in a matrix, each touch button configured to display computer generated images and transmit a signal indicating a player touch operation associated with each of the user input buttons, the acceptor device configured to accept an item associated with a monetary value to establish a credit balance being increasable and decreasable based at least on wagering activity, the cashout device configured to receive an input to cause an initiation of a payout associated with the credit balance;

initiating a skill contest game and display the skill contest game on the game screen of the display device;

determining a number of skill events being included in the skill contest game skill;

determining a reference point total as a function of the number of skill events;

conducting a round of the skill contest game including displaying the skill events on the plurality of touch buttons in a sequential display pattern and synchronizing the display of the skill events with a musical soundtrack, each skill event including a plurality of sequential images being displayed in a corresponding touch button for a predefined event time period;

detecting a player touch operation associated with each skill event being displayed in the plurality of touch buttons and determining a timing period of each detected player touch operation;

determining a total amount of base points associated with the detected player touch operations based on a corresponding timing period associated with each detected player touch operation;

determining a normalized skill game point total based on the total amount of base points and the reference point total;

determining an award as a function of the normalized skill game point total; and adjusting the credit balance based on the award.

10. The method of claim 9, wherein the award includes an amount of gaming credits, the method including the processor performing the steps of:

determining a ratio of gaming credits to skill game points; and calculating the amount of gaming credits included in the award by multiplying the normalized skill game point total by the ratio of gaming credits to skill game points.

11. The method of claim 9, including the processor performing the steps of:

calculating the normalized skill game point total by dividing the product of the total amount of base points and a predefined maximum skill game point total by the reference point total.

12. The method of claim 11, wherein the reference point total is a maximum total amount of base points associated with the skill contest game.

13. The method of claim 9, including the processor performing the steps of:

selecting the musical soundtrack associated with the skill contest game from a plurality of musical soundtracks.

14. The method of claim 13, wherein the gaming machine includes a memory device including a plurality of music data files, each music data file being associated with a musical soundtrack and including a predefined number of skill events and a timing record including a predefined sequential display pattern, the method including the processor performing the steps of:

determining the number of skill events associated with the selected musical soundtrack; and determining the reference point total as a function of the number of skill events associated with the selected musical soundtrack and a maximum base point amount associated with each skill event.

15. The method of claim 14, including the processor performing the steps of:

displaying each skill event including an event time period having a plurality of consecutive operation timing periods, each operating timing period being associated with a predefined base point amount; and for each skill event:

determining a consecutive operation timing period associated with the player touch operation;

determining a number of base points acquired during the skill event by determining the predefined base point amount associated with the determined consecutive operation timing period associated with the player touch operation; and calculating the total amount of base points as the sum of the number of base points acquired for each skill event.

16. The method of claim 9, including the processor performing the steps of:

initiating a primary skill-based wagering game upon receiving the wager from the player;

randomly determining if a trigger condition occurs with the primary skill-based wagering game; and initiating the skill contest game upon detecting the occurrence of the trigger condition.

17. One or more non-transitory computer-readable storage media, having computer-executable instructions embodied thereon, wherein when executed by at least one processor, the computer-executable instructions cause the at least one processor to:

display a skill-based wagering game on a display device including a game screen using computer generated graphical images;

receive a signal from a user input device indicating a wager being placed by the player, the user input device including a player selection device, an acceptor device, and a cashout device, the player selection device including a plurality of touch buttons arranged in a matrix, each touch button configured to display computer generated images and transmit a signal indicating a player touch operation associated with each of the user input buttons, the acceptor device configured to accept an item associated with a monetary value to establish a credit balance being increasable and decreasable based at least on wagering activity, the cashout device configured to receive an input to cause an initiation of a payout associated with the credit balance;

initiate a skill contest game and display the skill contest game on the game screen of the display device;

determine a number of skill events being included in the skill contest game;

determine a reference point total as a function of the number of skill events;

conduct a round of the skill contest game including displaying the skill events on the plurality of touch buttons in a sequential display pattern and synchronizing the display of the skill events with a musical soundtrack, each skill event including a plurality of sequential images being displayed in a corresponding touch button for a predefined event time period;

detect a player touch operation associated with each skill event being displayed in the plurality of touch buttons and determine a timing period of each detected player touch operation;

determine a total amount of base points associated with the detected player touch operations based on a corresponding timing period associated with each detected player touch operation;

determine a normalized skill game point total based on the total amount of base points and the reference point total;

determine an award as a function of the normalized skill game point total; and adjust the credit balance based on the award.

18. The one or more computer-readable storage media according to claim 17, wherein when executed by at least one processor, the computer-executable instructions cause the processor to:

determine a ratio of gaming credits to skill game points; and calculate an amount of gaming credits included in the award by multiplying the normalized skill game point total by the ratio of gaming credits to skill game points.

19. The one or more computer-readable storage media according to claim 17, wherein when executed by at least one processor, the computer-executable instructions cause the processor to:

select the musical soundtrack associated with the skill contest game from a plurality of musical soundtracks;

determine the number of skill events associated with the selected musical soundtrack; and determine the reference point total as a function of the number of skill events associated with the selected musical soundtrack and a maximum base point amount associated with each skill event.

20. The one or more computer-readable storage media according to claim 19, wherein when executed by at least one processor, the computer-executable instructions cause the processor to:

display each skill event including an event time period having a plurality of consecutive operation timing periods, each operating timing period being associated with a predefined base point amount; and for each skill event:

determine a consecutive operation timing period associated with the player touch operation; and determine a number of base points acquired during the skill event by determining the predefined base point amount associated with the determined consecutive operation timing period associated with the player touch operation; and calculate the total amount of base points as the sum of the number of base points acquired for each skill event.

* * * * *